US007226728B2

(12) United States Patent
Inoue

(10) Patent No.: US 7,226,728 B2
(45) Date of Patent: Jun. 5, 2007

(54) PHOTOTHERMOGRAPHIC MATERIAL

(75) Inventor: Rikio Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/223,178

(22) Filed: Sep. 12, 2005

(65) Prior Publication Data

US 2006/0068341 A1 Mar. 30, 2006

(30) Foreign Application Priority Data

Sep. 24, 2004 (JP) ..... 2004-277858

(51) Int. Cl.

| | |
|---|---|
| ***G03C 1/00*** | (2006.01) |
| ***G03C 1/005*** | (2006.01) |
| ***G03C 1/494*** | (2006.01) |
| ***G03C 1/85*** | (2006.01) |
| ***G03C 1/08*** | (2006.01) |

(52) U.S. Cl. ..... 430/617; 430/618; 430/619; 430/620; 430/559; 430/631; 430/639; 430/640; 430/523; 430/527

(58) Field of Classification Search ..... 430/617–620, 430/559, 631, 639, 640, 523, 527
See application file for complete search history.

(56) References Cited

U.S. PATENT DOCUMENTS

| | | | | |
|---|---|---|---|---|
| 6,830,879 | B2 | 12/2004 | Suzuki et al. | |
| 2004/0234909 | A1* | 11/2004 | Inoue et al. | 430/617 |
| 2005/0214700 | A1* | 9/2005 | Yamamoto et al. | 430/619 |

FOREIGN PATENT DOCUMENTS

| | | |
|---|---|---|
| JP | A 2003-084395 | 3/2003 |

* cited by examiner

*Primary Examiner*—Geraldina Visconti
(74) *Attorney, Agent, or Firm*—Margaret A. Burke; Sheldon J. Moss

(57) ABSTRACT

The present invention provides a photothermographic material having: a support and an image-forming layer including a photosensitive silver halide, a non-photosensitive organic silver salt, a reducer, and a binder on at least one surface of the support, wherein the photothermographic material further contains a dye having a half breadth of 100 nm or less at a maximum absorbance peak, and 50 mass % or more of a binder in an outermost layer on a dye-containing surface is a polymer latex.

27 Claims, No Drawings

PHOTOTHERMOGRAPHIC MATERIAL

CROSS-REFERENCE TO RELATED APPLICATION

This application claims priority under 35 U.S.C. 119 from Japanese Patent Application No. 2004-277858, the disclosure of which is incorporated by reference herein.

BACKGROUND OF THE INVENTION

1. Field of the Invention

The present invention is related to a photothermographic material which is used advantageously in the fields of films for medical diagnosis and films for photoengraving.

2. Description of the Related Art

Reduction in the amounts of waste processing solutions has been strongly desired in recent years in the field of medical imaging from the viewpoints of environmental protection and space saving. Under such circumstances, technologies on photothermographic image-recording materials as films for medical diagnosis and photoengraving which can be exposed to light efficiently with a laser image setter or a laser imager, and can form a clear black image having high resolution and sharpness have been demanded. With these photothermographic materials, it is possible to supply to customers a heat development treatment system which has eliminated the necessity of using solvent processing chemicals, and is simpler and does not impair the environment.

The similar requirements also exist in the field of general image forming materials. However, the image for medical use is required to have a high image quality excellent in sharpness and graininess, because fine details of the image are required. In addition, the medical image is characterized by preferably exhibiting a blue black image tone from the viewpoint of ease of medical diagnosis. Currently, various hard copy systems utilizing pigments or dyes such as inkjet printers and apparatuses for electrophotography are prevailing as general image forming systems. However, there is no system which is satisfactory as a medical image-output system.

On the other hand, thermal image forming systems utilizing organic silver salts are described in, for example, U.S. Pat. Nos. 3,152,904 and 3,457,075, and in "Thermally Processed Silver systems" (Imaging Processes and Materials), Neblette, 8th edition, edited by J. Sturge, V. Warlworth, and A. Shepp, Chapter 9, page 279 in 1989. In particular, photothermographic materials generally have an image-forming layer in which a catalytically active amount of photocatalyst (for example, a silver halide), a reducing agent, a reducible silver salt (for example, an organic silver salt) and, optionally, a color tone adjusting agent for controlling the tone of a developed silver image are dispersed in a binder matrix. When the photothermographic material is imagewise exposed to light and then heated to a high temperature (for example, 80° C. or higher), a redox reaction between the reducible silver salt (functioning as an oxidizer) and the reducing agent occurs to form a black-toned silver image. The redox reaction is promoted by the catalytic activity of a latent image of silver halide formed by exposure. Accordingly, the black-toned silver image is formed in an exposed region.

Such photothermographic materials have been already known. However, in many of these recording materials, the image-forming layer is formed using an organic solvent such as toluene, methyl ethyl ketone, or methanol. It is not advantageous to use an organic solvent since the organic solvent may cause harmful effects on human during the production process of the recording materials, and since it is costly to collect the solvent and to conduct other related processes.

In order to solve such problems, a method has been proposed in which a water-based coating liquid is used for forming an image-forming layer (hereinafter sometimes referred to as "water-based photosensitive layer." For example, techniques of using gelatin as a binder are disclosed in Japanese Patent Application Laid-Open (JP-A) Nos. 49-52626 and 53-116144. Further, a technique of using polyvinyl alcohol as a binder is disclosed in JP-A No. 50-151138.

However, these techniques are not practically satisfactory since the fogging level is significant and the tone of a formed image is not good. On the other hand, a technique of using polymer latex binder and water-based medium for forming an image-forming layer is disclosed in JP-A Nos. 10-10669 and 10-62899.

Photographic photosensitive materials usually contain a dye for, for example, prevention of halation, prevention of irradiation, filtering function or adjustment of image color tone. There are also similar requirements for photothermographic materials. However, unique functions that are not found in conventional wet-developing photosensitive materials are also required for the photothermographic materials. That is, all raw materials needed for image formation should be previously contained in the coated film, and these raw materials and reaction products thereof remain therein even after thermal development.

Generally, dyes have not only absorption in a required wavelength region but also side absorption at wavelengths longer and shorter than the range, and therefore, for example, an infrared absorption dye for infrared exposure has absorption in the visible region, resulting in a visually observable color. For this reason, decoloration of a dye used in a photothermographic material by a chemical reaction occurring due to heating during thermal development has been attempted. However, introduction of such a decoloration mechanism results in problems such as increase in turbidity and film thickness, and due to adverse effects on the photographic characteristics of the resulting image, introduction thereof into the image-forming layer or neighboring layers is difficult. In addition, slowness of a decoloration reaction makes it difficult to rapidly perform decoloration.

Alternatively, use of dyes with a narrower absorption spectrum that have smaller side absorption, without a decoloration mechanism, has also been attempted (e.g., U.S. Pat. No. 6,830,879 and JP-A No. 2003-84395). Characteristically, these dyes exhibit a narrow absorption spectrum by forming an aggregate and effectively have a maximum absorption wavelength in the required wavelength region, and therefore are effective even with a small amount.

However, there are many requirements for such dyes because photothermographic materials are used in various environments, and these dyes still do not sufficiently satisfy these requirements. In particular, under the circumstance inherent to the photothermographic materials, that the dye remains and is stored in the film even after image formation, there are new unexpected problems that have not been encountered in the past, and thus these exists a need for improvement and new methods of solving such problems.

Accordingly, there exists a need for a photothermnographic material that has good sharpness and good image storability and provides a preferable image color tone.

SUMMARY OF THE INVENTION

The invention provides a photothermographic material having: a support and an image-forming layer including a photosensitive silver halide, a non-photosensitive organic silver salt, a reducer, and a binder on at least one surface of the support, wherein the photothermographic material further contains a dye having a half breadth of 100 nm or less at a maximum absorbance peak, and 50 mass % or more of a binder in an outermost layer on a dye-containing surface is a polymer latex.

The invention can provide a photothermographic material that has good sharpness and good image storability and provides a preferable image color tone.

DESCRIPTION OF THE PREFERRED EMBODIMENTS

Hereinafter, the present invention will be described in detail. The photothermographic material of the invention has a support and an image-forming layer including a photosensitive silver halide, a non-photosensitive organic silver salt, a reducer, and a binder on at least one surface of the support, and further contains a dye having a half breadth of 100 nm or less at a maximum absorbance peak. In the material, fifty mass % or more of a binder in an outermost layer on a dye-containing surface is a polymer latex.

The half breadth in the invention means an absorption width at the half height of the maximum absorbance peak in the visible and infrared regions of the absorption spectrum of the dye.

When the photothermographic material has on one surface of the support at least one layer including the image-forming layer, the dye may be contained in at least one of the at least one layer. Alternatively, the dye may be contained in a back layer.

Preferably, the dye is a water-soluble dye.

The water-soluble dye is preferably a metal phthalocyanine dye represented by the following Formula (PC-1).

The dye is preferably contained in a layer other than the outermost layer, because this is effective.

Formula (PC-1)

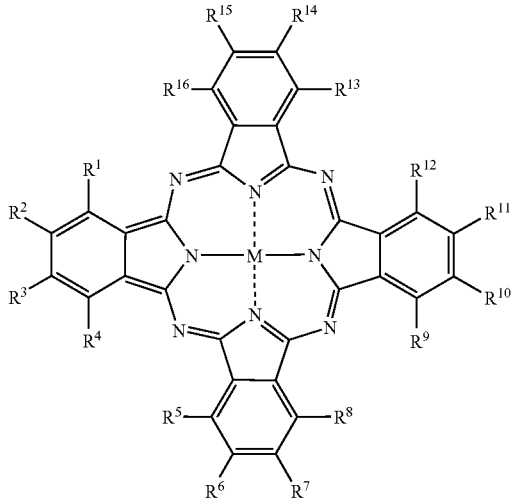

In the formula, M represents a metal atom. $R^1$, $R^4$, $R^5$, $R^8$, $R^9$, $R^{12}$, $R^{13}$, and $R^{16}$ independently represent a hydrogen atom or a substituent, and at least one of $R^1$, $R^4$, $R^5$, $R^8$, $R^9$, $R^{12}$, $R^{13}$, and $R^{16}$ is an electron-attractive group. $R^2$, $R^3$, $R^6$, $R^7$, $R^{10}$, $R^{11}$, $R^{14}$, and $R^{15}$ independently represent a hydrogen atom or a substituent.

In Formula (PC-1), at least one of $R^1$, $R^4$, $R^5$, $R^8$, $R^9$, $R^{12}$, $R^{13}$, and $R^{16}$ is preferably a group represented by Formula (II):

$$-L^1-R^{17} \qquad \text{Formula (II)}$$

In the formula, $L^1$ represents **—$SO_2$—*, **—$SO_3$—*, **—$SO_2NR_N$—*, **—SO—*, **—CO—*, **—$CONR_N$—*, **—COO—*, **—COCO—*, **—$COCO_2$—*, or **—$COCONR_N$—*. ** represents a site at which the group is connected to the phthalocyanine skeleton, while * represents a site at which the group is connected to $R^{17}$. $R_N$ represents a hydrogen atom or an alkyl, aryl, heterocyclic, acyl, alkoxycarbonyl, carbamoyl, sulfonyl, or sulfamoyl group. $R^{17}$ represents a hydrogen atom or an alkyl, aryl, or heterocyclic group.

More preferably, four or more of $R^1$, $R^4$, $R^5$, $R^8$, $R^9$, $R^2$, $R^3$, and $R^{16}$ are each the group represented by Formula (II).

Alternatively, the water-soluble dye is preferably an aggregation dye. The aggregation dye is preferably a polymethine dye, and more preferably a cyanine or oxonol dye.

The polymer latex in the outermost layer preferably has a glass transition temperature (Tg) of −20° C. to 70° C. In addition, the outermost layer preferably contains a gelling agent.

The photothermographic material preferably has a non-photosensitive intermediate layer between the outermost layer and the image-forming layer, and more preferably two non-photosensitive intermediate layers, and 50 mass % or more of the binder(s) for a non-photosensitive intermediate layer adjacent to the image-forming layer is a polymer latex having a monomer component represented by the following Formula (M).

$$CH_2{=}CR^{01}{-}CR^{02}{=}CH_2 \qquad \text{Formula (M)}$$

In the formula, $R^{01}$ and $R^{02}$ are each a hydrogen, an alkyl group having 1 to 6 carbon atoms, a halogen atom or a cyano group.

In addition, 50 mass % or more of the binder(s) for a non-photosensitive intermediate layer adjacent to the outermost layer is preferably an animal protein-derived hydrophilic polymer and more preferably gelatin.

The inventor of the invention encountered an unexpected problem, when a dye having a half breadth of 100 nm or less at a maximum absorbance peak is introduced into a photothermographic material. The inventor found the following facts. That is, some photothermographic materials have a sharp absorption spectrum with a half breadth of 100 nm or less immediately after production, but, after thermal development, have an extremely broad absorption spectrum, or a maximum absorption peak at a wavelength completely different from the wavelength of the absorption maximum peak before thermal development. As a result of intensive studies, the inventor further found the following facts. A dye showing such a sharp absorption forms in water a particular aggregate that has the sharp absorption, or has a highly planer structure. In the latter case, the dye is oriented by a solvent such as water or is oriented along the surface of a support, consequently showing the sharp absorption. Such sharp absorption characteristics are lost if the aggregate is broken down or the orientation thereof is disturbed by heating during thermal development, particularly, by heating in the presence of a trace amount of water. After further research for an improved means based on the above analytical results, the inventor has found that it is possible to achieve such an improvement by forming an outermost layer including a hydrophobic polymer latex, and completed the invention. Hydrophobic polymer latexes are already known in the field of photographic application, but the effects thereof on the particular problem associated with photothermographic materials are entirely unexpected.

Dye having a Half Breadth of 100 nm or Less at Maximum Absorbance Peak

In the invention, the dye having a half breadth of 100 nm or less at a maximum absorbance peak is preferably a metal phthalocyanine dye or an aggregate-forming dye. The metal phthalocyanine dye is preferably represented by Formula (PC-1). The aggregate-forming dye is preferably a polymethine dye, and more preferably a cyanine or oxonol dye. The half breadth is preferably 80 nm or less and more preferably 50 nm or less.

The wavelength region of the maximum absorbance peak is preferably 600 nm to 750 nm, more preferably 600 nm to 720 nm, and still more preferably 620 nm to 700 nm.

Hereinafter, the dye is described in detail.

1) Metal Phthalocyanine Compound

The dye is particularly preferably a metal phthalocyanine compound represented by the following Formula (PC-1).

Formula (PC-1)

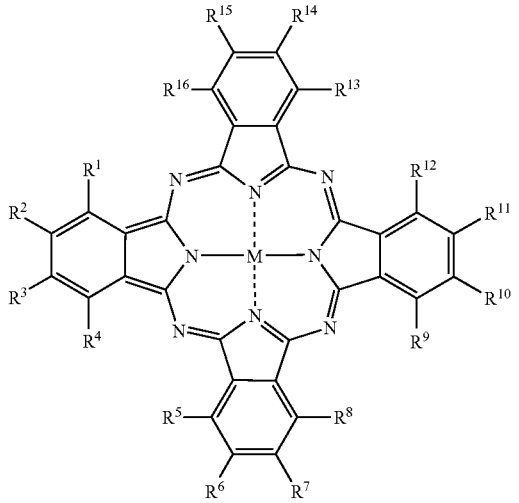

In Formula (PC-1), M represents a metal atom. The metal preferably forms a stable complex, and there is no other limitation on the metal. Examples thereof include Li, Na, K, Be, Mg, Ca, Ba, Al, Si, Cd, Hg, Cr, Fe, Co, Ni, Cu, Zn, Ge, Pd, Cd, Sn, Pt, Pb, Sr, and Mn. The metal is preferably Mg, Ca, Co, Zn, Pd, or Cu, more preferably Co, Pd, Zn, or Cu, and still more preferably Cu.

<Description of Substituent>

In Formula (PC-1), $R^1$, $R^4$, $R^5$, $R^8$, $R^9$, $R^{12}$, $R^{13}$, and $R^{16}$ independently represent a hydrogen atom, or a substituent, and at least one of $R^1$, $R^4$, $R^5$, $R^8$, $R^9$, $R^{12}$, $R^{13}$, and $R^{16}$ is an electron-attractive group.

Herein, the electron-attractive group is a halogen atom, a cyano group, a nitro group, or —C(═O)—R, —C(═O)—C(═O)—R, —S(═O)—R, —S(═O)$_2$—R, —C(═N—R')—R, —S(═NR')—R, —S(═NR')$_2$—R, —P(═O)$R_2$, —O—R", —S—R", —N(—R')—C(═O)—R, ═N(—R')—S(═O)—R, —N(—R')—S(═O)$_2$—R, —N(—R')—C(═N—R')—R, —N(—R')—S(═NR')$_2$—R, or —N(—R')—P(═O)$R^2$ group. R represents a hydrogen atom or an alkyl, aryl, heterocyclic, amino, alkyloxy, aryloxy, heterocyclic-oxy, —OH, aklylthio, arylthio, heterocyclic-thio, or SH group. R' represents a hydrogen atom or an alkyl, aryl, heterocyclic, acyl, sulfonyl, sulfinyl, or phosphoryl group. R" represents a perfluoroalkyl, cyano, acyl, sulfonyl, or sulfinyl group.

The group represented by R, R', or R" may be substituted with a substituent, and specific examples of the substituent include halogen atoms (fluorine, chlorine, bromine, and iodine), alkyl groups (including, for example, aralkyl, cycloalkyl, and active methine groups), alkenyl groups, alkynyl groups, aryl groups, heterocyclic groups (the position of the substitution site is not limited), heterocyclic groups containing one or more quaternary nitrogen atoms (e.g., pyridinio, imidazolio, quinolinio, and isoquinolinio groups), acyl groups, alkoxycarbonyl groups, aryloxycarbonyl groups, carbamoyl groups, a carboxy group and salts thereof, sulfonylcarbamoyl groups, acylcarbamoyl groups, sulfamoylcarbamoyl groups, carbazoyl groups, an oxalyl group, an oxamoyl group, a cyano group, a thiocarbamoyl group, a hydroxy group, alkoxy groups (including groups repeatedly containing ethyleneoxy or propyleneoxy units), aryloxy groups, heterocyclic-oxy groups, acyloxy groups, (alkoxy or aryloxy)carbonyloxy groups, a carbamoyloxy group, a sulfonyloxy group, an amino group, (alkyl, aryl, or heterocyclic)-amino groups, acylamino groups, a sulfonamide group, an ureido group, a thioureido group, imide groups, (alkoxy or aryloxy) carbonylamino groups, a sulfamoylamino group, semicarbazide groups, thiosemicarbazide groups, hydrazino groups, ammonio groups, oxamoylamino groups, (alkyl or aryl)-sulfonylureido groups, acylureido groups, acylsulfamoylamino groups, a nitro group, a mercapto group, (alkyl, aryl, or heterocyclic)-thio groups, (alkyl or aryl)-sulfonyl groups, (alkyl or aryl)-sulfinyl groups, a sulfo group and salts thereof, a sulfamoyl group, acylsulfamoyl groups, a sulfonylsulfamoyl group and salts thereof, groups containing a phosphoric acid amide or phosphoric acid ester structure, silyloxy groups (e.g., trimethylsilyloxy and t-butyldimethylsilyloxy groups), and silyl groups (e.g., trimethylsilyl, t-butyldimethylsilyl, and phenyldimethylsilyl). These substituents may be additionally substituted with a substituent.

The electron-attractive group in Formula (PC-1) is preferably a group represented by Formula (II).

$$-L^1-R^7 \qquad \text{Formula (II)}$$

$L^1$ represents **—$SO_2$—*, **—$SO_3$—*, **—$SO_2NR_N$—*, **—SO—*, **—CO—*, **—$CONR_N$—*, **—COO—*, **—$COCO_2$—*, or **—$COCONR_N$—*. ** represents a site at which the group is connected to the phthalocyanine skeleton, and * represents a site at which the group is connected to $R^{17}$. $R_N$ represents a hydrogen atom or an alkyl, aryl, heterocyclic, acyl, alkoxycarbonyl, carbamoyl, sulfonyl, or sulfamoyl group. $R_N$ may be additionally substituted with a substituent that $R^1$, $R^4$, $R^5$, $R^8$, $R^9$, $R^{12}$, $R^{13}$, or $R^{16}$ in Formula (PC-1) may be. $L^1$ preferably represents **—$SO_2$—*, **—$SO_2NR_N$—*, **—CO—*, **—$CONR_N$—* or **—COO—*, more preferably **—$SO_2$—*, **—$SO_2NR_N$—*, or **—$CONR_N$—*, and still more preferably **—$SO_2$—* or **—$SO_2NR_N$—*.

$R_N$ preferably represents a hydrogen atom or an alkyl, aryl or heterocyclic group, more preferably a hydrogen atom, an alkyl group having 1 to 20 carbon atoms, an aryl group having 6 to 20 carbon atoms or a heterocyclic group having 1 to 20 carbon atoms, still more preferably a hydrogen atom, an alkyl group having 1 to 10 carbon atoms, an aryl group having 6 to 10 carbon atoms or a heterocyclic group having 1 to 10 carbon atoms, and most preferably a hydrogen atom or an alkyl group having 1 to 6 carbon atoms.

$R^{17}$ represents a hydrogen atom or an alkyl, aryl, or heterocyclic group. When $R^{17}$ represents an alkyl, aryl or heterocyclic group, $R^{17}$ may be additionally substituted with a substituent that $R^1$, $R^4$, $R^5$, $R^8$, $R^9$, $R^{12}$, $R^{13}$, or $R^{16}$ in Formula (PC-1) may be. $R^{17}$ preferably represents an alkyl or aryl group, and more preferably an alkyl group. $R^{17}$ preferably has 1 to 30 carbon atoms, more preferably 1 to 20 carbon atoms, and still more preferably 1 to 10 carbon atoms.

$R^{17}$ is preferably substituted with a hydrophilic group. The hydrophilic group indicates a carboxyl group, a sulfo group, a phosphate group, a group having a quaternary ammonium salt structure, a group having a quaternary phosphonium salt structure, or a polyethyleneoxy group. When the hydrophilic group is a carboxyl, sulfo, or phosphate group, the dye of Formula (PC-1) may have a counter cation, as needed. The counter cation is a metal cation, an ammonium ion, a group having a quaternary ammonium salt structure, or a group having a quaternary phosphonium salt structure.

When W represents a group having a quaternary ammonium or phosphonium salt structure, W may have a counter anion, as needed. Examples of the counter anion include halide, sulfate, nitrate, phosphate, oxalate, alkanesulfonate, arylsulfonate, alkanecarboxylate, and arylcarboxylate ions. The hydrophilic group is preferably a carboxyl, sulfo, or phosphate group and more preferably a carboxyl or sulfo group. In such a case, the counter cation is preferably $Li^+$, $Na^+$, $K^+$, $Mg^{2+}$, $Ca^{2+}$ or $NH_4^+$, more preferably $Li^+$, $Na^+$, $K^+$ or $NH_4^+$, and still more preferably $Li^+$ or $Na^+$.

When each of $R^1$, $R^4$, $R^5$, $R^8$, $R^9$, $R^{12}$, $R^{13}$, and $R^{16}$ in Formula (PC-1) is a substituent, each group may be a substituent group selected from the examples of the substituents that above-described R, R', or R" may be. The substituent may be additionally substituted with at least one of the above examples.

The substituent is preferably a halogen atom, an alkyl group, an alkenyl group, an alkynyl group, an aryl group, a heterocyclic group (the position of the substitution site is not limited), a heterocyclic group containing one or more quaternary nitrogen atoms (e.g., a pyridinio, imidazolio, quinolinio, or isoquinolinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a sulfonyloxy group, an imide group, a sulfamoylamino group, a semicarbazide group, a thiosemicarbazide group, a nitro group, an (alkyl or aryl)-sulfonyl group, an (alkyl or aryl)-sulfinyl group, a sulfo group or a salt thereof, a sulfamoyl group, an acylsulfamoyl group, a sulfonylsulfamoyl group or a salt thereof, or a group containing a phosphoric amide or phosphoric ester structure. The substituent is more preferably an alkyl group, an aryl group, a heterocyclic group, an acyl group, an alkoxycarbonyl group, a carbamoyl group, a carboxy group or a salt thereof, an oxalyl group, an oxamoyl group, a cyano group, an imide group, a sulfamoylamino group, an (alkyl or aryl)-sulfonyl group, an (alkyl or aryl)-sulfinyl group, a sulfo group or a salt thereof, a sulfamoyl group, an acylsulfamoyl group, or a sulfonylsulfamoyl group or a salt thereof.

The substituent is still more preferably an aryl group, a heterocyclic group, an acyl group, an alkoxycarbonyl group, a carbamoyl group, a carboxy group or a salt thereof, an (alkyl or aryl)-sulfonyl group, an (alkyl or aryl)-sulfinyl group, a sulfo group or a salt thereof, or a sulfamoyl group.

In the compound represented by Formula (PC-1), four or more of $R^1$, $R^4$, $R^5$, $R^8$, $R^9$, $R^{12}$, $R^{13}$, and $R^{16}$ preferably represent each a group represented by Formula (II), and more preferably, at least one of $R^1$ and $R^4$, at least one of $R^5$ and $R^8$, at least one of $R^9$ and $R^{12}$, and at least one of $R^{13}$ and $R^{16}$ represent a group represented by Formula (II). Particularly preferably, one of $R^1$ and $R^4$, one of $R^5$ and $R^8$, one of $R^9$ and $R^{12}$, and one of $R^{13}$ and $R^{16}$ represent a group represented by Formula (II) and the other of each of these combinations is a hydrogen atom. When the compound of Formula (PC-1) has two groups of Formula (II), these groups may be the same as or different from each other.

In Formula (PC-1), $R^2$, $R^3$, $R^6$, $R^7$, $R^{10}$, $R^{11}$, $R^{14}$, and $R^{15}$ independently represent a hydrogen atom or a substituent. The substituent is selected from the examples of the substituent group that $R^1$, $R^4$, $R^5$, $R^8$, $R^9$, $R^{12}$, $R^{13}$, or $R^{16}$ in Formula (PC-1) may be.

Each of $R^1$, $R^4$, $R^5$, $R^8$, $R^9$, $R^{12}$, $R^{13}$, and $R^{16}$ is preferably a hydrogen or halogen atom or a carboxyl, alkoxycarbonyl, acyl, sulfo, sulfamoyl, sulfonyl, alkyl, aryl, or heterocyclic group. Each of these groups is a more preferably hydrogen or halogen atom or a sulfo, sulfamoyl, or sulfonyl group, and still more preferably a hydrogen or halogen atom or a sulfo group.

Generally, phthalocyanine compounds having multiple substituents may have positional isomers whose binding sites of the substituent groups are different.

similarly, the compound represented by Formula (PC-1) in the invention may have several kinds of positional isomers. In the invention, the phthalocyanine compound may be used as a single compound or as a mixture of such positional isomers. When the compound is used as a mixture of positional isomers, the number of the mixed positional isomers, the positions of the substitution sites of the substituents in the respective positional isomers, and the blending ratio of the positional isomers are not limited.

SPECIFIC EXAMPLES

Examples of the compounds represented by Formula (PC-1) for use in the invention are shown below. However, the invention is not limited by these examples.

In the following examples, each of positional isomer mixtures is expressed as a compound.

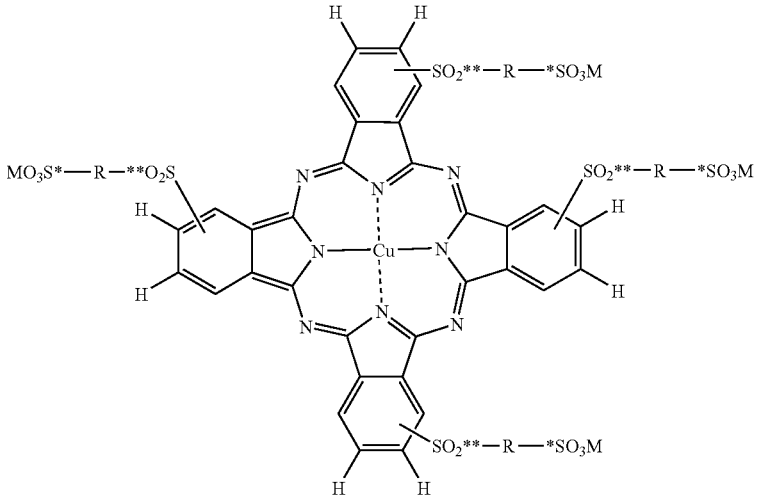
| | Exemplified compound | | |
|---|---|---|---|
| | M = Li | M = Na | M = K |
| **—R—* = **—$CH_2CH_2$—* | 1 | 10 | 19 |
| **—$CH_2CH_2CH_2$—* | 2 | 11 | 20 |
| **—$CH_2CH_2CH_2CH_2$—* | 3 | 12 | 21 |
| **—$CH_2CH_2CH_2CH_2CH_2$—* | 4 | 13 | 22 |
| **—$CH_2CH_2$—$(OCH_2CH_2)n$—* | | | |
| n = 1 | 5 | 14 | 23 |
| 2 | 6 | 15 | 24 |
| 3 | 7 | 16 | 25 |
| 4 | 8 | 17 | 26 |
| 5 | 9 | 18 | 27 |
| | Exemplified Compound | |
|---|---|---|
| | M = Li | M = Na |
| 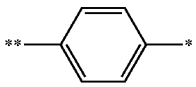 | 28 | 31 |
| 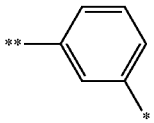 | 29 | 32 |
| 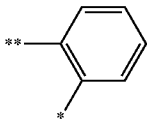 | 30 | 33 |
| 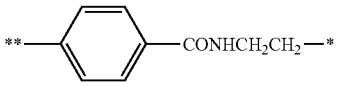 | 34 | 37 |
| 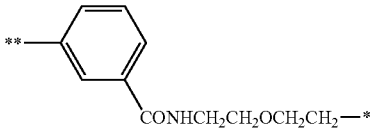 | 35 | 38 |

-continued

| | | |
|---|---|---|
| 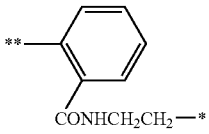 | 36 | 39 |

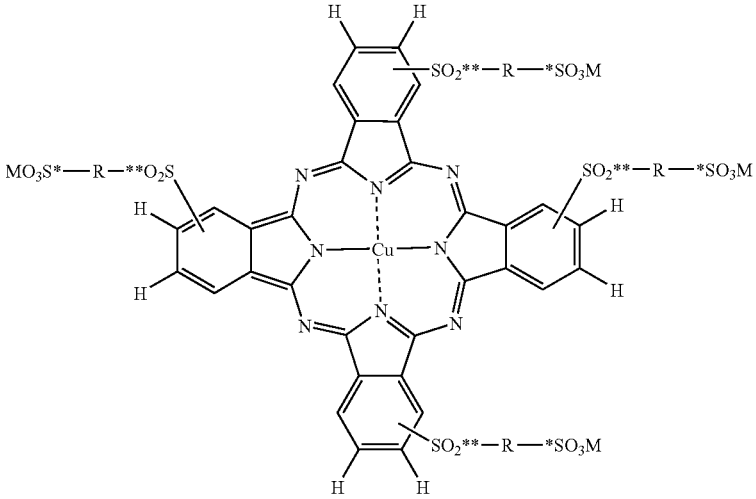

| | | Exemplified compound |
|---|---|---|
| **—R—* = **—$CH_2CH_2$—* | 40 | M = Li & $NH_4$ (Li/$NH_4$ = 3/1) |
| | 41 | M = Li & $NH_4$ (Li/$NH_4$ = 2/2) |
| | 42 | M = Na & $NH_4$ (Na/$NH_4$ = 3/1) |
| | 43 | M = Na & $NH_4$ (Na/$NH_4$ = 2/2) |
| | 44 | M = Na & $NH_4$ (Na/$NH_4$ = 1/3) |
| **—$CH_2CH_2CH_2$—* | 45 | M = Li & $NH_4$ (Li/$NH_4$ = 3/1) |
| | 46 | M = Li & $NH_4$ (Li/$NH_4$ = 2/2) |
| | 47 | M = Li & $NH_4$ (Li/$NH_4$ = 1/3) |
| | 48 | M = Na & $NH_4$ (Na/$NH_4$ = 3/1) |
| | 49 | M = Na & $NH_4$ (Na/$NH_4$ = 2/2) |
| | 50 | M = Na & $NH_4$ (Na/$NH_4$ = 1/3) |
| | 51 | M = K & $NH_4$ (K/$NH_4$ = 3/1) |
| | 52 | M = K & $NH_4$ (K/$NH_4$ = 2/2) |
| | 53 | M = K & $NH_4$ (K/$NH_4$ = 1/3) |
| | 54 | M = $Et_4N$ |
| **—$CH_2CH_2CH_2CH_2$—* | 55 | M = Li & $NH_4$ (Li/$NH_4$ = 3/1) |
| | 56 | M = Li & $NH_4$ (Li/$NH_4$ = 2/2) |
| | 57 | M = Na & $NH_4$ (Na/$NH_4$ = 3/1) |
| | 58 | M = Na & $NH_4$ (Na/$NH_4$ = 2/2) |
| | 59 | M = Na & $NH_4$ (Na/$NH_4$ = 1/3) |

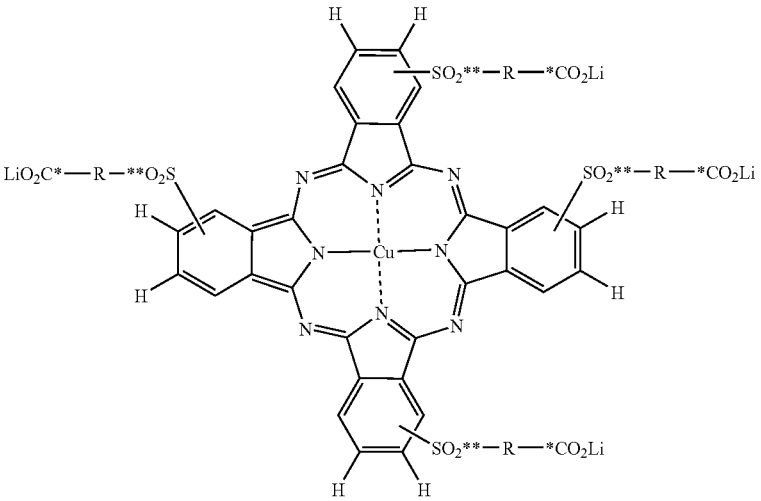

**—R—* = **—$CH_2CH_2$—* 60

-continued
| | |
|---|---|
| **—$CH_2CH_2CH_2$—* | 61 |
| **—$CH_2CH_2CH_2CH_2$—* | 62 |
| **—$CH_2CH_2CH_2CH_2CH_2$—* | 63 |
| **—$CH_2CH_2$—$(OCH_2CH_2)n$—* | 64 |
| n = 1 | 65 |
| 2 | 66 |
| 3 | 67 |
| 4 | 68 |
| 5 | 69 |
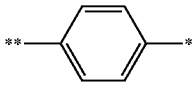
70
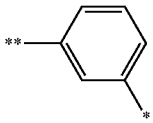
71
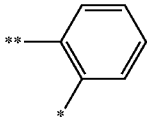
72
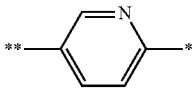
73
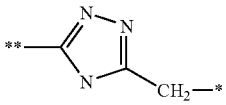
74
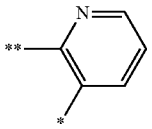
75
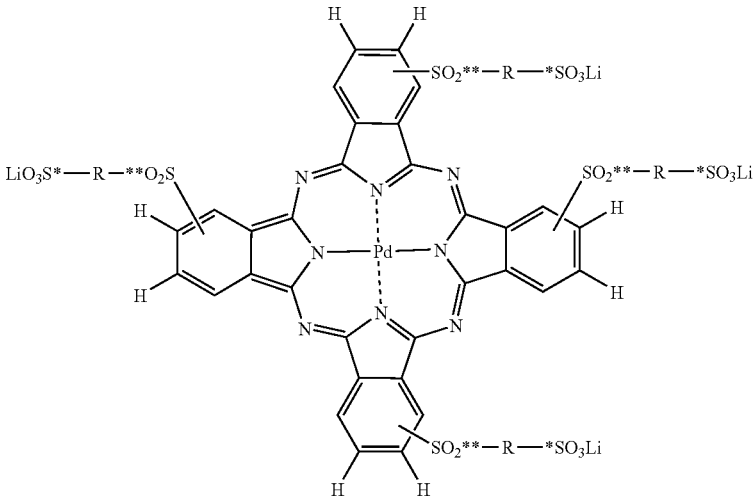
| | |
|---|---|
| **—R—* = **—$CH_2CH_2$—* | 76 |
| **—$CH_2CH_2CH_2$—* | 77 |
| **—$CH_2CH_2CH_2CH_2$—* | 78 |
| **—$CH_2CH_2CH_2CH_2CH_2$—* | 79 |
| **—$CH_2CH_2$—$(OCH_2CH_2)n$—* | |
| n = 1 | 80 |
| 2 | 81 |
| 3 | 82 |

-continued
| | |
|---|---|
| 4 | 83 |
| 5 | 84 |
| 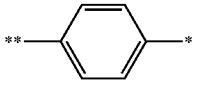 | 85 |
| 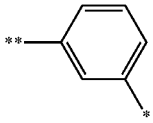 | 86 |
| 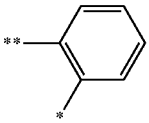 | 87 |
| 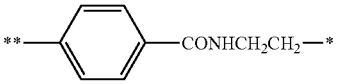 | 88 |
| 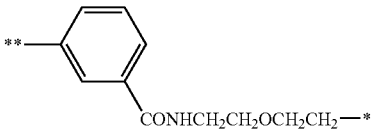 | 89 |
| 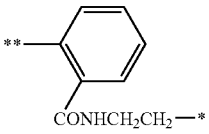 | 90 |
| 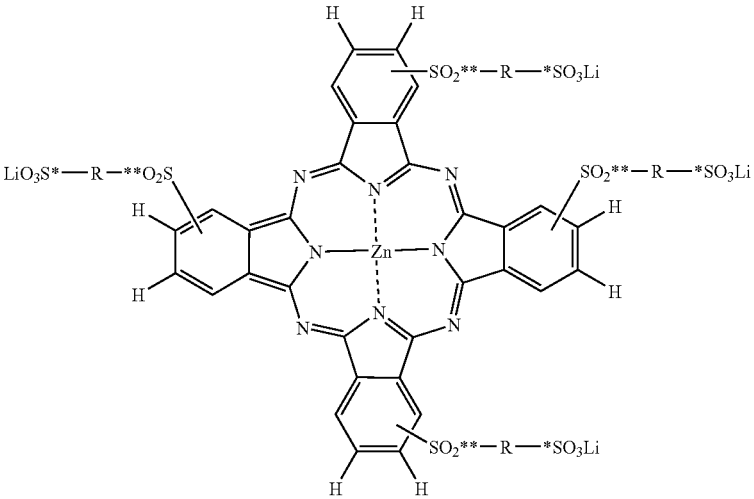 | |
| **—R—* = **—$CH_2CH_2$—* | 91 |
| **—$CH_2CH_2CH_2$—* | 92 |
| **—$CH_2CH_2CH_2CH_2$—* | 93 |
| **—$CH_2CH_2CH_2CH_2CH_2$—* | 94 |
| **—$CH_2CH_2$—$(OCH_2CH_2)n$—* | |
| n = 1 | 95 |
| 2 | 96 |
| 3 | 97 |
| 4 | 98 |
| 5 | 99 |
| 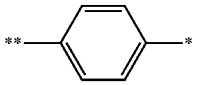 | 100 |

-continued
101
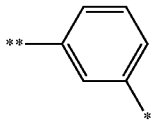
102
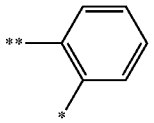
103
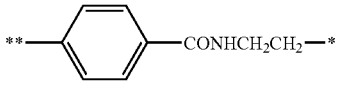
104
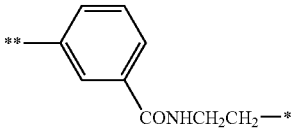
105
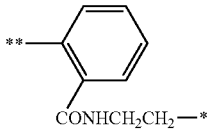
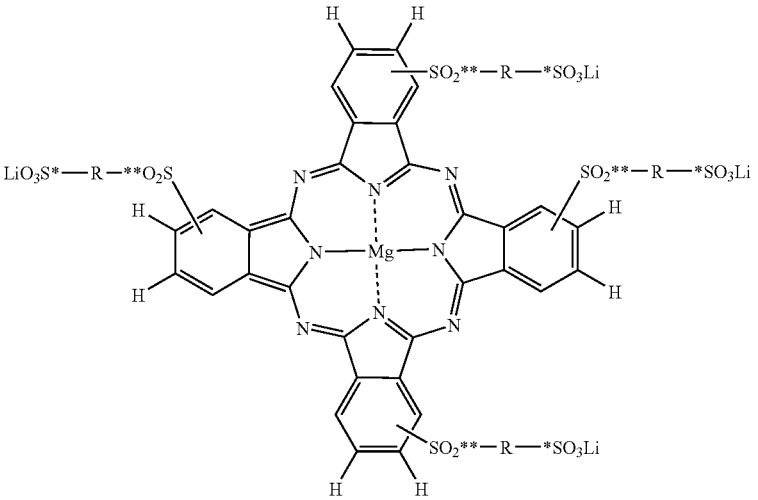
| | |
|---|---|
| **—R—* = **—$CH_2CH_2$—* | 106 |
| **—$CH_2CH_2CH_2$—* | 107 |
| **—$CH_2CH_2CH_2CH_2$—* | 108 |
| **—$CH_2CH_2CH_2CH_2CH_2$—* | 109 |
| **—$CH_2CH_2$—$(OCH_2CH_2)n$—* | |
| n = 1 | 110 |
| 2 | 111 |
| 3 | 112 |
113
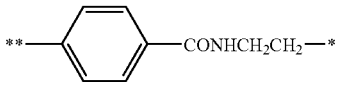
114
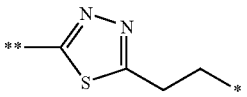

-continued
115
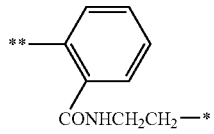
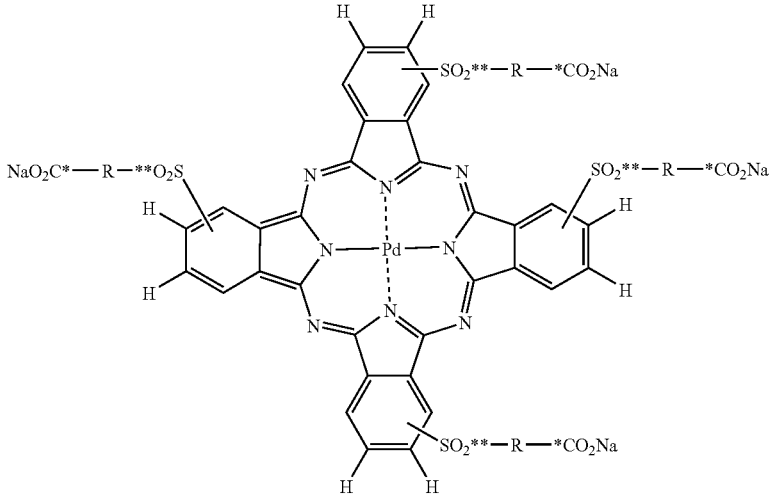
| | |
|---|---|
| **—R—* = **—$CH_2CH_2CH_2$—* | 116 |
| **—$CH_2CH_2CH_2CH_2$—* | 117 |
| **—$CH_2CH_2CH_2CH_2CH_2$—* | 118 |
| **—$CH_2CH_2$—$(OCH_2CH_2)n$—* | |
| n = 1 | 119 |
| 2 | 120 |
| 3 | 121 |
122
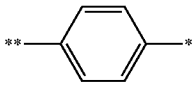
123
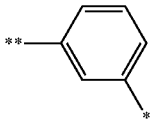
124
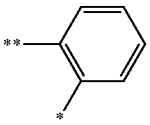
125
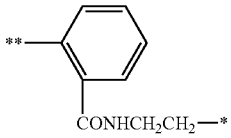

-continued
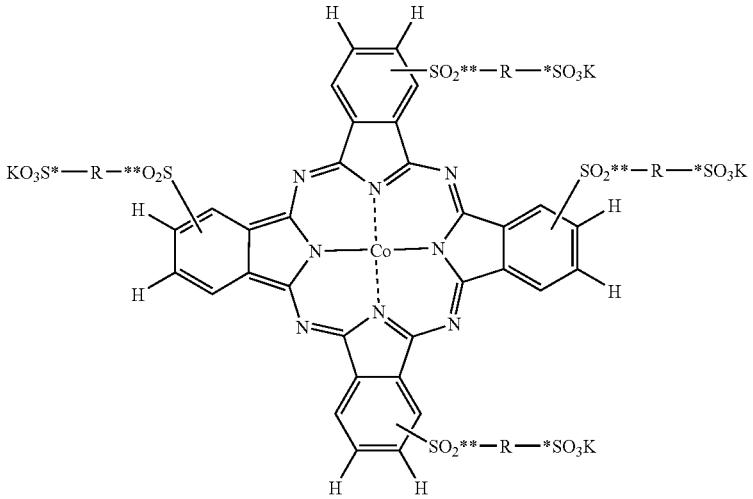
| | |
|---|---|
| **—R—* = **—$CH_2CH_2CH_2$—* | 126 |
| **—$CH_2CH_2CH_2CH_2$—* | 127 |
| **—$CH_2CH_2CH_2CH_2CH_2$—* | 128 |
| **—$CH_2CH_2$—$(OCH_2CH_2)n$—* | |
| n = 1 | 129 |
| 2 | 130 |
| 3 | 131 |
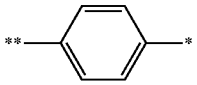
132
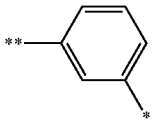
133
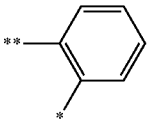
134
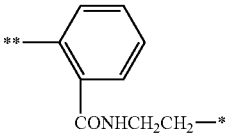
135

-continued
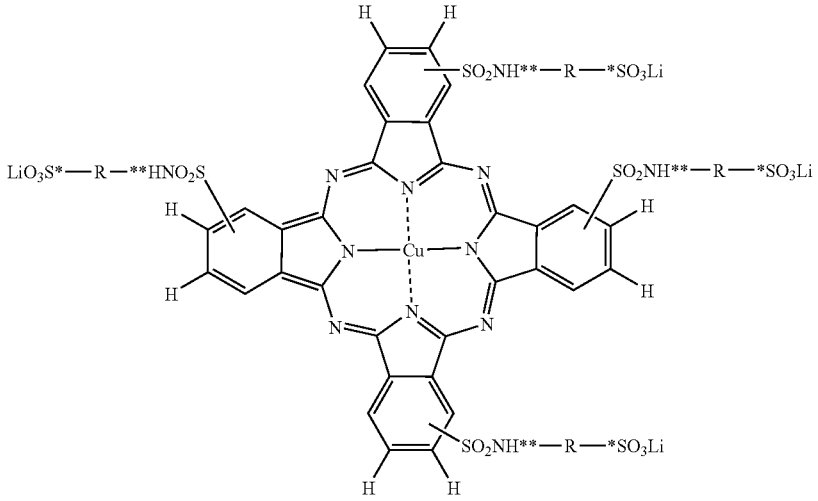
| | |
|---|---|
| **—R—* = **—$CH_2CH_2$—* | 136 |
| **—$CH_2CH_2CH_2$—* | 137 |
| **—$CH_2CH_2CH_2CH_2$—* | 138 |
| **—$CH_2CH_2CH_2CH_2CH_2$—* | 139 |
| **—$CH_2CH_2$—$(OCH_2CH_2)n$—* | |
| n = 1 | 140 |
| 2 | 141 |
| 3 | 142 |
143
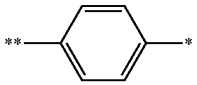
144
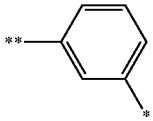
145
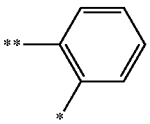
146
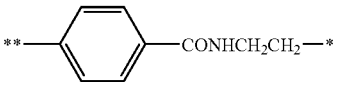
147
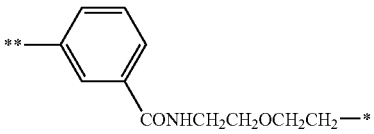
148
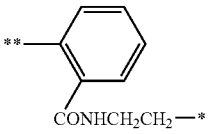

-continued
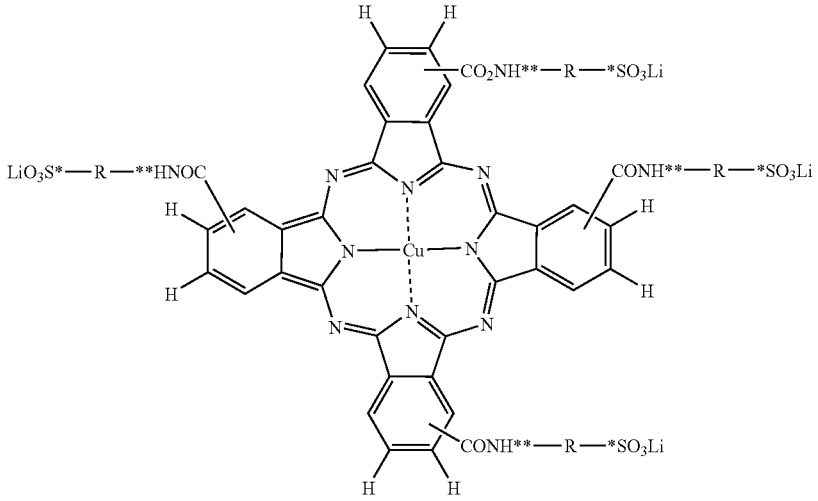
| | |
|---|---|
| **—R—* = **—$CH_2CH_2$—* | 149 |
| **—$CH_2CH_2CH_2$—* | 150 |
| **—$CH_2CH_2CH_2CH_2$—* | 151 |
| **—$CH_2CH_2CH_2CH_2CH_2$—* | 152 |
| **—$CH_2CH_2$—$(OCH_2CH_2)n$—* | |
| n = 1 | 153 |
| 2 | 154 |
| 3 | 155 |
156
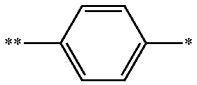
157
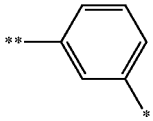
158
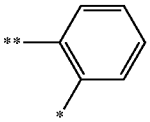
159
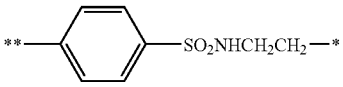
161
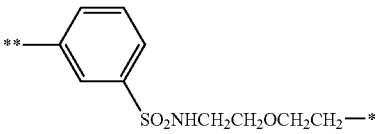
162
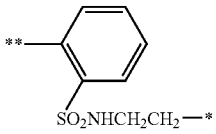

-continued
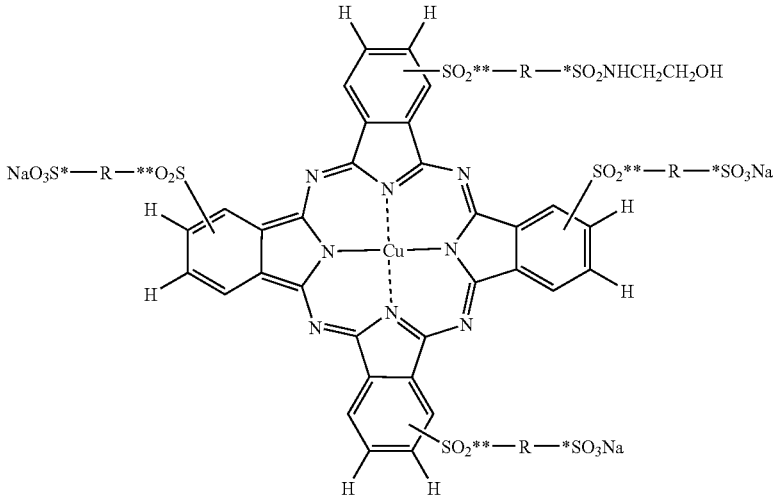
| | |
|---|---|
| **—R—* = **—$CH_2CH_2CH_2$—* | 163 |
| **—$CH_2CH_2CH_2CH_2$—* | 164 |
| **—$CH_2CH_2CH_2CH_2CH_2$—* | 165 |
| **—$CH_2CH_2$—$(OCH_2CH_2)n$—* | |
| n = 1 | 166 |
| 2 | 167 |
| 3 | 168 |
169
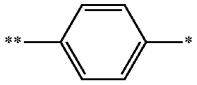
170
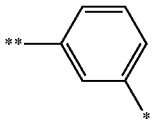
171
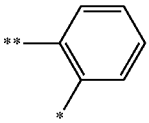
172
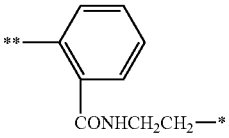

-continued
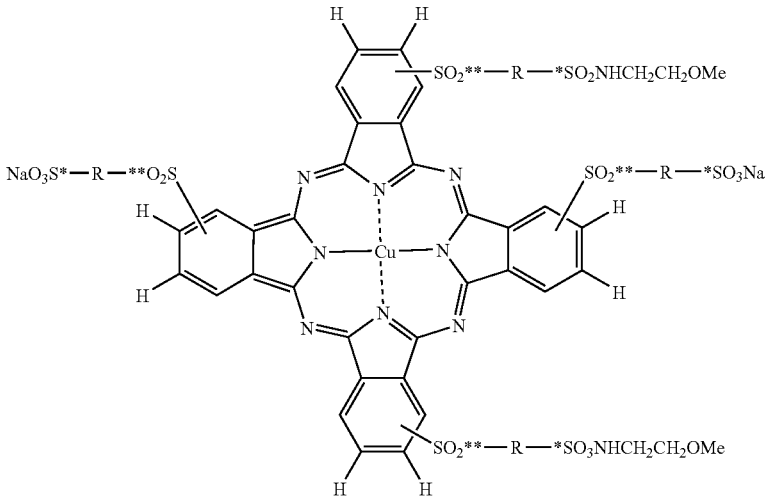
| | |
|---|---|
| **—R—* = **—$CH_2CH_2CH_2$—* | 173 |
| **—$CH_2CH_2CH_2CH_2$—* | 174 |
| **—$CH_2CH_2CH_2CH_2CH_2$—* | 175 |
| **—$CH_2CH_2$—$(OCH_2CH_2)n$—* | |
| n = 1 | 176 |
| 2 | 177 |
| 3 | 178 |
179
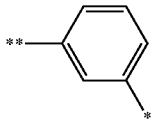
180
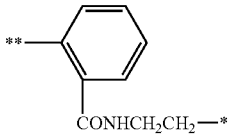
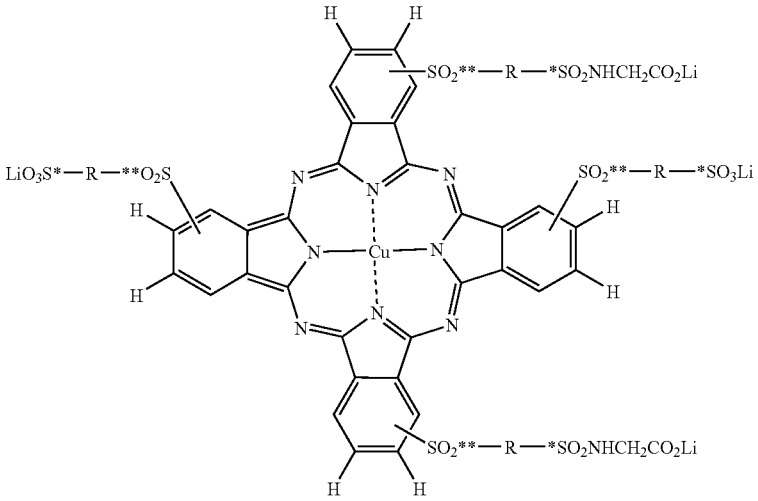
| | |
|---|---|
| **—R—* = **—$CH_2CH_2CH_2$—* | 181 |
| **—$CH_2CH_2CH_2CH_2$—* | 182 |
| **—$CH_2CH_2CH_2CH_2CH_2$—* | 183 |
| **—$CH_2CH_2$—$(OCH_2CH_2)n$—* | |
| n = 1 | 184 |
| 2 | 185 |
| 3 | 186 |

-continued
187
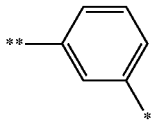
188
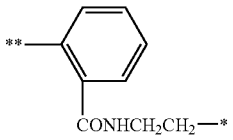
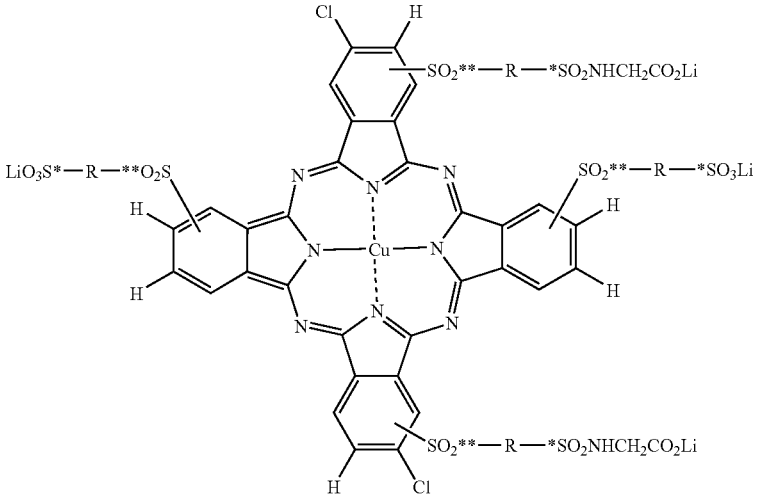
| | |
|---|---|
| **—R—* = **—$CH_2CH_2CH_2$—* | 189 |
| **—$CH_2CH_2CH_2CH_2$—* | 190 |
| **—$CH_2CH_2CH_2CH_2CH_2$—* | 191 |
192
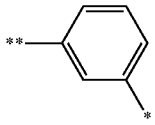
193
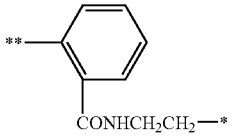
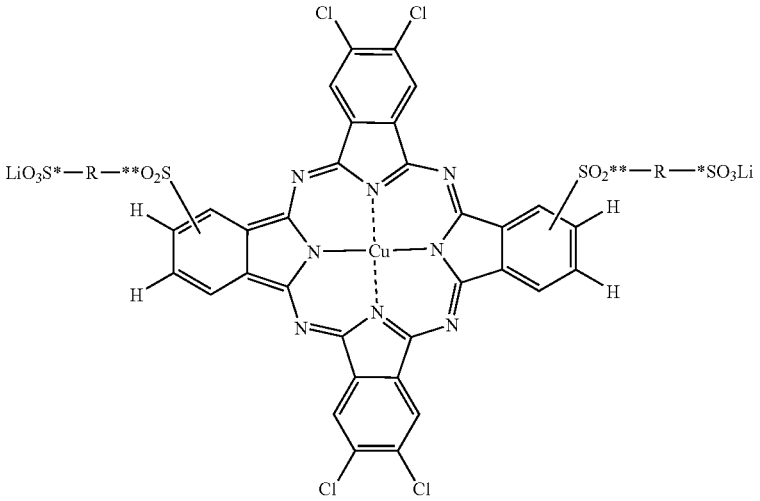

-continued
| | |
|---|---|
| **—R—* = **—$CH_2CH_2CH_2$—* | 194 |
| **—$CH_2CH_2CH_2CH_2$—* | 195 |
| **—$CH_2CH_2CH_2CH_2CH_2$—* | 196 |
197
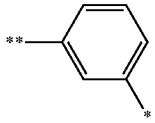
198
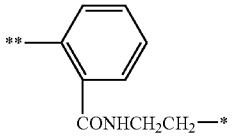
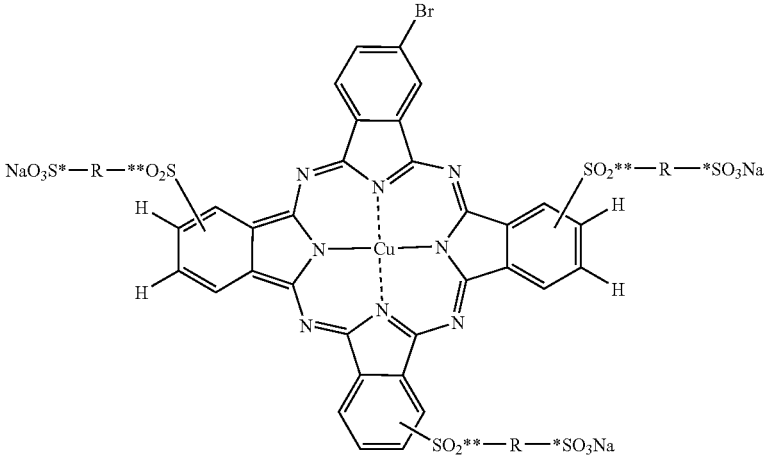
| | |
|---|---|
| **—R—* = **—$CH_2CH_2CH_2$—* | 199 |
| **—$CH_2CH_2CH_2CH_2$—* | 200 |
| **—$CH_2CH_2CH_2CH_2CH_2$—* | 201 |
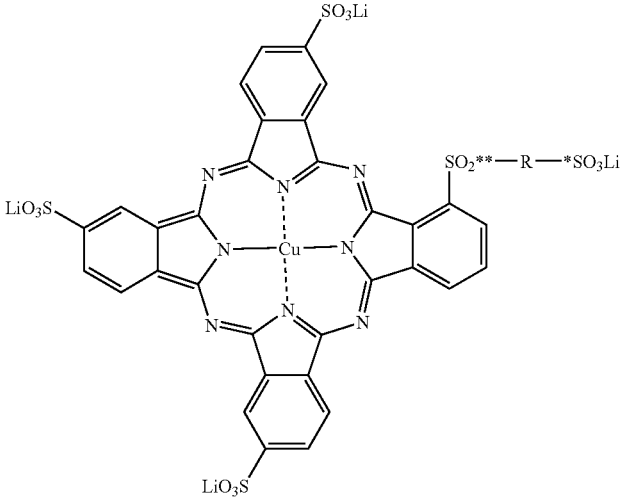
| | |
|---|---|
| **—R—* = **—$CH_2CH_2CH_2$—* | 202 |
| **—$CH_2CH_2CH_2CH_2$—* | 203 |
| **—$CH_2CH_2CH_2CH_2CH_2$—* | 204 |
205
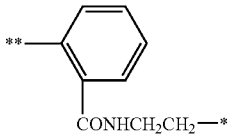

-continued
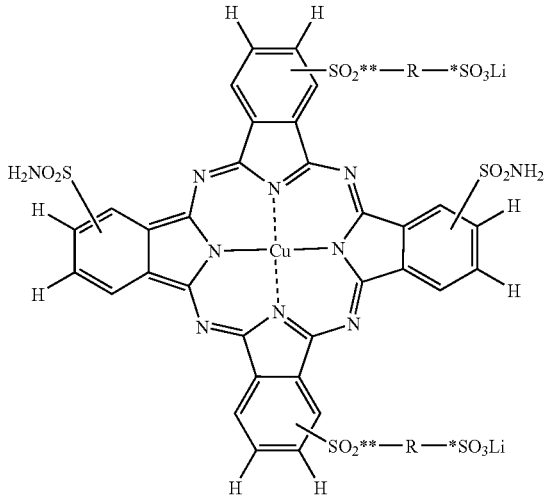
| | |
|---|---|
| **—R—* = **—$CH_2CH_2$—* | 206 |
| **—$CH_2CH_2CH_2$—* | 207 |
| **—$CH_2CH_2CH_2CH_2$—* | 208 |
| **—$CH_2CH_2CH_2CH_2CH_2$—* | 209 |
| **—$CH_2CH_2$—($OCH_2CH_2$)n—* | |
| n = 1 | 210 |
| 2 | 211 |
| 3 | 212 |
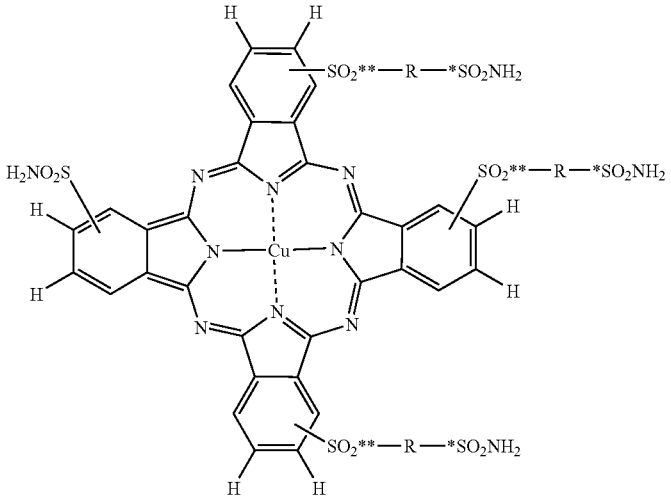
| | |
|---|---|
| **—R—* = **—$CH_2CH_2$—* | 213 |
| **—$CH_2CH_2CH_2$—* | 214 |
| **—$CH_2CH_2CH_2CH_2$—* | 215 |
| **—$CH_2CH_2CH_2CH_2CH_2$—* | 216 |
| **—$CH_2CH_2$—($OCH_2CH_2$)n—* | |
| n = 1 | 217 |
| 2 | 218 |
| 3 | 219 |

<Synthesis of Exemplified Compound 2>

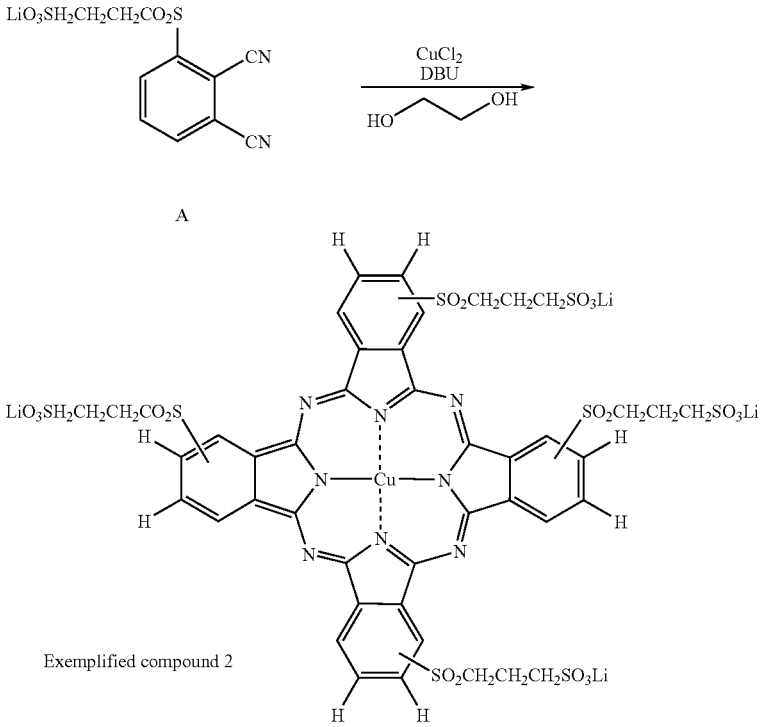

$CuCl_2$ (134 mg, 1 mmol) was added to an ethylene glycol solution (10 ml) of synthetic intermediate A (1.26 g, 4 mmol), and the resultant mixture was heated to 100° C. DBU (1.52 g, 10 mmol), was added to the reaction mixture, and the resultant blend was heated at 100° C. for 10 hours. The reaction mixture was acidified with hydrochloric acid and LiCl was added to the acidified mixture to precipitate a crude product of phthalocyanine. The crude product thus obtained was purified by column chromatography using Sephadex RG-15 as a carrier to obtain 67 mg of a mixture of exemplified compound 2 (yield of 5%).

2) Aggregate-forming Dye

The aggregate-forming dye for use in the invention is present in the thermographic material in an aggregate state. The dye in an aggregate state forms a so-called J-band state and shows a sharp absorption spectrum peak. Aggregation of dye and J-band are described in various literature [e.g., Photographic Science and Engineering Vol. 18, Nos. 323 to 335 (1974)]. The absorption maximum of the dye in a J-aggregation state appears at a wavelength longer than a wavelength at which the absorption maximum of the dye in a solution state (monomer state) appears. Accordingly, it is possible to determine whether the dye contained in a layer is in an aggregate or non-aggregate state from the measured absorption maximum of the dye.

The aggregation dye is preferably a polymethine dye and more preferably a cyanine or oxonol dye.

Such aggregation dyes are described in detail in paragraph Nos. 0017 to 0079 of U.S. Pat. No. 6,830,879 (specifically, compound Nos. 1 to 82) and in paragraph numbers 0048 to 0112 of JP-A No. 2003-84395 (specifically, compound Nos. 1 to 82); and these descriptions and the specific compounds therein may be applied to the invention.

3) Use Method of Dye

<Addition Method>

The dye in the invention is preferably water-soluble, and is used preferably as an aqueous solution obtained by dissolving the dye in water in production of the photosensitive material. The content of the water-soluble phthalocyanine compound in the invention contained in the aqueous solution is generally 0.1 to 30 mass %, preferably 0.5 to 20 mass %, and more preferably 1 to 8 mass %. The aqueous solution may also contain a water-soluble organic solvent and/or an auxiliary additive. The content of the water-soluble organic solvent is preferably 0 to 30 mass %, and preferably 5 to 30 mass %. The content of the auxiliary additive is 0 to 5 mass %, and preferably 0 to 2 mass %.

Specific examples of the water-soluble organic solvent for use in preparing the aqueous solution of the water-soluble dye in the invention include alkanols having 1 to 4 carbon atoms such as methanol, ethanol, propanol, iso-propanol, butanol, isobutanol, secondary butanol, and tertiary butanol; carboxylic amides such as N,N-dimethylformamide and N,N-dimethylacetamide; lactams such as ε-caprolactam and N-methylpyrrolidin-2-one; urea; cyclic ureas such as 1,3-dimethylimidazolidin-2-one and 1,3-dimethylhexahydropyrimid-2-one; ketones and keto alcohols such as acetone, methyl ethyl ketone, and 2-methyl-2-hydroxypentan-4-one; ethers such as tetrahydrofuran and dioxane; monomers, oligomers, polyalkylene glycols, and thioglycols having an alkylene unit including 2 to 6 carbon atoms such as ethylene glycol, 1,2- or 1,3-propylene glycol, 1,2- or 1,4-butylene glycol, 1,6-hexylene glycol, diethylene glycol, triethylene glycol, dipropylene glycol, thiodiglycol, polyethylene glycol, and polypropylene glycol; polyols (triols) such as glycerol and hexane-1,2,6-triol; alkylethers having 1 to 4 carbon atoms of polyhydric alcohol such as ethylene glycol monomethyl ether, ethylene glycol monoethyl ether, diethylene glycol monomethyl ether, diethylene glycol monoethyl ether, triethylene glycol monomethyl ether, and triethylene glycol monoethyl ether; and γ-bytylolactone and dimethylsulfoxide. Two or more of these water-soluble organic solvents may be used together.

Among these water-soluble organic solvents, the water-soluble organic solvent in the invention is preferably urea, N-methylpyrrolidin-2-one, or mono-, di-, or tri-alkylene glycol containing an alkylene unit having 2 to 6 carbon atoms, more preferably mono-, di-, or tri-ethylene glycol, dipropylene glycol, or dimethylsulfoxide, still more preferably N-methylpyrrolidin-2-one, diethylene glycol, dimethylsulfoxide, or urea, and most preferably urea. Because the aqueous solution containing a water-soluble dye in the invention is mixed and diluted with other various chemicals during preparation of the photosensitive material, the water-soluble organic solvent is preferably added to the aqueous solution in an amount in the range of 1 to 500 moles with respect to 1 mole of the water-soluble dye therein.

The auxiliary additive(s) such as an antiseptic fungicide, a pH adjusting agent, a chelating agent, a rust-preventive agent, a water-soluble ultraviolet absorbent, a water-soluble polymer compound, a dye-dissolving agent, and/or a surfactant may be contained, as needed.

Examples of the antiseptic fungicide include sodium dehydroacetate, sodium sorbate, 2-pyridinethiol-1-oxide sodium, sodium benzoate, sodium pentachlorophenolate, benzisothiazolinone and salts thereof, and para-hydroxybenzoic esters.

The pH adjusting agent is required to adjust the pH of the aqueous solution to a value in the range of 4 to 11 without adversely affecting the aqueous solution prepared and otherwise it is not limited. Examples thereof include alkanol amines such as diethanolamine and triethanolamine; alkali metal hydroxides such as lithium hydroxide, sodium hydroxide, and potassium hydroxide; ammonium hydroxide; and alkali metal carbonate salts such as lithium carbonate, sodium carbonate, and potassium carbonate.

Examples of the chelating agent include sodium ethylenediaminetetraacetate, sodium nitrilotriacetate, sodium hydroxyethyl-ethylenediaminetriacetate, sodium diethylenetriaminepentaacetate, and sodium uracildiacetate. Examples of the rust-preventive agent include acidic sulfite salts, sodium thiosulfate, ammonium thiglycolate, diisopropylpropylammonium nitrite, pentaerythritol tetranitrate, and dicyclohexylammonium nitrite. Examples of the water-soluble polymer compound include polyvinyl alcohol, cellulose derivatives, polyamine, and polyimine. Examples of the water-soluble ultraviolet absorbent include sulfonated benzophenones, and sulfonated benzotriazoles. Examples of the dye-dissolving agent include ε-caprolactam, ethylene carbonate, and urea. The surfactant can be a known anionic, cationic, or nonionic surfactant and is preferably, for example, an acetylene glycol surfactant.

<Layer in Which Dye is Contained>

When the photothermographic material has on only one surface of the support at least one layer including the image-forming layer, the dye in the invention may be contained in at least one of the at least one layer, or at least one layer provided on the other surface of the support, and is preferably contained in at least one of the at least one layer provided on the one surface, and at least one of the at least one layer provided on the other surface. In this case, at least one of the at least one layer provided on the one surface preferably contains a polyhalogen compound.

<Addition Amount>

In order to adjust the image color tone after thermal development to blue, the amount of the dye added is determined suitably considering silver tone and the color tone derived from other additives. Generally, the amount of the dye is such that the optical density (absorbance) measured at a desired wavelength does not exceed 1.5. The optical density is generally 0.01 to 1.2, preferably 0.05 to 1.0, and more preferably 0.1 to 0.8. The amount of the dye used to obtain such an optical density is generally 0.5 to 200 $mg/m^2$, preferably 1 to 160 $mg/m^2$, and more preferably 5 to 120 $mg/m^2$.

Layer Structure and Constituent Components

1) Layer Structure

The photothermographic material of the invention has, as essential layers, an image-forming layer (1) and an outermost layer (2) on the support in that order. The material preferably has one or more non-photosensitive intermediate layers between the image-forming layer and the outermost layer, more preferably two or more non-photosensitive intermediate layers, and still more preferably a non-photosensitive intermediate layer adjacent to the image-forming layer and mainly containing a polymer latex and a non-photosensitive intermediate layer adjacent to the outermost layer and mainly containing an animal protein-derived hydrophilic polymer. Each layer may be a single layer or a two- or more-layered laminate. The photothermographic material may further have any other layer(s).

The role of the outermost layer, which includes the outermost surface of the layers provided on one surface of the support of the photothermographic material on which one surface the image-forming layer is provided, is to improve transportability of the photothermographic material, to protect the surface of the material, and to prevent adhesion between photosensitive materials, adhesion of the photothermographic material to other member and thus damage of a formed image. Accordingly, the outermost layer preferably contains additives such as a matting agent, a lubricant, and a surfactant, as well as the binder.

2) Outermost layer

<Polymer Latex>

The binder(s) in the outermost layer in the invention contains a polymer latex. The content of the polymer latex in the binder(s) is 50 mass % or more (50 mass % to 100 mass %), and preferably 50 mass % to 75 mass %.

The polymer latex in the invention preferably has an equilibrium moisture content of 5 mass % or less at 25° C. and 60% RH. The equilibrium moisture content at 25° C. and 60% RH can be represented by the following equation:

Equilibrium moisture content at 25° C. and 60%

$$RH=\{(W1-W0)/W0\}\times 100 \text{ (mass \%)},$$

In the equation, W1 is the mass of a polymer in humidity-conditioned equilibrium in an atmosphere of 25° C. and 60% RH, and W0 is the mass of the polymer in a bone-dry state at 25° C.

In the invention, the equilibrium moisture content is preferably 2 mass % or less, more preferably 0.01 to 1.5 mass %, and still more preferably 0.02 to 1 mass %.

The glass transition temperature of the polymer latex in the invention is preferably 0 to 80° C., more preferably 10 to 70° C., and still more preferably 15 to 60° C.

Specific examples of the polymer latex usable in the invention include polyacrylate, polyurethane, polymethacrylate, and copolymers thereof.

Two or more polymer latexes can be used together in the invention, as needed. For example, a polymer latex having a glass transition temperature of 20° C. or higher and that having a glass transition temperature of lower than 20° C. may be used together. If two or more polymers having different glass transition temperatures are used together, the mass-averaged Tg is preferably within the above range.

In a preferable embodiment, a coating liquid which includes a solvent containing water in an amount of 30 mass % or more based on the amount of the solvent is prepared and applied to a support and the resulting coating is dried to form a hydrophobic polymer-containing layer.

The coating liquid preferably has an ionic conductivity of 2.5 mS/cm or lower, and such a coating liquid can be prepared by purifying a synthesized polymer with a separation membrane.

The solvent of the coating liquid is preferably water or a mixed solvent of water and a water-miscible organic solvent whose content in the mixed solvent is 70 mass % or lower. Examples of the water-miscible organic solvent include alcohols such as methyl alcohol, ethyl alcohol, and propyl alcohol; cellosolves such as methyl cellosolve, ethyl cellosolve, and butyl cellosolve; ethyl acetate; and dimethylformamide.

The polymer is preferably dispersible in an aqueous solvent. Examples of a system in which the polymer is dispersed include a latex in which water-insoluble fine particles of hydrophobic polymer are dispersed, or a system in which polymer molecules or micelles formed by polymer molecules are dispersed. Among these, a latex in which polymer particles are dispersed is preferable. The average size of the dispersed particles is in the range of from 1 nm to 50,000 nm, preferably from 5 nm to 1,000 nm, more preferably from 10 nm to 500 nm, and still more preferably from 50 nm to 200 nm. There is no particular limitation on the particle size distribution of the dispersed particles, and the dispersed particles may have a broad distribution or a monodisperse particle size distribution. From the viewpoint of controlling the physical properties of a coating liquid, mixing two or more types of particles each having a monodisperse particle distribution is preferable.

Typical examples of the hydrophobic polymer include acrylic polymer, polyester, rubber (e.g., an SBR resin), polyurethane, polyvinyl chloride, polyvinyl acetate, polyvinylidene chloride, or polyolefin. The polymer may be linear, branched or cross-linked, and may be a homopolymer obtained by polymerizing one kind of monomer, or a copolymer obtained by polymerizing two or more kinds of monomers. In the case of a copolymer, it may be a random copolymer or a block copolymer. The number-average molecular weight of the polymer is in the range of from 5,000 to 1,000,000, and preferably from 10,000 to 200,000. Those having a too small molecular weight result in an image-forming layer having an insufficient mechanical strength, whereas those having a too large molecular weight have a poor film-forming property. A cross-linkable polymer latex is particularly preferably used.

Specific Examples of Latex

Specific examples of the polymer latex are given below, and are expressed by starting monomers. The numerical values in parenthesis represent the mass percentages of the left monomers. The molecular weight is the number average molecular weight. Latexes whose starting monomers include a polyfunctional monomer form a cross-linked structure, and the concept of molecular weight is not applicable thereto. Hence, they are denoted as "cross-linking", and the molecular weight is not shown. Tg represents the glass transition temperature of the polymer.

NP-1; latex of MMA(70)-EA(27)-MAA(3) (molecular weight of 37,000, and Tg of 61° C.)

NP-2; latex of MMA(70)-2EHA(20)-St(5)-AA(5) (molecular weight of 40,000, and Tg of 59° C.)

NP-3; latex of St(55)-Bu(42)-MAA(3) (cross-linking, and Tg of 5° C.)

NP-4; latex of St(68)-Bu(29)-AA(3) (cross-linking, and Tg of 17° C.)

NP-5; latex of St(71)-Bu(26)-AA(3) (cross-linking, and Tg of 24° C.)

NP-6; latex of St(70)-Bu(27)-IA(3) (cross-linking)

NP-7; latex of St(75)-Bu(24)-AA(1) (cross-linking, and Tg of 29° C.)

NP-8; latex of St(60)-Bu(35)-DVB(3)-MAA(2) (cross-linking)

NP-9; latex of St(70)-Bu(25)-DVB(2)-AA(3) (cross-linking)

NP-10; latex of VC(50)-MMA(20)-EA(20)-AN(5)-AA(5) (molecular weight of 80,000)

NP-11; latex of VDC(85)-MMA(5)-EA(5)-MAA(5) (molecular weight of 67,000)

NP-12; latex of Et(90)-MAA(10) (molecular weight of 12,000)

NP-13; latex of St(70)-2EHA(27)-AA(3) (molecular weight of 130,000, and Tg of 43° C.)

NP-14; latex of MMA(63)-EA(35)-AA(2) (molecular weight of 33,000, and Tg of 47° C.)

NP-15; latex of St(70.5)-Bu(26.5)-AA(3) (cross-linking, and Tg of 23° C.)

NP-16; latex of St(69.5)-Bu(27.5)-AA(3) (cross-linking, and Tg of 20.5° C.)

NP-17; latex of St(61.3)-Isoprene(33.5)-AA(3) (cross-linking, and Tg of 17° C.)

NP-18; latex of St(67)-Isoprene(28)-Bu(2)-AA(3) (cross-linking, and Tg of 27° C.)

In the above structures, MMA represents methyl metacrylate, EA represents ethyl acrylate, MAA represents methacrylic acid, 2EHA represents 2-ethylhexyl acrylate, St represents styrene, Bu represents butadiene, AA represents acrylic acid, DVB represents divinylbenzene, VC represents vinyl chloride, AN represents acrylonitrile, VDC represents vinylidene chloride, Et represents ethylene, and IA represents itaconic acid.

The above polymer latexes are available commercially. Specifically, the commercial products are as follows: those of acrylic polymers include CEVIAN A-4635, 4718, and 4601 (manufactured by Daicel Chemical Industries, Ltd.), and NIPOL Lx811, 814, 821, 820, and 857 (manufactured by Zeon Corporation); those of polyesters include FINETEX ES 650, 611, 675, and 850 (manufactured by Dainippon Ink and Chemicals), and WD-SIZE, and WMS (manufactured by Eastman Chemical); those of polyurethanes include HYDRAN AP10, 20, 30, and 40 (manufactured by Dainippon Ink and Chemicals); those of rubbers include LACSTAR 7310K, 3307B, 4700H, and 7132C (manufactured by Dainippon Ink and Chemicals), and NIPOL Lx416, 410, 438C, and 2507 (manufactured by Zeon Corporation); those of polyvinyl chlorides include G351 and G576 (manufactured by Zeon Corporation); those of polyvinylidene chlorides include L502 and L513 (manufactured by Asahi Kasei Corp.); and those of polyolefins include CHEMIPEARL S120 and SA100 (manufactured by Mitsui Chemicals, Inc.).

One of these polymer latexes may be used alone, or two or more of them may be used together, as needed.

The latex polymer for use in the hydrophobic polymer layer in the invention is particularly preferably an acrylic copolymer, polyester, or polyurethane. In addition, the latex polymer for use in the hydrophobic polymer layer in the invention preferably contains acrylic acid or methacrylic acid in an amount of 1 to 6 mass %, and more preferably 2 to 5 mass %. The latex polymer for use in the hydrophobic polymer layer in the invention preferably contains acrylic acid.

The coating amount of the hydrophobic polymer per $m^2$ of a support is preferably 0.1 to 10 $g/m^2$, and more preferably 0.3 to 5 $g/m^2$.

The concentration of the polymer in the coating liquid is preferably so adjusted to make the viscosity of the coating liquid suitable for simultaneous multi-layer application, but is not particularly limited. The concentration thereof in the coating liquid is generally 5 to 50 mass %, preferably 10 to 40 mass %, and more preferably 15 to 30 mass %.

<Matting Agent>

The photothermographic material of the invention may contain a matting agent to improve transportability, and the matting agent is described in JP-A No. 11-65021, paragraph Nos. 0126 and 0127. The coating amount of the matting agent per $m^2$ of the photosensitive material is preferably 1 to 400 $mg/m^2$, and more preferably 5 to 300 $mg/m^2$.

In the invention, the matting agent particles may have a definite shape or an indefinite shape, and preferably have a definite shape, and more preferably have a spherical shape.

The volume-weighted average of the sphere-equivalent diameters of the matting agent particles contained in the outer layer of layers provided on a surface of a support on which surface an image-forming layer is provided is preferably 0.3 to 10 μm, more preferably 0.5 to 7 μm. In addition, the variation coefficient of the size distribution of the matting agent particles is preferably 5 to 80% and more preferably 20 to 80%. The variation coefficient is a value represented by (standard deviation of particle diameter)/(average of particle diameter)×100. The outer layer may contain two or more matting agents having different average particle diameters. In such a case, the difference between the largest average particle diameter and the smallest average particle diameter is preferably 2 to 8 μm and more preferably 2 to 6 μm.

The volume-weighted average of the sphere-equivalent diameters of the matting agent particles contained in the outer layer of at least one layer provided on a surface of a support on which surface a back layer is provided is preferably 1 to 15 μm, more preferably 3 to 10 μm. In addition, the variation coefficient of the size distribution of the matting agent particles is preferably 3 to 50% and more preferably 5 to 30%. The outer layer may contain two or more matting agents having different average particle diameters. In such a case, the difference between the largest average particle diameter and the smallest average particle diameter is preferably 2 to 14 μm and more preferably 2 to 9 μm.

The degree of matting on the outer surface of layers provided on a surface of a support on which surface an image-forming layer is provided is set so that star-dust defects do not occur. However, the Beck's smoothness of the outer surface is preferably 30 seconds to 2000 seconds, and more preferably 40 seconds to 1500 seconds. The Beck's smoothness can be easily obtained by Japan Industrial Standard (JIS) P8119 "Method of measuring Beck's smoothness of paper and paperboard with Beck's tester", or TAPPI standard method T479.

The Beck's smoothness, which represents the degree of matting, of the outer surface of at least one layer provided on a surface of a support on which surface a back layer is provided is preferably 10 to 1200 seconds, more preferably 20 to 800 seconds, and still more preferably 40 to 500 seconds.

In the invention, the matting agent is preferably contained in the outermost layer of the photosensitive material, a layer functioning as a surface protective layer, or a layer close to the outermost layer.

<Lubricant>

The photothermographic material preferably contains a lubricant such as liquid paraffin, long-chain fatty acid, fatty acid amide, or fatty acid ester for improvement in handling property during production and scratch resistance during thermal development. The lubricant is preferably liquid paraffin and/or fatty acid ester having a branched structure and a molecular weight of 1,000 or more from which low-boiling components are removed.

The lubricant is preferably selected from compounds described in JP-A No. 11-65021, paragraph No. 0117, JP-A No. 2000-5137, and Japanese Patent Application Nos. 2003-8015, 2003-8071, and 2003-132815.

The amount of the lubricant is generally 1 $mg/m^2$ to 200 $mg/m^2$, preferably 10 $mg/m^2$ to 150 $mg/m^2$, and more preferably 20 mg/m to 100 $mg/m^2$.

The lubricant may be contained in any of the image-forming layer and the non-image-forming layer, but is preferably contained in the outermost layer for improvement in transportability and scratch resistance.

<Surfactant>

A surfactant employable in the invention is described in JP-A No. 11-65021, paragraph No. 0132. Also, this reference describes a solvent in paragraph No. 0133, a support in paragraph No. 0134, an antistatic or electrically conductive layer in paragraph No. 0135, and a method for obtaining a color image in paragraph No. 0136. A lubricant is described in JP-A No. 11-84573, paragraph Nos. 0061–0064 and JP-A No. 2001-83679, paragraph Nos. 0049–0062.

The photothermographic material of the invention preferably contains a fluorinated surfactant. Specific examples of the fluorinated surfactant include those described in JP-A Nos. 10-197985, 2000-19680 and 2000-214554. Moreover, the fluorinated surfactant is preferably a fluorinated polymer surfactant described in JP-A No. 9-281636. The photothermographic material more preferably contains a fluorinated surfactant described in JP-A Nos. 2002-82411, 2003-57780 and 2003-149766. In particular, the fluorinated surfactant described in JP-A Nos. 2003-57780 and 2003-149766 has a good charge regulating ability, good stability of a coated surface and a good lubricating ability when it is coated in the form of an aqueous coating liquid. The fluorinated surfactant described in JP-A No. 2003-149766 is the most preferable in that it has a high charge regulating ability and in that it can be effective even in a small amount.

In the invention, the fluorinated surfactant may be contained in a surface layer provided on one side of the photothermnographic material on which one side an image-forming layer is provided and/or a surface layer provided on the other side of the material on which a back layer is provided, and is preferably contained the surface layer provided on the one side and that on the other side. In addition, it is particularly preferable to use it in combination with an electrically conductive layer containing a metal oxide. In such a case, even when the amount of the fluorinated surfactant contained in a surface layer provided on a side of the photothermographic material on which side the electrically conductive layer is provided is reduced or zero, the resultant photosensitive material can have satisfactory performance.

The amount of the fluorinated surfactant contained in each of the surface layer provided on one side of the photothermographic material on which one side an image-forming layer is provided and that provided on the other side of the material on which a back layer is provided is preferably in the range of 0.1 to 100 mg/m$^2$, more preferably 0.3 to 30 mg/m$^2$, and still more preferably 1 to 10 mg/m$^2$. The fluorinated surfactant described in JP-A No. 2001-264110 is particularly effective, and the amount thereof is preferably in the range of 0.01 to 10 mg/m$^2$ and more preferably 0.1 to 5 mg/m$^2$.

2) Non-photosensitive Intermediate Layer A

A non-photosensitive intermediate layer A is provided on the image-forming layer and the outermost layer and contains a film-forming binder. The intermediate layer A may also contain any additive such as a development accelerate or inhibiter described later, a dye, a pigment, a plasticizer, a lubricant, a cross-linking agent, and/or a surfactant.

<Binder of Non-photosensitive Intermediate Layer A>

The binder contained in the non-photosensitive intermediate layer A is preferably a polymer whose monomers contain the following monomer component represented by Formula (M) in an amount of 10 to 70 mass %.

$$CH_2{=}CR^{01}{-}CR^{02}{=}CH_2 \qquad \text{Formula (M)}$$

In formula (M), $R^{01}$ and $R^{02}$ independently represent a hydrogen atom, an alkyl group having 1 to 6 carbon atoms, a halogen atom, or a cyano group.

The alkyl group preferably has 1 to 4 carbon atoms and more preferably 1 to 2 carbon atoms. The halogen atom is preferably a fluorine, chlorine, or bromine atom, and more preferably a chlorine atom.

Preferably, each of $R^{01}$ and $R^{02}$ is a hydrogen atom, or one of them is a hydrogen atom and the other is a methyl group or a chlorine atom. More preferably, each of them is a hydrogen atom, or one is a hydrogen atom and the other is a methyl group.

Specific examples of the monomer represented by Formula (M) include 2-ethyl-1,3-butadiene, 2-n-propyl-1,3-butadiene, 2,3-dimethyl-1,3-butadiene, 2-methyl-1,3-butadiene, 2-chloro-1,3-butadiene, 1-bromo-1,3-butadiene, 2-fluoro- 1,3-butadiene, 2,3-dichloro-1,3-butadiene, and 2-cyano-1,3-butadiene.

The binder in the invention is a polymer whose monomers contain a monomer represented by Formula (M) as a copolymerizable component. The ratio (copolymerization ratio) of the amount of the monomer represented by Formula (M) to that of all the monomers of the polymer is 10 mass % to 70 mass %, preferably 15 mass % to 65 mass %, and more preferably 20 mass % to 60 mass %. When the copolymerization ratio is less than 10 mass %, the amount of fusible component in the binder reduces, whereby processing fragility deteriorates.

On the other hand, when the copolymerization ratio exceeds 70 mass %, the amount of fusible component in the binder increases, and the mobility of the binder increases. Therefore, image storability deteriorates.

The monomers of the polymer may contain an acidic monomer. The acidic monomer is preferably carboxylic acid, sulfonic acid, and/or phosphoric acid, and more preferably carboxylic acid. The copolymerization ratio of the amount of the acidic monomer to that of all the monomers of the polymer is preferably 1 to 20 mass %, and more preferably 1 to 10 mass %. Specific examples of the acidic monomer include acrylic acid, methacrylic acid, itaconic acid, sodium p-styrenesulfonate, isoprenesulfonic acid, and phosphorylethyl methacrylate. The acidic monomer is more preferably acrylic acid and/or methacrylic acid, and still more preferably acrylic acid.

The glass transition temperature (Tg) of the binder in the invention is preferably in the range of −30° C. to 70° C., more preferably −10° C. to 50° C., and still more preferably 0° C. to 40° C. in view of film forming property and image storability. A blend of two or more types of polymers can be used as the binder. In this case, the average Tg obtained by summing up the Tg of each polymer weighted by its proportion is preferably within the foregoing range. Also, In the case of phase separation or a core-shell structure, the weighted average Tg is preferably within the foregoing range.

The glass transition temperature (Tg) can be calculated by the following equation:

$$1/Tg=\Sigma(Xi/Tgi)$$

In the equation, it is assumed that the polymer is obtained by copolymerizing n monomer components. In other words, i is an integer of 1 to n. Xi represents the mass fraction of an i-th monomer ($\Sigma Xi=1$), and Tgi represents the glass transition temperature (absolute temperature) of a homopolymer of the i-th monomer. Σ indicates the sum of values respectively corresponding to i of 1 to n. The glass transition temperature (Tgi) of a homopolymer of each monomer is obtained from "Polymer Handbook (3rd edition)" (J. Brandrup, E. H. Immergut (Wiley-Interscience, 1989)).

The polymer used for the binder in the invention can be easily synthesized by a solution polymerization method, a suspension polymerization method, an emulsion polymerization method, a dispersion polymerization method, an anionic polymerization method, or a cationic polymerization method. Above all, an emulsion polymerization method in which the polymer is obtained as a latex is the most preferable. In an emulsion polymerization, for example, a system including water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator is prepared. The monomer mixture is polymerized at a temperature in the range of about 30° C. to about 100° C. (preferably 60° C. to 90° C.) for 3 to 24 hours, while the system is being stirred. Various conditions such as the type of the dispersion medium, the monomer concentration, the amount of the initiator, the amount of the emulsifier, the amount of the dispersion medium, reaction temperature, and a method for adding the monomer are suitably determined considering the type of the monomers to be used. Furthermore, it is preferable to use a dispersant as necessary.

Generally, the emulsion polymerization method can be conducted according to the disclosures of the following documents: *Gosei Jushi Emarujon* (Synthetic Resin Emulsions) (edited by Taira Okuda and Hiroshi Inagaki and published by Kobunshi Kankokai (1978)); *Gosei Ratekkusu no Oyo* (Applications of Synthetic Latexes) (edited by Takaaki Sugimura, Yasuo Kataoka, Soichi Suzuki and Keiji Kasahara and published by Kobunshi Kankokai (1993)); and *Gosei Ratekkusu no Kagaku* (Chemistry of Synthetic Latexes) (edited by Soichi Muroi and published by Kobunshi Kankokai (1970)). The emulsion polymerization method for synthesizing the polymer latex in the invention may be a batch polymerization method, a monomer (continuous or divided) addition method, an emulsion addition method, or a seed polymerization method. The emulsion polymerization method is preferably a batch polymerization method, a monomer (continuous or divided) addition method, or an emulsion addition method in view of the productivity of latex.

The polymerization initiator may be any polymerization initiator having radical generating ability. The polymerization initiator may be selected from inorganic peroxides such as persulfates and hydrogen peroxide, peroxides described in the organic peroxide catalogue of NOF Corporation, and azo compounds described in the azo polymerization initiator catalogue of Wako Pure Chemical Industries, Ltd. The polymerization initiator is preferably a water-soluble peroxide such as persulfate and/or a water-soluble azo compound described in the azo polymerization initiator catalogue of Wako Pure Chemical Industries, Ltd., and more preferably ammonium persulfate, sodium persulfate, potassium persulfate, azobis(2-methylpropionamidine) hydrochloride, azobis (2-methyl-N-(2-hydroxyethyl)propionamide), and/or azobiscyanovaleric acid, and, from the viewpoints of image storability, solubility and cost, still more preferably peroxide such as ammonium persulfate, sodium persulfate, and potassium persulfate.

The amount of the polymerization initiator to be added is, based on the total amount of monomers, preferably 0.3 mass % to 2.0 mass %, more preferably 0.4 mass % to 1.75 mass %, and still more preferably 0.5 mass % to 1.5 mass %. When the amount of the polymerization initiator is less than 0.3 mass %, image storability deteriorates. Meanwhile, when it exceeds 2.0 mass %, the latex particles easily aggregate, thereby lowering coating property.

The polymerization emulsifier may be selected from anionic surfactants, nonionic surfactants, cationic surfactants, and amphoteric surfactants. Among these, the polymerization emulsifier is preferably an anionic surfactant from the viewpoints of dispersibility and image storability. The polymerization emulsifier is more preferably a sulfonic acid anionic surfactant because polymerization stability can be ensured even with a small addition amount and the surfactant has resistance to hydrolysis. The polymerization emulsifier is still more preferably a long chain alkyldiphenyl ether disulfonate (whose typical examples include PELEX SS-H manufactured by Kao Corporation), and most preferably a low electrolyte types one such as PIONIN A-43-S (manufactured by Takemoto Oil & Fat Co., Ltd.).

The amount of a sulfonic acid anionic surfactant serving as the polymerization emulsifier is preferably 0.1 mass % to 10.0 mass %, more preferably 0.2 mass % to 7.5 mass %, and still more preferably 0.3 mass % to 5.0 mass %, based on the total amount of monomers. When the amount of the polymerization emulsifier is less than 0.1 mass %, stability at the time of emulsion polymerization cannot be ensured. When it exceeds 10.0 mass %, image storability deteriorates.

It is preferable to use a chelating agent in synthesizing the polymer latex to be used in the invention. The chelating agent is a compound capable of coordinating (chelating) a polyvalent ion such as a metal ion (for example, an iron ion) or an alkaline earth metal ion (for example, a calcium ion). The chelating agent may be selected from compounds described in Japanese Patent Publication (JP-B) No. 6-8956, U.S. Pat. No. 5,053,322, and JP-A Nos. 4-73645, 4-127145, 4-247073, 4-305572, 6-11805, 5-173312, 5-66527, 5-158195, 6-118580, 6-110168, 6-161054, 6-175299, 6-214352, 7-114161, 7-114154, 7-120894, 7-199433, 7-306504, 9-43792, 8-314090, 10-182571, 10-182570 and 11-190892.

The chelating agent is preferably selected from inorganic chelate compounds (such as sodium tripolyphosphate, sodium hexametaphosphate, and sodium tetrapolyphosphate), aminopolycarboxylic acid chelate compounds (such as nitrilotriacetic acid and ethylenediaminetetraacetic acid), organic phosphonic acid chelate compounds (such as compounds described in *Research Disclosure*, No. 18,170, JP-A Nos. 52-102726, 53-42730, 56-97347, 54-121127, 55-4024, 55-4025, 55-29883, 55-126241, 55-65955, 55-65956, 57-179843 and 54-61125, and West German Patent No. 1,045,373), polyphenol chelating agents, and polyamine chelate compounds. The chelating agent is more preferably an aminopolycarboxylic acid derivative.

Typical examples of the aminopolycarboxylic acid derivative include compounds in the appended table of *EDTA* (*-Konpurekisan no Kagaku-*) (EDTA (-Chemistry of Complexons-) (published by Nankodo Co., Ltd. in 1977). Some of the carboxyl groups of these compounds may be in the form of a salt of an alkali metal (such as sodium or potassium) or an ammonium salt. Typical examples of an aminocarboxylic acid derivative include iminodiacetic acid, N-methyliminodiacetic acid, N-(2-aminoethyl)iminodiacetic acid, N-(carbamoylmethyl)iminodiacetic acid, nitrilotriacetic acid, ethylenediamine-N,N'-diacetic acid, ethylenediamine-N,N'-di-a-propionic acid, ethylenediamine-N,N'-di-p-propionic acid, N,N'-ethylene-bis-(α-o-hydroxyphenyl) glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylene-diamine-N,N',N'-triacetic acid, ethylenediamine-N,N,N',N'-tetraacetic acid, 1,2-propylenediamine-N,N,N',N'-tetraacetic acid, d,l-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,l-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohekane-1,4-diamin-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-a-propionic acid, ethylenediamine-N,N'-diacetic acid-N,N'-di-β-propionic acid, ethylenediamine-N,N,N',N'-tetrapropionic acid, diethylenetriamine-N,N,N',N",N"-pentaacetic acid, triethylenetetramine-N,N,N',N",N'",N'"-hexaacetic acid, and 1,2,3-triaminopropane-N,N,N',N",N'",N'"-hexaacetic acid, and those obtained by substituting a part of the carboxyl groups of these compounds with an alkali metal (for example, sodium and potassium) or an ammonium group.

The amount of the chelating agent to be added is preferably 0.01 mass % to 0.4 mass %, more preferably 0.02 mass % to 0.3 mass %, and still more preferably 0.03 mass % to 0.15 mass %, based on the total amount of monomers. When the addition amount of the chelating agent is less than 0.01 mass %, metal ions entering during the preparation of the polymer latex are not sufficiently trapped, and the stability of the latex against aggregation deteriorates, whereby the coating property becomes worse. When it exceeds 0.4 mass %, the viscosity of the latex increases, whereby the coating property deteriorates.

In synthesis of the polymer latex to be used in the invention, it is preferable to use a chain transfer agent. By controlling the addition amount of the chain transfer agent, it is possible to control the gelling rate. The chain transfer agent is preferably one described in *Polymer Handbook* (3rd Edition) (Wiley-Interscience, 1989). The chain transfer agent is more preferably a sulfur compound, because the compound has a high chain transfer ability and because the required amount is small. The chain transfer agent is particularly preferably a hydrophobic mercaptane chain transfer agent such as tert-dodecylmercaptane or n-dodecylmercaptane.

The amount of the chain transfer agent to be added is preferably 0.2 mass % to 2.0 mass %, more preferably 0.3 mass % to 1.8 mass %, and still more preferably 0.4 mass % to 1.6 mass %, based on the total amount of monomers.

Besides the foregoing compounds, other additive may be used such as an electrolyte, a stabilizer, a thickener, a defoaming agent, an antioxidant, a vulcanizer, an antifreezing agent, a gelling agent, and a vulcanization accelerator in the emulsion polymerization. These additives are described in, for example, *Synthetic Rubber Handbook*.

Specific Examples of Polymer

Specific examples of the polymer for use in the invention are shown in Table 1 as exemplified compounds (P-1) to (P-17), but the invention is not limited by these specific examples.

TABLE 1

| Compound No. | Styrene Co-polymerization ratio (wt %) | Isoprene Co-polymerization ratio (wt %) | Acidic monomer Kind | Acidic monomer Co-polymerization ratio (wt %) | Tg (° C.) |
|---|---|---|---|---|---|
| P-1 | 60.4 | 36.6 | Acrylic acid | 3 | 15.5 |
| P-2 | 63 | 34 | Acrylic acid | 3 | 20.2 |
| P-3 | 65 | 32 | Acrylic acid | 3 | 23.9 |
| P-4 | 59.5 | 37.5 | Acrylic acid | 3 | 13.9 |
| P-5 | 45 | 50 | Acrylic acid | 5 | −6.6 |
| P-6 | 70 | 26 | Acrylic acid | 4 | 35.8 |
| P-7 | 45 | 53 | Acrylic acid | 2 | −11.2 |
| P-8 | 60 | 35 | Methacrylic acid | 5 | 21.2 |
| P-9 | 50 | 46 | Methacrylic acid | 4 | 1.5 |
| P-10 | 37 | 56 | Methacrylic acid | 7 | −12.4 |
| P-11 | 70.5 | 27 | Methacrylic acid | 2.5 | 35.2 |
| P-12 | 65.5 | 30 | Itaconic acid | 4.5 | 31.8 |
| P-13 | 60 | 34.5 | Itaconic acid | 5.5 | 24 |
| P-14 | 47 | 50 | Itaconic acid | 3 | −4.6 |
| P-15 | 53.5 | 42.5 | Sodium p-styrenesulfonate | 4 | 6.9 |
| P-16 | 66 | 29 | Sodium p-styrenesulfonate | 5 | 32.2 |
| P-17 | 45.5 | 52 | Sodium p-styrenesulfonate | 2.5 | −8.8 |

A synthesis example of the compound P-1 will be described as a synthesis example of the polymer to be used in the invention. The synthesis method usable in the invention is not limited to the synthesis example described below. Other exemplified compounds can be synthesized by a similar synthesis method.

A polymerization tank in a gas monomer reactor (TAS-2J manufactured by Taiatsu Techno Corp.) containing 1,500 g of distilled water is heated at 90° C. and kept at that time for 3 hours to form passive films on the stainless steel surface and the stainless stirrer parts in the polymerization tank. 582.28 g of distilled water which had been subjected to nitrogen gas-bubbling for 1 hour, 9.49 g of a surfactant [Pionin A-43-S (manufactured by Takemoto Oil & Fat Co., Ltd.)], 19.56 g of 1 mol/L NaOH, 0.20 g of tetrasodium ethylenediaminetetraacetate, 314.99 g of styrene, 190.87 g of isoprene, 10.43 g of acrylic acid, and 2.09 g of tert-dodecylmercaptan were put into the polymerization tank thus treated. The tank was sealed, and the resultant mixture was stirred at an agitating speed of 225 rpm and heated. The heating was conducted to that the internal temperature was 65° C. A solution in which 2.61 g of ammonium persulfate was dissolved in 40 ml of water was added to the mixture, and the resulting blend was stirred for 2 hours. Then, the blend was heated. The heating was conducted so that the internal temperature was 65° C. The blend was stirred at the same temperature for 4 hours. The polymerization conversion rate at this time was 90% as determined by solid matter measurement. A solution in which 5.22 g of acrylic acid was dissolved in 46.98 g of water and 10 g of water were added to the blend. Subsequently, a solution in which 1.30 g of ammonium persulfate was dissolved in 50.7 ml of water was added to the resultant mixture. After addition, the resulting mixture was heated to 90° C. and stirred at the same temperature for 3 hours. After completion of the reaction, the mixture was cool down so that the internal temperature became room temperature. One mol/L NaOH and One mol/L $NH_4OH$ were added to the mixture at a molar ratio of $Na^+$ ion to $NH_4^+$ ion of 1:5.3 so as to adjust the pH of the mixture to 8.4. Thereafter, the mixture was filtered through a polypropylene filter having a pore size of 1.0 μm for removal of foreign matters such as dusts, and the resultant was stored. Thus, 1,248 g of an isoprene latex P-1 was obtained. The chloride ion concentration, as determined by ion chromatography, of the latex was 3 ppm. The chelating agent concentration, as determined by high-performance liquid chromatography, of the latex was 142 ppm. Further, the latex contained particles having an average diameter of 113 nm, a glass transition temperature (Tg) of 15° C., a solid matter concentration of 41.3 mass %, a gelation rate of 50.0 wt %, an ionic conductivity of 5.23 mS/cm (ionic conductivity was measured at 25° C. by using a conductometer CM-30S manufactured by DKK-TOA Corp.), and a glass transition temperature (Tg) of 15° C.

The coating liquid containing the polymer latex to be used in the invention may contain an aqueous solvent, and may further contain a water-miscible organic solvent. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably not more than 50% of the entire amount of the solvents of the coating liquid, and more preferably not more than 30%.

Furthermore, in the polymer latex to be used in the invention, the polymer concentration is, based on the amount of the latex liquid, preferably 10 mass % to 70 mass %, more preferably 20 mass % to 60 mass %, and still more preferably 30 mass % to 55 mass %.

The polymer latex in the invention preferably has an equilibrium moisture content of not more than 2 mass % at 25° C. and 60% RH. The equilibrium moisture content is more preferably 0.01 mass % to 1.5 mass %, and still more preferably 0.02 mass % to 1.0 mass %.

The latex particles in the invention may have a mean particle size in the range of 1 nm to 50,000 nm, preferably 5 nm to 1,000 nm, more preferably 10 nm to 500 mn, and still more preferably 50 nm to 200 nm. The particle size distribution of the particles is not particularly restricted, and may be a wide or monodisperse distribution. In order to adjust the physical properties of the coating liquid, it is preferable to use two or more kinds of particles each having a monodisperse distribution.

In the invention, the non-photosensitive intermediate layer A may further include a hydrophilic polymer such as gelatin, polyvinyl alcohol, methyl cellulose, hydroxypropyl cellulose, or carboxymethyl cellulose as necessary. The amount of such a hydrophilic polymer to be added is preferably not more than 50 mass %, and more preferably not more than 20 mass %, based on the total amount of the binders in the non-photosensitive intermediate layer A.

The coating amount of the binder(s) of the non-photosensitive intermediate layer A in the invention is preferably in the range of 0.5 to 3.0 g/m$^2$ and more preferably 1.0 to 2.0 g/m$^2$.

3) Non-photosensitive Intermediate Layer B

In the invention, the non-photosensitive intermediate layer B is adjacent to the outermost layer and containing a hydrophilic polymer in an amount of 50 mass % or more. The content of the hydrophilic polymer is preferably 50 to 100 mass % and more preferably 60 to 100 mass %. In the invention, the hydrophilic polymer for the non-photosensitive intermediate layer B is preferably an animal protein-derived hydrophilic polymer. The animal protein-derived hydrophilic polymer is natural or chemically modified water-soluble polymer such as glue, casein, gelatin, or albumen.

The hydrophilic polymer is preferably gelatin, and both acid- and alkali-treated gelatins (e.g., lime-treated gelatin), which are classified according to its production method, may be used preferably. The gelatin preferably has a molecular weight of 10,000 to 1,000,000. The hydrophilic polymer may also be other modified gelatin (e.g., phthalated gelatin) modified using amino or carboxyl groups. The gelatin can be inert gelatin (e.g., Nitta Gelatin 750), and/or phthalated gelatin (e.g., Nitta Gelatin 801).

An aqueous gelatin solution solates at a temperature of 30° C. or higher, and gels and loses liquidity at a temperature of less than 30° C. The sol-gel transition occurs reversibly depending on temperature, and the aqueous gelatin solution serving as a coating liquid has a setting property of losing liquidity when cooled down to a temperature of lower than 30° C.

In addition, the photothermographic material may contain not only the animal protein-derived hydrophilic polymer but also a non-animal protein-derived hydrophilic or hydrophobic polymer described below.

The non-photosensitive intermediate layer B may also contain a cross-linking agent, a surfactant, a pH adjusting agent, an antiseptic, a fungicide, a dye, a pigment, and/or a color tone adjusting agent.

Examples of the non-animal protein-derived hydrophilic polymer usable in the invention include natural polymers other than animal protein (e.g., gelatin) such as polysaccharides, microorganism-derived polymers, and animal-derived non-protein polymers; semisynthetic polymer such as cellulose, starch, and alginic acid; and synthetic polymers such as vinyl resins and polyvinyl alcohol. The natural and semisynthetic polymers include those whose raw materials include vegetable-derived cellulose. The non-animal protein-derived hydrophilic polymer is preferably polyvinyl alcohol and/or acrylic acid-vinylalcohol copolymer.

The non-animal protein-derived hydrophilic polymer does not have a setting property, but, when used with a gelling agent, can acquire a setting property, improving coating properties.

The hydrophobic polymer is preferably dispersible in an aqueous solvent.

Typical examples of the polymer dispersible in an aqueous solvent include synthetic resins, polymers and copolymers, and film-forming media such as cellulose acetates, cellulose acetate butyrates, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g., polyvinylformal and polyvinylbutyral), polyesters, polyurethanes, phenoxy resins, polyvinylidene chlorides, polyepoxides, polycarbonates, polyvinyl acetates, polyolefins, cellulose esters, and polyamides.

Specific examples thereof include the latexes for use in the non-photosensitive intermediate layer A according to the invention, polyacrylate, polyurethane, polymethacrylate and copolymers thereof.

4) Auxiliary Additive

The intermediate layers A and B and the outermost layer may contain various auxiliary additives in addition to the binder, as needed.

<Gelling Agent>

The gelling agent in the invention is a substance that, when added to the non-animal protein-derived hydrophilic polymer or the aqueous hydrophobic polymer latex and cooled, causes gelation of the polymer or latex, or which, when added to the polymer or latex together with a gelation-accelerating substance, causes the gelation. The gelation results in a drastic decrease in liquidity.

The gelling agent may be a water-soluble polysaccharide, and specific examples thereof include agar, κ-carrageenan, ι-carrageenan, alginic acid, alginates, agarose, furcelleran, gellan gum, glucono delta lactone, azotobacter vinelandii gum, xanthan gum, pectin, guar gum, locust bean gum, tara gum, cassia gum, glucomannan, tragacanth gum, karaya gum, pullulan, arabic gum, arabinogalactan, dextran, carboxymethylcellulose sodium salt, methylcellulose, psyllium seed gum, starch, chitin, chitosan, and curdlan.

Examples of a substance which gelates when cooled after melting heating include agar, carrageenan, and gellan gum.

Among these, the gelling agent is more preferably κ-carrageenan (e.g., K-9F manufactured by Mitsui Sugar Co., Ltd., or K-15, K-21 to 24, or I-3 manufactured by Nitta Gelatin Inc.), ι-carrageenan, or agar, and still more preferably κ-carrageenan.

The content of the gelling agent used is preferably 0.01 to 10.0 mass %, more preferably 0.02 to 5.0 mass %, and still more preferably 0.05 to 2.0 mass %, with respect to the binder polymer.

<Gelation Accelerator>

The gelling agent is preferably used in combination with a gelation accelerator. The gelation accelerator used in the invention is a substance which, when brought into contact with a gelling agent, accelerates gelation. A specific combination of the gelling agent and the gelation accelerator exhibits such function. Examples of the combinations of the gelling agent and the gelation accelerator usable in the invention include the following ones:

- Combination of an alkali metal ion such as a potassium ion, or an alkaline earth metal ion such as a calcium ion or magnesium ion serving as a gelation accelerator, and, as a gelling agent, carrageenan, alginates, gellan gum, azotobacter vinelandii gum, pectin, or carboxymethylcellulose sodium salt
- Combination of a boron compound such as boric acid as a gelling accelerator and gum such as guar gum, locust bean gum, tara gum, or cassia gum as a gelling agent
- Combination of an acid or alkali as a gelling accelerator and alginate, glucomannan, pectin, chitin, chitosan, or curdlan as a gelling agent
- Combination of a gelling agent and, as a gelation accelerator, water-soluble polysaccharide capable of reacting with the gelling agent to form gel, such as a combination of xanthan gum as a gelling agent and cassia gum as a gelation accelerator, and a combination of carrageenan as a gelling agent and locust bean gum as a gelation accelerator Specific examples of the combination of the gelling agent and the gelation accelerator include the following:

a) combination of κ-carrageenan and potassium;
b) combination of ι-carrageenan and calcium;
c) combination of low methoxyl pectin and calcium;
d) combination of sodium alginate and calcium;
e) combination of gellan gum and calcium;
f) combination of gellan gum and acid; and
g) combination of locust bean gum and xanthan gum.

The gelation accelerator and the gelling agent are preferably contained in different layers, though they may be contained in the same layer. The gelation accelerator is more preferably contained in a layer which is not in contact with a layer containing the gelling agent. That is, it is more preferable that a layer free from both of the gelling agent and the gelation accelerator is disposed between the layer containing the gelling agent and the layer containing the gelation accelerator.

The gelling accelerator is preferably used in an amount of 0.1 to 200 mass %, and more preferably 1.0 to 100 mass % with respect to the gelling agent.

The hydrophilic polymer-containing layer may further contain other additive, such as a surfactant, a pH adjusting agent, an antiseptic, a fungicide, a dye, a pigment, and/or a color tone adjusting agent, as needed.

<Filming Aid>

A filming aid may be added to for an aqueous hydrophobic polymer dispersion to control the minimum filming temperature of the aqueous dispersion. The filming aid, which is also called plasticizer, is an organic compound (usually, an organic solvent) that lowers the minimum filming temperature of a polymer latex, and is described in, for example, Chemistry of Synthesis Latex written by Soichi Muroi, and published by Kobunshi Kankokai in 1970. Typical examples of the filming aid are listed below, but the compounds for use in the invention are not limited to the following specific examples.

Z-1: Benzyl alcohol
Z-2: 2,2,2,4-Tetramethylpentanediol-1,3-monoisobutyrate.
Z-3: 2-Dimethylaminoethanol
Z-4: Diethylene glycol <Cross-linking Agent>

In the invention, a cross-linking agent is preferably contained in any of layers provided on a surface of a support on which surface an image-forming layer is provided. It is more preferably contained in the hydrophilic polymer 2-containing layer or a hydrophilic polymer 1-containing layer such as a non-photosensitive intermediate layer B. Inclusion of the cross-linking agent results in increased hydrophobic property and water resistance of the non-photosensitive intermediate layer, giving an excellent photothermographic material.

The cross-linking agent is not particularly limited and has a plurality of groups which can react with an amino group and/or a carboxyl group in the molecule thereof. Some examples of the cross-linking agent are described in T. H. James, *The Theory of the Photographic Process, Fourth Edition*, Page 77 to 87 (Macmillan Publishing Co., Inc., 1977). The cross-linking agent is preferably an inorganic one such as chromium alum or an organic one agent, and more preferably an organic cross-linking agent.

A hydrophobic-polymer containing layer such as the non-photosensitive intermediate layer A may include a cross-linking agent. In this case, the cross-linking agent is not particularly limited and has a plurality of groups capable of reacting with a carboxyl group in the molecule thereof.

Typical examples of the organic cross-linking agent include carboxylic acid derivatives, carbamic acid derivatives, sulfonic ester compounds, sulfonyl compounds, epoxy compounds, aziridine compounds, isocyanate compounds, carbodiimide compounds, and oxazoline compounds. The organic cross-linking agent is preferably an epoxy compound, an isocyanate compound, a carbodiimide compound, and/or an oxazoline compound. Only a single cross-linking agent may be used, or two or more cross-linking agents may be used together.

Specific examples of the cross-linking agent are described below, but the invention is not limited by these examples.

<<Carbodiimide Compound>>

Water-soluble or water-dispersible carbodiimide compounds are preferable. Examples thereof include isophorone diisocyanate-derived polycarbodiimides described in JP-A No. 59-187029 and JP-B No. 5-27450; tetramethylxylylene diisocyanate-derived carbodiimide compounds described in JP-A No. 7-330849, multi-branched carbodiimide compounds described in JP-A No. 10-30024; and dicyclohexylmethane diisocyanate-derived carbodiimide compounds described in JP-A No. 2000-7642.

<<Oxazoline Compound>>

Water-soluble or water-dispersible oxazoline compounds are preferable, and examples thereof include oxazoline compounds described in JP-A No. 2001-215653.

<<Isocyanate Compound>>

Isocyanate compounds can react with water. Therefore, the isocyanate compounds which function as the crosslinking agents are preferably water-dispersible, and more preferably self-emulsifiable from the viewpoint of pot life. Specific examples thereof include water-dispersible isocyanate compounds described in JP-A Nos. 7-304841, 8-277315, 10-45866, 9-71720, 9-328654, 9-104814, 2000-194045, 2000-194237, and 2003-64149.

<<Epoxy Compound>>

Water-soluble or water-dispersible epoxy compounds are preferable, and specific examples thereof include water-dispersible epoxy compounds described in JP-A Nos. 6-329877 and 7-309954.

Specific examples of the cross-linking agent for use in the invention are listed below, but the invention is not limited by the following examples.

Epoxy Compound

Trade Name:

DIC FINE EM-60 (Dainippon Ink and Chemicals, Inc.)

Isocyanate Compound

Trade Names:

DURANATE WB40-100 (Asahi Kasei Corporation)
DURANATE WB40-80D (Asahi Kasei Corporation)
DURANATE WT20-100 (Asahi Kasei Corporation)
DURANATE WT30-100 (Asahi Kasei Corporation)
CR-60N (Dainippon Ink and Chemicals, Inc.)

Carbodiimide Compound

Trade Names:

CARBODILITE V-02 (Nisshinbo Industries, Inc.)
CARBODILITE V-02-L2 (Nisshinbo Industries, Inc.)
CARBODILITE V-04 (Nisshinbo Industries, Inc.)
CARBODILITE V-06 (Nisshinbo Industries, Inc.)
CARBODILITE E-01 (Nisshinbo Industries, Inc.)
CARBODILITE E-02 (Nisshinbo Industries, Inc.)

Oxazoline Compound

Trade Names:

EPOCROS K-1010E (Nippon Shokubai Co., Ltd.)
EPOCROS K-1020E (Nippon Shokubai Co., Ltd.)
EPOCROS K-1030E (Nippon Shokubai Co., Ltd.)
EPOCROS K-2010E (Nippon Shokubai Co., Ltd.)
EPOCROS K-2020E (Nippon Shokubai Co., Ltd.)
EPOCROS K-2030E (Nippon Shokubai Co., Ltd.)
EPOCROS WS-500 (Nippon Shokubai Co., Ltd.)
EPOCROS WS-700 (Nippon Shokubai Co., Ltd.)

The cross-linking agent used in the invention may be mixed with a binder solution before addition thereof to a coating liquid. Alternatively, the cross-linking agent may be added to the coating liquid in the end of the preparation of the coating liquid, or immediately before coating.

The amount of the cross-linking agent used in the invention is preferably 0.5 to 200 parts by mass, more preferably 2 to 100 parts by mass, and still more preferably 3 to 50 parts by mass with respect to 100 parts by mass of the binder of a layer in which the cross-linking agent is contained.

<<Thickener>>

A thickener is preferably added to a coating liquid for forming the non-photosensitive intermediate layer A. The addition of the thickener enables formation of a hydrophobic layer having a uniform thickness. Examples of the thickener include alkaline metal salts of polyvinyl alcohol, alkaline metal salts of hydroxyethylcellulose, and alkaline metal salts of carboxymethylcellulose. The thickener is preferably thixotropic in view of easy handling, and thus is preferably hydroxyethylcellulose, sodium hydroxymethylcarboxylate, and/or carboxymethyl-hydroxyethylcellulose.

The viscosity of the non-photosensitive intermediate layer A coating liquid including the thickener at 40° C. is preferably 1 to 200 mPa.s, more preferably 10 to 100 mPa.s, and still more preferably 15 to 60 mPa.s.

Organic Silver Salt

1) Composition

The organic silver salt which can be used in the invention is relatively stable to light but, when heated to a temperature of 80° C. or higher in the presence of an exposed photosensitive silver halide and a reducer, serves as a silver ion-supplying matter and forms a silver image. The organic silver salt may be any organic material which can supply silver ions reducible by the reducer. Such a non-photosensitive organic silver salt is disclosed in, for example, JP-A No. 10-62899 (paragraph Nos. 0048 to 0049), EP No. 0803764A1 (page 18, line 24 to page 19, line 37), EP No. 0962812A1, and JP-A Nos. 11-349591, 2000-7683, and 2000-72711. The organic silver salt is preferably the silver salt of an organic acid, particularly the silver salt of a long-chain aliphatic carboxylic acid (having 10 to 30 carbon atoms, and preferably having 15 to 28 carbon atoms). Typical examples of the silver salt of a fatty acid include silver lignocerate, silver behenate, silver arachidate, silver stearate, silver oleate, silver laurate, silver caproate, silver myristate, silver palmitate, and silver erucate, and mixtures thereof. In the invention, it is preferred to use the silver salt of a fatty acid with a silver behenate content of 50 to 100 mol % among these silver salts of fatty acids, more preferably 85–100 mol %, and still more preferably 95–100 mol %. Further, it is preferred to use the silver salt of a fatty acid with a silver erucate content of 2 mol % or less, more preferably 1 mol % or less, and still more preferably 0.1 mol % or less.

The content of silver stearate in the organic silver salt is preferably 1 mol % or less. When the content of silver stearate is 1 mol % or less, the silver salt of an organic acid having low Dmin, high sensitivity and excellent image storability can be obtained. The content of silver stearate in the organic silver salt is more preferably 0.5 mol % or less, and is still more preferably substantially 0 mol %.

When the silver salt of an organic acid includes silver arachidate, the content of silver arachidate is preferably 6 mol % or less in order to obtain a silver salt of organic acid having low Dmin and excellent image storability. The content of silver arachidate is more preferably 3 mol % or less.

2) Shape

There is no particular restriction on the shape of the organic silver salt grains usable in the invention and they may have a needle-like, rod-like, tabular or flaky shape.

However, the organic silver salt grains preferably have a flaky shape in the invention. Also, short needle-like, rectangular parallelopiped, cuboidal, or potato-like, indefinitely shaped grains with a ratio of the major axis length to the minor axis length of 5 or less are preferably as the organic silver salt. Such organic silver grains have a lower level of fogging during thermal development than long needle-like grains with a ratio of the major axis length to the minor axis length of more than 5. In particular, the organic silver salt grains more preferably have a ratio of the major axis length to the minor axis length of 3 or less, since such grains can improve the mechanical stability of a coating film. In this specification, the flaky organic silver salt-grains are defined as follows. When an organic acid silver salt grain is observed under an electron microscope, and the shape of the organic acid silver salt grain is approximated to a rectangular parallelopiped with sides having lengths of a, b and c in ascending order (the length c may be equal to the length b), a value of x is calculated from the shortest length a and the next shortest length b as follows.

$$x=b/a$$

When the values x of about 200 grains are calculated in the above manner and averaged, and the average satisfies the relation of x (average)≧1.5, grains having such an average value x are regarded as flaky. The flaky grains preferably satisfy the relation of 30≧x (average)≧1.5, and more preferably satisfy the relation of 15≧x (average)≧1.5. Needle-like grains satisfy the relation of 1≦x (average)≦1.5.

In the flaky grains, the length a corresponds to the thickness of a tabular grain having, as a principal plane, a plane with sides having lengths b and c. The average of lengths a is preferably 0.01 μm to 0.3 μm, and more preferably 0.1 μm to 0.23 μm. The average of the ratios of the lengths c to the lengths b is preferably 1 to 9, more preferably 1 to 6, still more preferably 1 to 4, and most preferably 1 to 3.

A sphere-equivalent diameter maintained within the range of from 0.05 to 1 μm hinders coagulation in the photosensitive material and provides satisfactory image storability. The sphere-equivalent diameter is preferably 0.1 to 1 μm. In the invention, the sphere-equivalent diameter can be determined by directly taking a photograph of a sample by an electron microscope and then executing image processing of the resultant negative film.

In the aforementioned flaky grains, the ratio of sphere-equivalent diameter/a of each grain is defined as an aspect ratio. The aspect ratio of the flaky grains is preferably within the range of 1.1 to 30 and more preferably within the range of 1.1 to 15 in view of hindering coagulation in the photosensitive material and improving image storability.

The grain size distribution of the organic silver salt grains is preferably monodisperse. The term "monodisperse" means that the percentage of a value obtained by dividing the standard deviations of the lengths of the minor axis and the major axis of each grain respectively by the minor axis and the major axis is preferably 100% or less, more preferably 80% or less and still more preferably 50% or less. The shapes of the organic silver salt grains can be determined from a transmission electron microscopic image of an organic silver salt dispersion. The check to determine whether the organic silver salt grains are monodisperse can be made as follows. The standard deviation of the volume-weighted average diameter of the organic silver salt grains is obtained, and the percentage (variation factor) of a value obtained by dividing the standard deviation by the volume-weighted average diameter is preferably 100% or less, more preferably 80% or less and still more preferably 50% or less. The volume-weighted average diameter can be obtained by irradiating the organic silver salt dispersed in liquid with laser light and determining the self-correlation function of the fluctuation of the scattered light with respect to time.

3) Preparation

Methods known in the art may be applied to a method for producing the organic silver salt used in the invention and to a dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868.

When a photosensitive silver salt is present together with the organic silver salt during dispersion of the organic silver salt, the level of fogging increases and sensitivity becomes remarkably lower. Therefore, it is preferred that the photosensitive silver salt is not substantially contained in the system including the organic silver salt during the dispersion. In the invention, the amount of the photosensitive silver salt in an aqueous dispersion in which the organic silver salt is to be dispersed is preferably 1 mol % or less, more preferably 0.1 mol % or less per mol of the organic acid silver salt in the dispersion. It is even more preferable that positive addition of the photosensitive silver salt is not conducted.

In the invention, the aqueous dispersion of the organic silver salt and that of the photosensitive silver salt can be mixed in producing the photosensitive material, and the mixing ratio of the organic silver salt to the photosensitive silver salt can be selected depending on purpose. The ratio of the photosensitive silver salt to the organic silver salt is preferably in the range of 1 mol % to 30 mol %, more preferably in the range of 2 mol % to 20 mol %, and still more preferably in the range of 3 mol % to 15 mol %. Mixing two or more kinds of the aqueous dispersions of organic silver salts and two or more kinds of the aqueous dispersions of photosensitive silver salts is preferable to control photographic properties.

4) Addition Amount

The organic silver salt usable in the invention may be used in a desired amount, but the total amount of silver including silver contained in the organic silver salt and the silver halide is preferably 0.1 to 5.0 g/m$^2$, more preferably 0.3 to 3.0 g/m$^2$, and still more preferably 0.5 to 2.0 g/m$^2$. In particular, to improve image storability, the total coating silver amount is preferably 1.8 g/m$^2$ or less and more preferably 1.6 g/m$^2$ or less. Use of a reducer preferably used in the invention allows sufficiently high image density even at such a low silver amount.

Explanations of Reducer

The photothermographic material of the invention preferably includes a thermal development agent which is a reducer for the organic silver salt. The reducer for the organic silver salt can be any substance (preferably organic substance) capable of reducing a silver ion into metal silver. Examples of such a reducer are described in JP-A No. 11-65021, paragraph Nos. 0043–0045 and EP No. 0803764A1, page 7, line 34 to page 18, line 12.

The reducer employed in the invention is preferably a bisphenol reducer or a so-called hindered phenol reducer having a substituent in an ortho-position with respect to the phenolic hydroxyl group, and is more preferably a compound represented by the following Formula (R).

Formula (R)

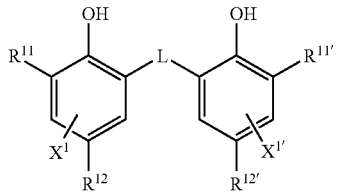

In Formula (R), $R^{11}$ and $R^{11'}$ independently represent an alkyl group having 1 to 20 carbon atoms. $R^{12}$ and $R^{12'}$ independently represent a hydrogen atom or a substituent which can bond to the benzene ring. L represents an —S— or —$CHR^{13}$— group. $R^{13}$ represents a hydrogen atom or an alkyl group having 1 to 20 carbon atoms. $X_1$ and $X_1'$ independently represent a hydrogen atom or a group which can bond to the benzene ring.

Detailed explanations on Formula (R) will be given in the following.

Hereinafter, alkyl groups includes cycloalkyl groups, unless otherwise indicated.

1) $R^{11}$ and $R^{11'}$ $R^{11}$ and $R^{11'}$ independently represent a substituted or unsubstituted alkyl group having 1 to 20 carbon atoms. The type of the substituent of the substituted alkyl group is not particularly limited, but the substituent is preferably an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group or a halogen atom.

2) $R^{12}$ and $R^{12'}$, and $X_1$ and $X_1'$ $R^{12}$ and $R^{12'}$ independently represent a hydrogen atom or a substituent which can bond to the benzene ring, and $X_1$ and $X_1'$ independently represent a hydrogen atom or a group which can bond to the benzene ring. Typical examples of the group which can bond to the benzene ring include alkyl groups, aryl groups, halogen atoms, alkoxy groups, and acylamino groups.

3) L

L represents an —S— or —$CHR^{13}$— group. $R^{13}$ represents a hydrogen atom or a substituted or unsubstituted alkyl group having 1 to 20 carbon atoms. When $R^{13}$ is an unsubstituted alkyl group, typical examples thereof include methyl, ethyl, propyl, butyl, heptyl, undecyl, isopropyl, 1-ethylpentyl, 2,4,4-trimethylpentyl, cyclohexyl, 2,4-dimethyl-3-cyclohexenyl, and 3,5-dimethyl-3-cyclohexenyl groups. As in the examples of the substituent group for $R^{11}$, examples of the substituent of the substituted alkyl group include halogen atoms, alkoxy groups, aklylthio groups, aryloxy groups, arylthio groups, acylamino groups, sulfonamide groups, sulfonyl groups, phosphoryl groups, oxycarbonyl groups, carbamoyl groups, and sulfamoyl groups.

4) Preferable Substituent

Each of $R^{11}$ and $R^{11'}$ is preferably a primary, secondary or tertiary alkyl group having 1 to 15 carbon atoms, and specific examples thereof include methyl, isopropyl, t-butyl, t-amyl, t-octyl, cyclohexyl, cyclopentyl, 1-methylcyclohexyl, and 1-methylcyclopropyl groups. Each of $R^{11}$ and $R^{11'}$ is more preferably an alkyl group having 1 to 4 carbon atoms. Among these, each of $R^{11}$ and $R^{11'}$ is more preferably a methyl, t-butyl, t-amyl, or 1-methylcyclohexyl group, and is most preferably a methyl or t-butyl group.

Each of $R^{12}$ and $R^{12}$, is preferably an alkyl group having 1 to 20 carbon atoms, and specific examples thereof include methyl, ethyl, propyl, butyl, isopropyl, t-butyl, t-amyl, cyclohexyl, 1-methylcyclohexyl, benzyl, methoxymethyl, and methoxyethyl groups. Each of $R^{12}$ and $R^{12}$ is more preferably a methyl, ethyl, propyl, isopropyl, or t-butyl group, and is most preferably a methyl or ethyl group.

Each of $X_1$ and $X_1'$ is preferably a hydrogen or halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms, and a chained alkyl group or a cyclic alkyl group is preferably used as the alkyl group. In addition, an alkyl group having a C═C bond may also be used preferably. Typical examples of the alkyl group include methyl, ethyl, propyl, isopropyl, 2,4,4-trimethylpentyl, cyclohexyl, 2,4-dimethyl-3-cyclohexenyl, and 3,5-dimethyl-3-cyclohexenyl groups. $R^{13}$ is particularly preferably a hydrogen atom or a methyl, ethyl, propyl, isopropyl, or 2,4-dimethyl-3-cyclohexenyl group.

When $R^{11}$ and $R^{11'}$ are tertiary alkyl groups and $R^{12}$ and $R^{12'}$ are methyl groups, $R^{13}$ is preferably a primary or secondary alkyl group having 1 to 8 carbon atoms such as a methyl, ethyl, propyl, isopropyl, or 2,4-dimethyl-3-cyclohexenyl group.

When $R^{11}$ and $R^{11'}$ are tertiary alkyl groups and $R^{12}$ and $R^{12'}$ are alkyl groups other than a methyl group, $R^{13}$ is preferably a hydrogen atom.

When $R^{11}$ and $R^{11'}$ are not tertiary alkyl groups, $R^{13}$ is preferably a hydrogen atom or a secondary alkyl group, and more preferably a secondary alkyl group. The secondary alkyl group is preferably an isopropyl or 2,4-dimethyl-3-cyclohexenyl group.

The reducer exerts different types of influence on thermal developability, and the silvery tone of developed images, depending on the combination of $R^{11}$, $R^{11'}$, $R^{12}$, $R^{12'}$ and $R^{13}$. Two or more of the reducers are preferably used together according to application, because the above properties can be controlled by a proper combination of two or more reducers.

Specific examples of the reducer used in the invention, including the compounds represented by Formula (R) are shown below, but the invention is not limited by such examples.

R-1

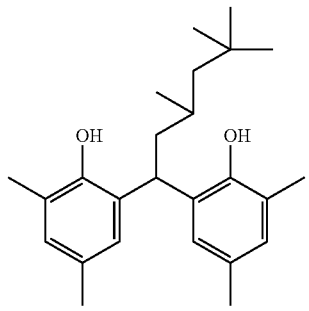

-continued
R-2
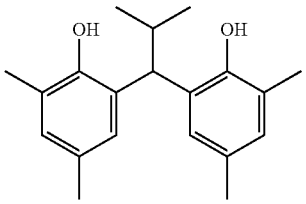
R-3
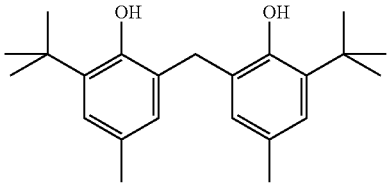
R-4
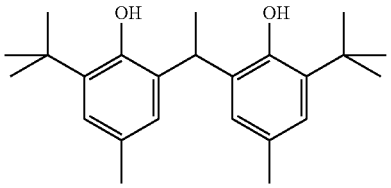
R-5
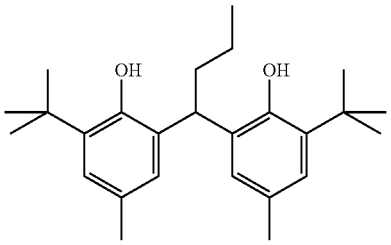
R-6
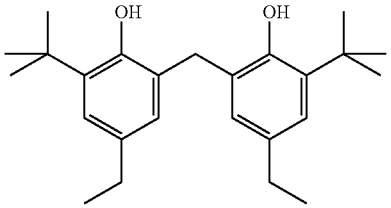
R-7
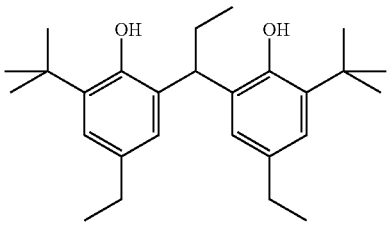
R-8
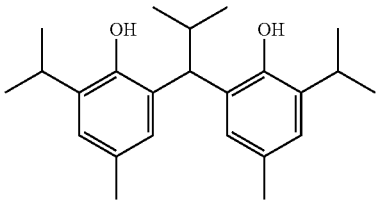
-continued
R-9
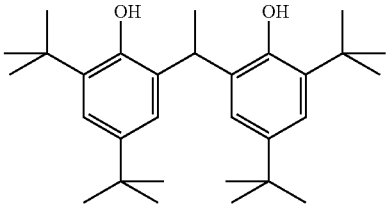
R-10
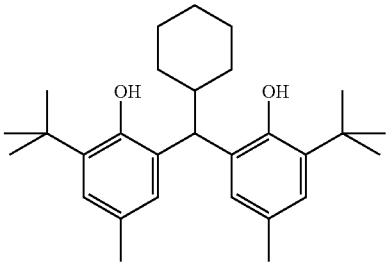
R-11
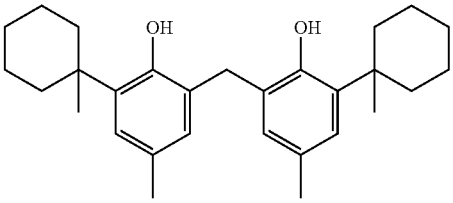
R-12
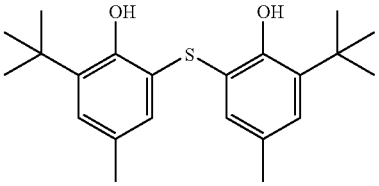
R-13
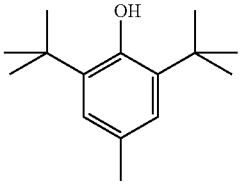
R-14
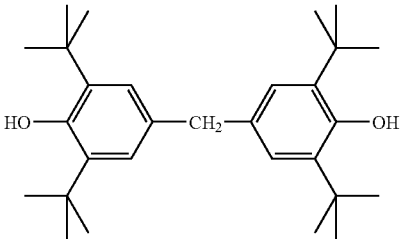
R-15
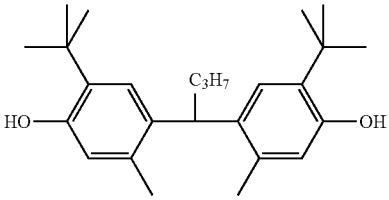

-continued

R-16

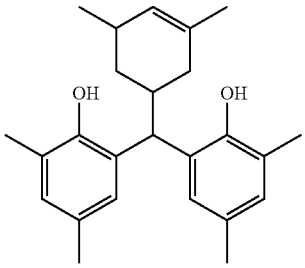

R-17

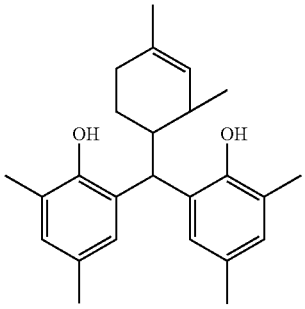

R-18

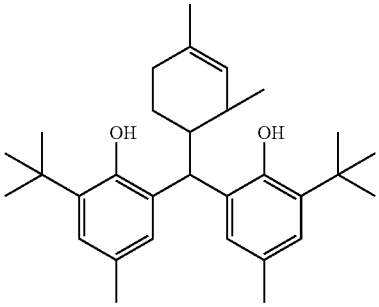

Typical examples of the reducer used in the invention other than those described above include compounds described in JP-A Nos. 2001-188314, 2001-209145, 2001-350235, and 2002-156727, and EP No. 1278101A2.

In the invention, the amount of the reducer added is preferably 0.1 to 3.0 g/m$^2$, more preferably 0.2 to 2.0 g/m$^2$, and still more preferably 0.3 to 1.0 g/m$^2$. The amount of the reducer is preferably 5 to 50 mol % per mole of silver contained in a layer or layers of the thermographic material which are provided on the surface of a support on which the image-forming layer is provided, more preferably 8 to 30 mol %, and still more preferably 10 to 20 mol %. The reducer is preferably included in the image-forming layer.

The reducer may be contained in a coating liquid used in preparing the photosensitive material in any form of a solution, emulsified dispersion, or solid fine particle dispersion.

In a well-known emulsification dispersion method, an emulsified dispersion is mechanically prepared by dissolving the reducer in oil such as dibutyl phthalate, tricresyl phosphate, dioctyl sebacate or tri(2-ethylhexyl) phosphate and a supplementary solvent such as ethyl acetate or cyclohaxanone and emulsifying and dispersing the resultant solution in water with a surfactant such as sodium dodecylbenzenesulfonate, sodium oleoyl-N-methyltaurinate, or sodium di(2-ethylhexyl)sulfosuccinate. In this method, it is preferable to add a polymer such as a-methylstyrene oligomer or poly(t-butylacrylamide) to the emulsion in order to control the viscosity and the refractive index of oil droplets.

In a method for dispersing solid fine particles, powder of the reducer is dispersed in an appropriate solvent such as water by means of a ball mill, a colloid mill, a vibrating ball mill, a sand mill, a jet mill, a roller mill, or ultrasonic waves, thereby obtaining a solid dispersion. In this case, a protective colloid such as polyvinyl alcohol, or a surfactant (for instance, an anionic surfactant such as sodium triisopropylnaphthalenesulfonate (a mixture of compounds having the isopropyl groups in different substitution sites) may be added to the dispersion. The above-described mill generally contains, as dispersion media, zirconia beads, and zirconium derived from the beads may contaminate the dispersion. The amount of zirconium in the dispersion depends on the dispersing conditions, but is generally in the range of 1 ppm to 1000 ppm. Zirconium being contained in an amount of 0.5 mg or less per g of silver is practically acceptable.

The aqueous dispersion preferably contains an antiseptic agent (e.g., benzisothiazolinone sodium salt).

In the invention, the reducer is preferably used as a solid particle dispersion, and the mean particle size of the reducer fine particles is generally 0.01 μm to 10 μm, preferably 0.05 μm to 5 μm, and still more preferably 0.1 μm to 2 μm. In the invention, particles contained in other solid dispersions preferably have a mean particle size within the above range.

Explanations of Development Accelerator

The photothermographic material of the invention preferably contains a development accelerator, and typical examples thereof include sulfonamidophenol compounds described in JP-A Nos. 2000-267222 and 2000-330234 (Formula (A)); hindered phenol compounds represented by Formula (II) described in JP-A No. 2001-92075; hydrazine compounds described in JP-A Nos. 10-62895 and 11-15116 (Formula (1)), and represented by Formula (D) described in JP-A No. 2002-156727, and Formula (1) described in JP-A No. 2002-278017; and phenol and naphthol compounds represented by Formula (2) described in JP-A No. 2001-264929; phenol compounds described in JP-A Nos. 2002-311533 and 2002-341484; and naphthol compounds described in JP-A No. 2003-66558. The development accelerator is preferably a naphthol compound described in JP-A No. 2003-66558. The development accelerator is used in an amount in the range of 0.1 to 20 mole %, preferably 0.5 to 10 mole %, and more preferably 1 to 5 mole % with respect to the reducer. The development accelerator may be introduced into the photosensitive material in the same manner as the reducer, but is particularly preferably added as a solid dispersion or an emulsified dispersion. If added as an emulsified dispersion, it is added preferably as an emulsified dispersion including a high-boiling solvent, which is solid at room temperature, and a low-boiling supplementary solvent, or as a so-called oilless emulsified dispersion that includes no high-boiling solvent.

In the invention, among the above-described compounds, the development accelerator is preferably a hydrazine compound described in JP-A No. 2002-156727 or 2002-278017 and/or a naphthol compound described in JP-A No. 2003-66558.

The development accelerator in the invention is more preferably a compound represented by the following Formula (A-1) or (A-2).

$$Q_1\text{-NHNH-}Q_2 \qquad \text{Formula (A-1)}$$

In the formula, $Q_1$ represents an aromatic or heterocyclic group that binds to —NHNH-$Q_2$ via a carbon atom; and $Q_2$ represents a carbamoyl, acyl, alkoxycarbonyl, aryloxycarbonyl, sulfonyl, or sulfamoyl group.

In Formula (A-1), the aromatic group or heterocyclic group represented by $Q_1$ is preferably a five- to seven-membered unsaturated ring. Typical examples thereof include benzene, pyridine, pyrazine, pyrimidine, pyridazine, 1,2,4-triazine, 1,3,5-triazine, pyrrole, imidazole, pyrazole, 1,2,3-triazole, 1,2,4-triazole, tetrazole, 1,3,4-thiadiazole, 1,2,4-thiadiazole, 1,2,5-thiadiazole, 1,3,4-oxadiazole, 1,2,4-oxadiazole, 1,2,5-oxadiazole, thiazole, oxazole, isothiazole, isoxazole, and thiophene rings. The aromatic or heterocyclic group is also preferably a fused ring in which at least two of these rings are fused.

The ring may have one or more substituents. When the ring has two or more substituents, these substituents may be the same as or different from each other. Examples of the substituent include halogen atoms, and alkyl, aryl, carbonamide, alkylsulfonamide, arylsulfonamide, alkoxy, aryloxy, aklylthio, arylthio, carbamoyl, sulfamoyl, cyano, alkylsulfonyl, arylsulfonyl, alkoxycarbonyl, aryloxycarbonyl, and acyl groups. These substituents may have additional substituents, if possible. Typical examples of the substituent of the above-exemplified substituent include halogen atoms, and alkyl, aryl, carbonamide, alkylsulfonamide, arylsulfonamide, alkoxy, aryloxy, aklylthio, arylthio, acyl, alkoxycarbonyl, aryloxycarbonyl, carbamoyl, cyano, sulfamoyl, alkylsulfonyl, arylsulfonyl, and acyloxy groups.

The carbamoyl group represented by Q2 preferably has 1 to 50 carbon atoms and more preferably 6 to 40 carbon atoms. Example thereof include unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl groups.

The acyl group represented by $Q_2$ preferably has 1 to 50 carbon atoms and more preferably 6 to 40 carbon atoms. Examples thereof include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl groups. The alkoxycarbonyl group represented by $Q_2$ preferably has 2 to 50 carbon atoms and more preferably 6 to 40 carbon atoms, and examples thereof include methoxycarbonyl, ethoxycarbonyl, isobutyloxycarbonyl, cyclohexyloxycarbonyl, dodecyloxycarbonyl, and benzyloxycarbonyl groups.

The aryloxycarbonyl group represented by $Q_2$ preferably has 7 to 50 carbon atoms and more preferably 7 to 40 carbon atoms. Examples thereof include phenoxycarbonyl, 4-octyloxyphenoxycarbonyl, 2-hydroxymethylphenoxycarbonyl, and 4-dodecyloxyphenoxycarbonyl groups. The sulfonyl group represented by $Q_2$ preferably has 1 to 50 carbon atoms and more preferably 6 to 40 carbon atoms. Examples thereof include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl groups.

The sulfamoyl group represented by $Q_2$ preferably has 0 to 50 carbon atoms and more preferably 6 to 40 carbon atoms. Examples thereof include unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl groups. The group represented by $Q_2$ may have, at a site or sites at which the group can be substituted, one or more of groups the same as those described as the examples of the substituent of the five- to seven-membered unsaturated ring represented by $Q_1$. When the group represented by $Q_2$ has two or more substituents, these may be the same as or different from each other.

In the following, typical examples of the compound represented by Formula (A-1) will be described. $Q_1$ is preferably a five-membered or six-membered unsaturated ring, and more preferably a benzene, pyrimidine, 1,2,3-triazole, 1,2,4-triazole, tetrazole, 1,3,4-thiadiazole, 1,2,4-thiadiazole, 1,3,4-oxadiazole, 1,2,4-oxadiazole, thiazole, oxazole, isothiazole, or isoxazole ring, or a fused ring in which at least one of these rings is fused with a benzene or unsaturated heterocyclic ring. $Q_2$ is preferably a carbamoyl group, in particular, a carbamoyl group having a hydrogen atom on the nitrogen atom.

Formula (A-2)

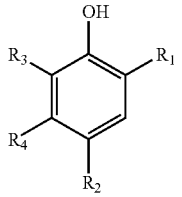

In Formula (A-2), $R_1$ represents an alkyl, acyl, acylamino, sulfonamide, alkoxycarbonyl, or carbamoyl group. $R_2$ represents a hydrogen or halogen atom, or an alkyl, alkoxy, aryloxy, aklylthio, arylthio, acyloxy, or carbonic acid ester group. $R_3$ and $R_4$ each represent a group that may bond to a benzene ring and examples thereof include those described as the examples of the substituent in the compound of Formula (A-1). $R_3$ and $R_4$ may bind to each other to form a fused ring.

$R_1$ is preferably an alkyl group having 1 to 20 carbon atoms (e.g., a methyl, ethyl, isopropyl, butyl, tert-octyl, or cyclohexyl group), an acylamino group (e.g., an acetylamino, benzoylamino, methylureido, or 4-cyanophenylureido group), or a carbamoyl group (e.g., a n-butylcarbamoyl, N,N-diethylcarbamoyl, phenylcarbamoyl, 2-chlorophenylcarbamoyl, or 2,4-dichlorophenylcarbamoyl group); or an acylamino group (including ureido and urethane groups). $R_2$ is preferably a halogen atom (more preferably, a chlorine or bromine atom), an alkoxy group (e.g., a methoxy, butoxy, n-hexyloxy, n-decyloxy, cyclohexyloxy, or benzyloxy group), or an aryloxy group (e.g., a phenoxy or naphthoxy group).

$R_3$ is preferably a hydrogen atom or a halogen atom, or an alkyl group having 1 to 20 carbon atoms, and more preferably a halogen atom. $R_4$ is preferably a hydrogen atom, an alkyl group, or an acylamino group, and more preferably an alkyl or acylamino group. Typical examples of these substituents are the same as in the explanations of $R_1$. When $R_4$ is an acylamino group, it is preferable that $R_4$ binds to $R_3$ to form a carbostyryl ring.

When $R_3$ and $R_4$ in Formula (A-2) bind to each other to form a fused ring, the fused ring is preferably a naphthalene ring. The naphthalene ring may have one or more substituents identical with the substituents described in the explanations of Formula (A-1). When the compound represented by Formula (A-2) is a naphthol compound, $R_1$ is preferably a carbamoyl group. Among them, $R_1$ is more preferably a benzoyl group. $R_2$ is preferably an alkoxy or aryloxy group, and more preferably an alkoxy group.

Typical examples of the development accelerator in the invention are shown bellow, but the invention is not restricted by these examples.

A-1

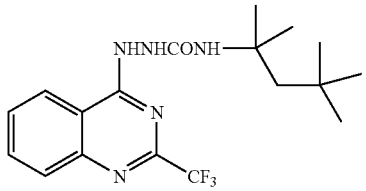

A-2

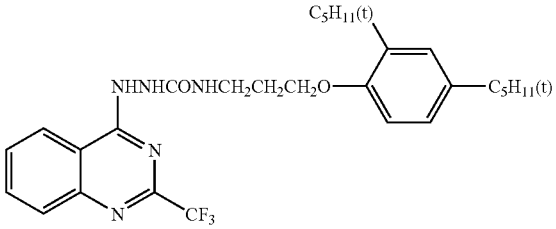

A-3

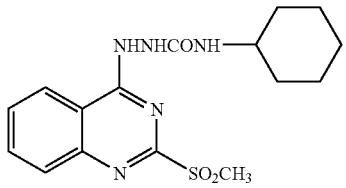

A-4

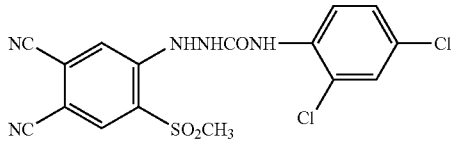

A-5

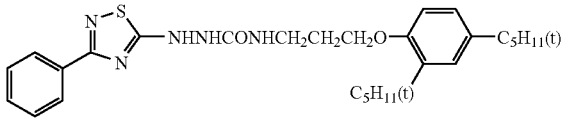

A-6

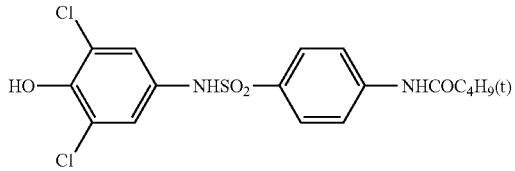

A-7

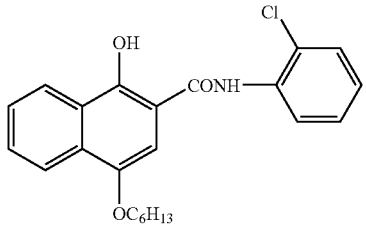

-continued

A-8

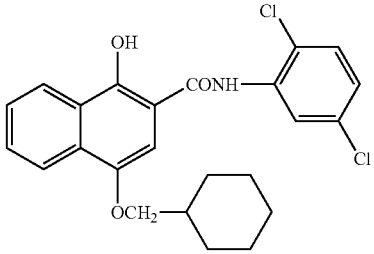

A-9

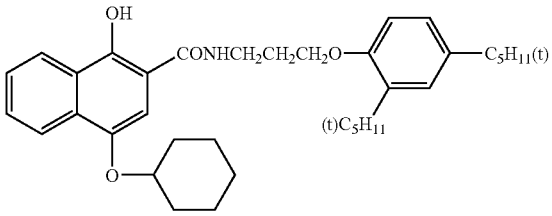

A-10

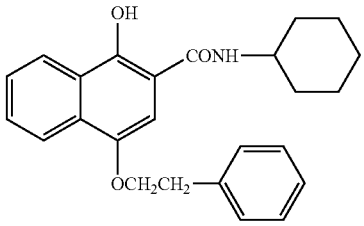

A-11

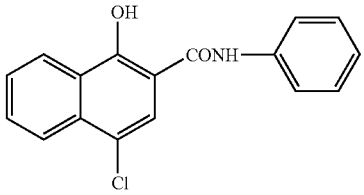

A-12

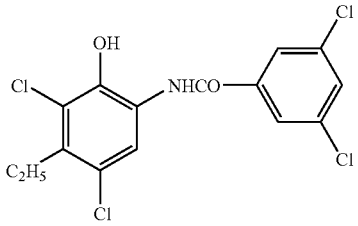

Hydrogen-bonding Compound

When the reducer in the invention has an aromatic hydroxyl group (—OH) or an amino group (—NHR group, wherein R is a hydrogen atom or an alkyl group), especially when it is one of the bisphenols described above, the photothermographic material of the invention preferably contains a non-reducing compound having a group that can form a hydrogen bond together with the aromatic hydroxyl group or the amino group.

Examples of the group that form a hydrogen bond together with the hydroxyl or amino group include phosphoryl, sulfoxide, sulfonyl, carbonyl, amido, ester, urethane, ureido group, tertiary amino, and nitrogen-containing aromatic groups. Among these, the group is preferably a phosphoryl group, a sulfoxide group, an amido group (not having an >N—H moiety but blocked in the form of >N—Ra wherein Ra represents a substituent other than H), a urethane group (not having an >N—H moiety but blocked in the form of >N—Ra wherein Ra represents a substituent other than H), or a ureido group (not having an >N—H moiety but blocked in the form of >N—Ra wherein Ra represents a substituent other than H).

The hydrogen-bonding compound in the invention is particularly preferably a compound represented by the following Formula (D).

Formula (D)

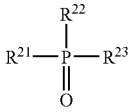

In Formula (D), $R^{21}$ to $R^{23}$ independently represent an alkyl, aryl, alkoxy, aryloxy, amino or heterocyclic group, and these groups may be unsubstituted or have one or more substituents.

When at least one of $R^{21}$ to $R^{23}$ is substituted, examples of the substituent include halogen atoms, and alkyl, aryl, alkoxy, amino, acyl, acylamino, alkylthio, arylthio, sulfonamido, acyloxy, oxycarbonyl, carbamoyl, sulfamoyl, sulfonyl, and phosphoryl groups. The substituent is preferably an alkyl or aryl group. Examples thereof include methyl, ethyl, isopropyl, t-butyl, t-octyl, phenyl, 4-alkoxyphenyl, and 4-acyloxyphenyl groups.

Specific examples of the alkyl groups represented by $R^{21}$ to $R^{23}$ include methyl, ethyl, butyl, octyl, dodecyl, isopropyl, t-butyl, t-amyl, t-octyl, cyclohexyl, 1-methylcyclohexyl, benzyl, phenethyl, and 2-phenoxypropyl groups.

Examples of the aryl groups represented by $R^{21}$ to $R^{23}$ include phenyl, cresyl, xylyl, naphthyl, 4-t-butylphenyl, 4-t-octylphenyl, 4-anisidyl, and 3,5-dichlorophenyl groups.

Examples of the alkoxy groups represented by $R^{21}$ to $R^{23}$ include methoxy, ethoxy, butoxy, octyloxy, 2-ethylhexyloxy, 3,5,5-trimethylhexyloxy, dodecyloxy, cyclohexyloxy, 4-methylcyclohexyloxy, and benzyloxy groups.

Examples of the aryloxy groups represented by $R^{21}$ to $R^{23}$ include phenoxy, cresyloxy, isopropylphenoxy, 4-t-butylphenoxy, naphthoxy, and biphenyloxy groups.

Examples of the amino groups represented by $R^{21}$ to $R^{23}$ include dimethylamino, diethylamino, dibutylamino, dioctylamino, N-methyl-N-hexylamino, dicyclohexylamino, diphenylamino, and N-methyl-N-phenylamino groups.

Each of $R^{21}$ to $R^{23}$ is preferably an alkyl, aryl, alkoxy, or aryloxy group. From the viewpoint of the effects of the invention, at least one of $R^{21}$ to $R^{23}$ is preferably an alkyl or aryl group. More preferably, two or more of them each are an alkyl or aryl group. From the viewpoint of inexpensive availability, $R^{21}$ to $R^{23}$ are preferably the same group.

Specific examples of the hydrogen-bonding compound in the invention, including that represented by Formula (D), are shown below, but the invention is not limited by these examples.

D-1

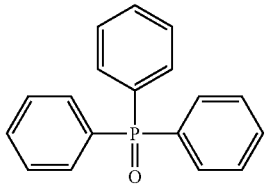

D-2

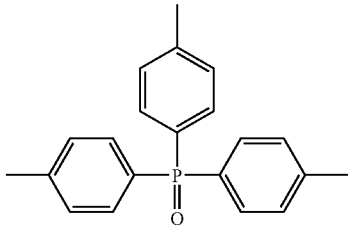

D-3

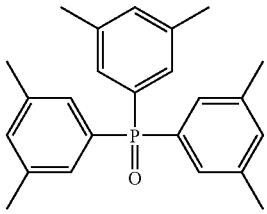

D-4

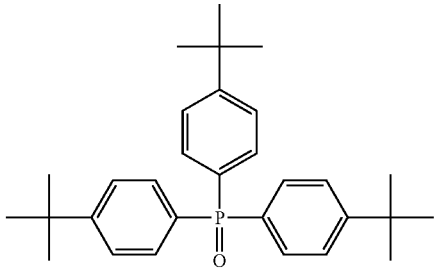

D-5

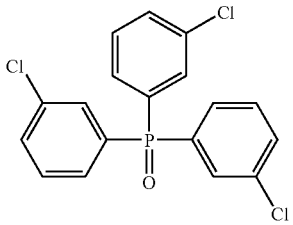

D-6

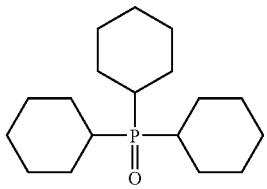

D-7

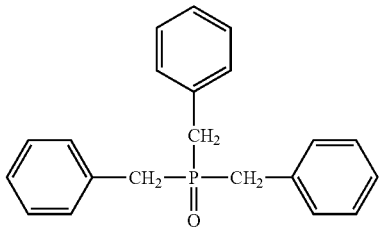

-continued

D-8

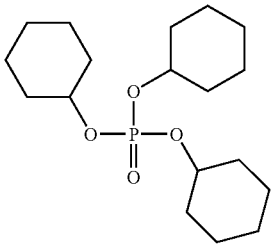

D-9

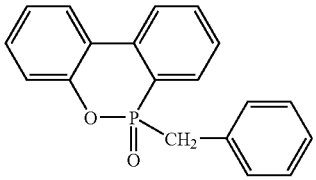

D-10

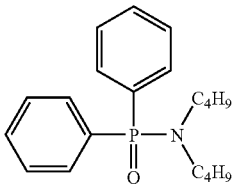

D-11

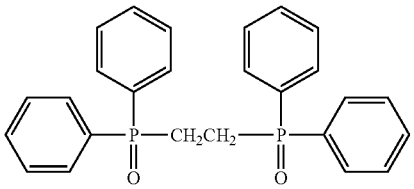

D-12

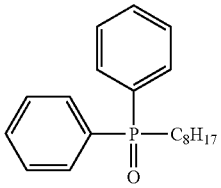

D-13

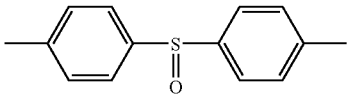

D-14

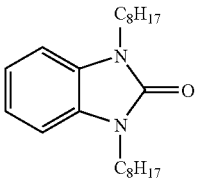

D-15

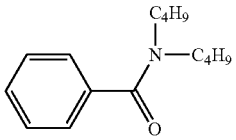

Specific examples of the hydrogen-bonding compounds other than those exemplified above include those described in EP No. 1096310 and in JP-A Nos. 2002-156727 and 2002-318431.

As in the reducer, the compound represented by Formula (D) used in the invention can be added to a coating liquid in the form of a solution, an emulsified dispersion, or a solid fine particle dispersion in incorporating it into the photothermographic material. However, the compound is preferably added in the form of a solid dispersion. In the solution, the compound represented by Formula (D) and the compound having a phenolic hydroxyl group or an amino group form a hydrogen-bonding complex. The compound of Formula (D) can be isolated as the crystal of the complex depending on the combination of the reducer and the compound of Formula (D).

It is particularly preferred to use the crystal powder thus isolated in the form of a solid fine particle dispersion, because it provides stable performance. Further, it is also preferable that powder of the reducer and that of the compound represented by Formula (D) are mixed with each other and that the resultant mixture, together with an appropriate dispersant, is stirred with, for example, a sand grinder mill to form a complex during dispersion.

The amount of the compound of Formula (D) is preferably 1 mol % to 200 mol %, more preferably 10 mol % to 150 mol %, and still more preferably 20 mol % to 100 mol % with respect to the reducer.

Binder of Image-forming Layer

The binder of the image-forming layer may be any polymer. The polymer is preferably transparent or translucent, and generally colorless. The polymer may be a natural resin, polymer or copolymer, or a synthetic resin, polymer or copolymer, or a film-forming medium. Specific examples thereof include gelatins, rubbers, polyvinyl alcohols, hydroxyethylcelluloses, cellulose acetates, cellulose acetate butyrates, polyvinylpyrrolidones, casein, starch, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formal, and polyvinyl butyral), polyesters, polyurethanes, phenoxy resins, polyvinylidene chlorides, polyepoxides, polycarbonates, polyvinyl acetates, polyolefins, cellulose esters, and polyamides. The binder may be used with water, or an organic solvent or used as an emulsion to form a coating liquid.

In the invention, the glass transition temperature (Tg) of the binder which can be contained in s layer including the organic silver salt is preferably in the range of from 0° C. to 80° C., more preferably from 10° C. to 70° C., and still more preferably from 15° C. to 60° C. The binder may be referred to as a high Tg polymer hereinafter.

Two or more binders may be used together, if necessary. For example, a polymer having Tg of 20° C. or more and that having Tg of less than 20° C. can be used together. In the case where two or more kinds of polymers having different Tgs may be blended, it is preferred that the mass-averaged Tg is within the range mentioned above.

In the invention, it is preferred that the image-forming layer is formed by applying a coating liquid containing water in an amount of 30% by mass or more with respect to the total amount of solvent(s) and drying the resultant coating.

In the case where the image-forming layer is formed by first applying a coating liquid containing water in an amount of 30% by mass or more with respect to the total amount of solvent(s) and drying the resultant coating, and in the case where the binder of the image-forming layer is soluble or dispersible in an aqueous solvent (water solvent), particularly in the case where a polymer latex having an equilibrium moisture content of 2% by mass or lower at 25° C. and 60% RH is used as the binder, improved performance can be obtained. Most preferably, the ionic conductivity of the binder is adjusted to 2.5 mS/cm or lower. To attain this, a process for purifying a prepared polymer with a separation functional membrane can be conducted.

The aqueous solvent in which the polymer is soluble or dispersible, as referred herein, is water or a mixture of water and 70% by mass or less of a water-miscible organic solvent. The water-miscible organic solvent can be, for example, alcohol such as methyl alcohol, ethyl alcohol, or propyl alcohol; cellosolve such as methyl cellosolve, ethyl cellosolve, or butyl cellosolve; or ethyl acetate, or dimethylformamide.

The equilibrium moisture content of the binder polymer in the invention at 25° C. and 60% RH is preferably 2% by mass or lower, more preferably 0.01% by mass to 1.5% by mass, and still more preferably 0.02% by mass to 1% by mass.

The binder used in the invention is particularly preferably a polymer dispersible in the aqueous solvent. Examples of a system in which the polymer is dispersed include a latex in which water-insoluble fine particles of hydrophobic polymer are dispersed, or a system in which polymer molecules or micelles formed by the polymer molecules are dispersed. Among these, a latex in which polymer particles are dispersed is preferable. The average size of the dispersed particles is generally in the range of from 1 nm to 50,000 nm, preferably from 5 nm to 1,000 nm, more preferably from 10 nm to 500 nm, and still more preferably from 50 nm to 200 nm. There is no particular limitation on the particle size distribution of the dispersed particles, and the dispersed particles may have a broad distribution or a monodisperse particle size distribution. From the viewpoint of controlling the physical properties of a coating liquid, mixing two or more types of particles each having a monodisperse particle distribution is preferable.

In the invention, the polymer dispersible in the aqueous solvent is preferably a hydrophobic polymer such as acrylic polymer, polyester, rubber (e.g., an SBR resin), polyurethane, polyvinyl chloride, polyvinyl acetate, polyvinylidene chloride, or polyolefin. The polymer may be linear, branched or cross-linked, and may be a homopolymer obtained by polymerizing one kind of monomer, or a copolymer obtained by polymerizing two or more kinds of monomers. In the case of a copolymer, it may be a random copolymer or a block copolymer. The number-average molecular weight of the polymer is generally in the range of from 5,000 to 1,000,000, and preferably from 10,000 to 200,000. Those having too small molecular weight result in an image-forming layer having an insufficient mechanical strength, whereas those having too large molecular weight have a poor film-forming property. Further, the binder is particularly preferably a cross-linkable polymer latex.

Specific Examples of Latex

Typical examples of the polymer latex are given below, and are expressed by starting monomers. The numerical values in parentheses represent the mass percentages of the left monomers. The molecular weight is the number average molecular weight. Latexes whose starting monomers include a polyfunctional monomer form a cross-linked structure, and the concept of molecular weight is not applicable thereto. Hence, they are denoted as "cross-linking", and the molecular weight is not shown. Tg represents the glass transition temperature of the polymer.

P-1; latex of MMA(70)-EA(27)-MAA(3) (molecular weight of 37,000, and Tg of 61° C.)

P-2; latex of MMA(70)-2EHA(20)-St(5)-AA(5) (molecular weight of 40,000, and Tg of 59° C.)

P-3; latex of St(50)-Bu(47)-MAA(3) (cross-linking, and Tg of −17° C.)

P-4; latex of St(68)-Bu(29)-AA(3) (cross-linking, and Tg of 17° C.)

P-5; latex of St(71)-Bu(26)-AA(3) (cross-linking, and Tg of 24° C.)

P-6; latex of St(70)-Bu(27)-IA(3) (cross-linking)

P-7; latex of St(75)-Bu(24)-AA(1) (cross-linking, and Tg of 29° C.)

P-8; latex of St(60)-Bu(35)-DVB(3)-MAA(2) (cross-linking)

P-9; latex of St(70)-Bu(25)-DVB(2)-AA(3) (cross-linking)

P-10; latex of VC(50)-MMA(20)-EA(20)-AN(5)-AA(5) (molecular weight of 80,000)

P-11; latex of VDC(85)-MMA(5)-EA(5)-MAA(5) (molecular weight of 67,000)

P-12; latex of Et(90)-MAA(10) (molecular weight of 12,000)

P-13; latex of St(70)-2EHA(27)-AA(3) (molecular weight of 130,000, and Tg of 43° C.)

P-14; latex of MMA(63)-EA(35)-AA(2) (molecular weight of 33,000, and Tg of 47° C.)

P-15; latex of St(70.5)-Bu(26.5)-AA(3) (cross-linking, and Tg of 23° C.)

P-16; latex of St(69.5)-Bu(27.5)-AA(3) (cross-linking, and Tg of 20.5° C.)

In the above structures, MMA represents methyl metacrylate, EA represents ethyl acrylate, MAA represents methacrylic acid, 2EHA represents 2-ethylhexyl acrylate, St represents styrene, Bu represents butadiene, AA represents acrylic acid, DVB represents divinylbenzene, VC represents vinyl chloride, AN represents acrylonitrile, VDC represents vinylidene chloride, Et represents ethylene, and IA represents itaconic acid.

The above polymer latexes are available commercially. Specifically, the commercial products are as follows: those of acrylic polymers include CEVIAN A-4635, 4718, and 4601 (manufactured by Daicel Chemical Industries, Ltd.), and NIPOL Lx811, 814, 821, 820, and 857 (manufactured by Zeon Corporation); those of polyesters include FINETEX ES 650, 611, 675, and 850 (manufactured by Dainippon Ink and Chemicals), and WD-SIZE, and WMS (manufactured by Eastman Chemical); those of polyurethanes include HYDRAN AP10, 20, 30, and 40 (manufactured by Dainippon Ink and Chemicals); those of rubbers include LACSTAR 7310K, 3307B, 4700H, and 7132C (manufactured by Dainippon Ink and Chemicals), and NIPOL Lx416, 410, 438C, and 2507 (manufactured by Zeon Corporation); those of polyvinyl chlorides include G351 and G576 (manufactured by Zeon Corporation); those of polyvinylidene chlorides include L502 and L513 (manufactured by Asahi Kasei Corp.); and those of polyolefins include CHEMIPEARL S120 and SA100 (manufactured by Mitsui Chemicals, Inc.).

One of these polymer latexes may be used alone, or two or more of these may be used together. Preferable latex The polymer latex for use in the invention is preferably a latex of styrene-butadiene copolymer. The mass ratio of the styrene monomer unit to the butadiene monomer unit of the styrene-butadiene copolymer is preferably in the range of from 40:60 to 95:5. Further, the styrene and butadiene monomer units preferably account for 60 to 99% by mass with respect to all the monomers of the copolymer. Further, the monomers of the polymer latex used in the invention preferably contain acrylic acid or methacrylic acid in the range from 1 to 6% by mass with respect to the sum of styrene and butadiene, and more preferably from 2 to 5% by mass. The monomers of the polymer latex in the invention preferably contain acrylic acid. The preferable range of the molecular weight of the polymer latex is similar to that described above.

Typical examples of the styrene-butadiene-acid copolymer latex for use in the invention include the above-exemplified polymers P-3 to P-8 and P-15; and commercially available LACSTAR-3307B, 7132C, and NIPOL Lx416.

The organic silver salt-containing layer in the invention, namely image-forming layer, is preferably formed using the polymer latex as its binder. As for the amount of the binder of the organic silver salt-containing layer, the mass ratio of all the binders to the organic silver salt is generally in the range of from 1/10 to 10/1, preferably from 1/3 to 5/1, and more preferably from 1/1 to 3/1.

Such an organic silver salt-containing layer is usually an image-forming layer containing a photosensitive silver salt, i.e., a photosensitive silver halide, and in such a case, the mass ratio of all the binders to the silver halide is generally in the range of 400 to 5 and preferably in the range of 200 to 10.

The total amount of the binder(s) in the image-forming layer in the invention is preferably in the range of from 0.2 $g/m^2$ to 30 $g/m^2$, more preferably from 1 $g/m^2$ to 15 $g/m^2$, and even more preferably from 2 $g/m^2$ to 10 $g/m^2$. The image-forming layer in the invention may contain a cross-linking agent for cross-linking the binder, and/or a surfactant to improve coating properties.

Preferable Solvent for Coating Liquid

In the invention, the solvent for use in the coating liquid for the image-forming layer of the photosensitive material (hereinafter, both a solvent and a dispersion medium are called solvents for simplicity) is preferably an aqueous solvent containing water in an amount of 30 mass % or more. In addition to water, the aqueous solvent may contain any water-miscible organic solvent such as methyl alcohol, ethyl alcohol, isopropyl alcohol, methyl cellosolve, ethyl cellosolve, dimethylformamide, or ethyl acetate. The water content of the solvent for coating liquid is preferably 50 mass % or more and more preferably 70 mass % or more. Typical examples of the solvent composition include water, a mixture of water and methyl alcohol at a mass ratio of 90/10, a mixture of water and methyl alcohol at a mass ratio of 70/30, a mixture of water, methyl alcohol and dimethylformamide at a mass ratio of 80/15/5, a mixture of water, methyl alcohol and ethyl cellosolve at a mass ratio of 85/10/5, and a mixture of water, methyl alcohol and isopropyl alcohol at a mass ratio of 85/10/5.

The image-forming layer of the photothermographic material of the invention may contain a hydrophilic polymer such as gelatin, polyvinyl alcohol, methyl cellulose, hydroxypropyl cellulose, or carboxymethyl cellulose, if necessary. The content of the hydrophilic polymer is generally 30% by mass or less, and preferably 20% by mass or less with respect to the total mass of the binder(s) contained in the image-forming layer.

Photosensitive Silver Halide

1) Halogen Composition

The type of the halogen composition of a photosensitive silver halide to be employed in the invention is not particularly restricted, and the photosensitive silver halide can be silver chloride, silver chlorobromide, silver bromide, silver iodobromide, silver iodochlorobromide or silver iodide. Among these, the photosensitive silver halide is preferably silver bromide, silver iodobromide or silver iodide. The halogen composition within each grain may be uniform, or may stepwise change or continuously change. Also, silver halide grains having a core/shell structure may be preferably employed as the photosensitive silver halide. The core/shell structure is preferably a 2- to 5-layered structure, and more preferably 2- to 4-layered structure. A Silver bromide or silver iodide layer may be provided on the surface of each of silver chloride, silver bromide or silver chlorobromide grains.

2) Grain Forming Method

A method for forming photosensitive silver halide grains is well known in the art, and can be, for example, any of methods described in Research Disclosure 17029, June 1978 and U.S. Pat. No. 3,700,458. More specifically, a method can be used in which a silver-supplying compound and a halogen-supplying compound are added to a solution of gelatin or other polymer to prepare a photosensitive silver halide, which is then mixed with an organic silver salt. Alternatively, any of methods described in JP-A No. 11-119374, paragraph Nos. 0217 to 0224, and JP-A Nos. 11-352627 and 2000-347335 can be used.

3) Grain Size

The sizes of the photosensitive silver halide grains are preferably small to suppress turbidity after image formation. More specifically, it is preferably 0.20 μm or less, more preferably 0.01 to 0.15 μm and even more preferably 0.02 to 0.12 μm. The grain size means a diameter of a circle having the same area as the projected area of a silver halide grain (in the case where the photosensitive silver halide grains are tabular, the projected area of the principal plane thereof).

4) Grain Shape

The shapes of the silver halide grains can be cubic, octahedral, tabular, spherical, rod-like, or potato-like, but the silver halide grains are preferably cubic in the invention. Moreover, silver halide grains having rounded corners can also be advantageously employed. The plane index (Miller's index) of the external surface of each photosensitive silver halide grain is not particularly restricted. However, it is preferable that the proportion of a {100} plane, which, when the grain adsorbs a spectrally sensitizing dye, shows high spectral sensitization efficiency, is high. The proportion is preferably 50% or higher, more preferably 65% or higher and still more preferably 80% or higher. The Miller's index of the {100} plane can be determined by a method described in T. Tani; J. Imaging Sci., 29, 165 (1985), utilizing adsorption dependences of {111} and {100} planes in the adsorption of a sensitizing dye.

5) Heavy Metal

The photosensitive silver halide grains used in the invention may include a metal or a complex of a metal of Groups 8 to 13 of the periodic table having Groups 1 to 18. The metal or the central metal of the metal complex preferably belongs to Groups 8 to 10 of the periodic table. Such a metal or central metal is preferably rhodium, ruthenium, iridium or iron. Such a metal complex may be used alone, or two or more complexes having the same metal or different metals can be used together. The content of the metal or metal complex is preferably within the range of $1\times10^{-9}$ to $1\times10^{-3}$ moles per mole of silver. The heavy metals, and complexes thereof and a method of addition thereof are described in JP-A Nos. 7-225449, 11-65021, paragraph Nos. 0018 to 0024, and 11-119374, paragraph Nos. 0227 to 0240.

In the invention, the silver halide grains preferably contain a hexacyano metal complex in the outermost surface portion thereof. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{-3}$, $[Cr(CN)_6]^{-3}$, and $[Re(CN)_6]^{3-}$. In the invention, the hexacyano metal complex is preferably a hexacyano iron complex.

Since the hexacyano metal complex is present in the form of ions in an aqueous solution, the counter cation is not important. However, the counter cation is preferably an alkali metal ion such as a sodium ion, a potassium ion, a rubidium ion, a cesium ion or a lithium ion, an ammonium ion or an alkylammonium ion (such as a tetramethylammonium ion, a tetraethylammonium ion, a tetrapropylammonium ion or a tetra(n-butyl)ammonium ion), because it is easily miscible with water and is suitable for precipitating operation of a silver halide emulsion.

The hexacyano metal complex can be mixed with water, or a mixed solvent of water and a suitable organic solvent miscible with water (for example, alcohol, ether, glycol, ketone, ester or amide), or gelatin in preparing the photothermographic material.

The amount of the hexacyano metal complex added is preferably $1\times10^{-5}$ to $1\times10^{-2}$ moles per mole of silver, and more preferably $1\times10^{-4}$ to $1\times10^{-3}$ moles per mole of silver.

In order for the hexacyano metal complex to exist in the outermost surface portion of each silver halide grain, the hexacyano metal complex is directly added to a system before the end of a charging step, or during a rinsing step or a dispersing step, or before a chemical sensitization step, namely within a period from the end of addition of an aqueous silver nitrate solution for grain formation to the start of the chemical sensitization step, such as a chalcogen sensitization including sulfur sensitization, selenium sensitization or tellurium sensitization, or a precious metal sensitization including gold sensitization. In order to prevent the growth of the silver halide fine grains, it is preferable to add the hexacyano metal complex to the system soon after the grain formation, and to execute the addition before the end of the charging step.

The addition of the hexacyano metal complex is preferably started after 96 mass % of the total amount of silver nitrate for grain formation is added to the system, more preferably after 98 mass % of the total amount of silver nitrate for grain formation is added to the system and still more preferably after 99 mass % of the total amount of silver nitrate for grain formation is added to the system.

When the hexacyano metal complex is added after the addition of the last portion of an aqueous silver nitrate solution to be added immediately before the completion of grain formation, the metal complex can be adsorbed on the outermost surfaces of silver halide grains, and most thereof and silver ions on the surfaces of the grains form a poorly soluble salt. The resultant silver salt of hexacyanoferrate (II) is less soluble than AgI. Therefore, even when the silver halide grains are small, re-dissolution of the silver salt of hexacyanoferrate can be prevented, thereby enabling production of silver halide grains having a small size.

The metal atom or metal complex (for example, $[Fe(CN)_6]^{4-}$) that can be included in the silver halide grains employed in the invention, a desalting method and a chemical sensitizing method of the silver halide emulsion are described in JP-A No. 11-84574, paragraph Nos. 0046–0050, No. 11-65021, paragraph Nos. 0025–0031, and No. 11-119374, paragraph Nos. 0242–0250.

6) Gelatin

Any type of gelatin can be contained in the photosensitive silver halide emulsion employed in the invention. It is necessary to maintain a satisfactory dispersion state of the photosensitive silver halide emulsion in a coating liquid containing an organic silver salt, and it is preferable to use gelatin having a molecular weight of 10,000 to 1,000,000. It is also preferable to phthalate the substituent of gelatin. Such gelatin may be used at the time of grain formation, or dispersion after a desalting process., however it is preferably used at the time of grain formation.

7) Sensitizing Dye

In the invention, it is preferable that, when adsorbed on the silver halide grains, a sensitizing dye can spectrally sensitize the silver halide grains in a desired wavelength region and has spectral sensitivity suitable for the spectral characteristics of an exposure light source. Examples of the sensitizing dye and a method of addition thereof described in, for example, JP-A No. 11-65021, paragraph Nos. 0103–0109, JP-A No. 10-186572 (a compound represented by Formula (II)), JP-A No. 11-119374 (a dye represented by Formula (I) and the descriptions of paragraph No. 0106), U.S. Pat. No. 5,510,236, U.S. Pat. No. 3,871,887 (a dye described in Example 5), JP-A Nos. 2-96131 and 59-48753 (dyes disclosed therein), EP No. 0803764A1 (page 19, line 38 to page 20, line 35), and JP-A Nos. 2001-272747, 2001-290238 and 2002-23306. One of these sensitizing dyes may be used alone or two or more of these can be used together. In the invention, adding the sensitizing dye to the silver halide emulsion is preferably conducted in a period from the end of a desalting process to a coating process, and more preferably in a period from the end of the desalting process to the end of a chemical ripening process.

The amount of the sensitizing dye added in the invention can be selected according to a desired sensitivity or a desired fog level, however it is preferably within the range of $10^{-6}$ to 1 mole per mole of silver halide in the image-forming layer, and more preferably $10^{-4}$ to $10^{-1}$ moles.

In the invention, in order to improve spectral sensitizing efficiency, the photosensitive silver halide emulsion may contain a super sensitizer. Examples of the super sensitizer employable in the invention include compounds described in EP No. 587338, U.S. Pat. Nos. 3,877,943 and 4,873,184 and JP-A Nos. 5-341432, 11-109547 and 10-111543.

8) Chemical Sensitization

The photosensitive silver halide grains in the invention are preferably chemically sensitized by a sulfur, selenium and/or tellurium sensitization method. Any of known compounds, for example, those described in JP-A No. 7-128768, may be used as the compound for use in the sulfur, selenium, and/or tellurium sensitization method. In particular, the grains are preferably subjected to tellurium sensitization in the invention, and any of compounds described in literature shown in paragraph No. 0030 of JP-A No. 11-65021 and compounds represented by Formulae (II), (III), and (IV) of JP-A No. 5-313284 is preferably used in the sensitization.

The photosensitive silver halide grains used in the invention are preferably chemically sensitized by a gold sensitization method or a combination of a gold sensitization method and the chalcogen sensitization. A gold sensitizer preferably contains a monovalent or trivalent gold, and is preferably an ordinarily employed gold sensitizer. Typical examples thereof include chloroauric acid, bromoauric acid, potassium chloroaurate, potassium bromoaurate, auric trichloride, potassium auric thiocyanate, potassium iodoaurate, tetracyanoauric acid, ammonium aurothiocyanate, and pyridyl trichlorogold. In addition, any of gold sensitizers described in U.S. Pat. No. 5,858,637 and JP-A No. 2002-278016 can also be preferably used.

In the invention, the chemical sensitization may be executed any time after grain formation and before coating, and can be executed, after desalting, and (1) before spectral sensitization, (2) simultaneously with spectral sensitization, (3) after spectral sensitization, or (4) immediately before coating.

The amount of the sulfur, selenium or tellurium sensitizer employed in the invention depends on the type of the silver halide grains to be used and chemical ripening conditions. However, it is generally within the range of $10^{-8}$ to $10^{-2}$ moles per mole of silver halide, and preferably $10^{-7}$ to $10^{-3}$ moles.

The amount of the gold sensitizer to be added depends on various conditions. However, it is generally within the range of $10^{-7}$ to $10^{-3}$ moles per mole of silver halide, and preferably $10^{-6}$ to $5\times10^{-4}$ moles.

The conditions of the chemical sensitization in the invention are not particularly restricted. Generally, the pH of the emulsion is 5 to 8, the pAg of the emulsion is 6 to 11 and the temperature is 40 to 95° C.

The silver halide emulsion to be employed in the invention may contain a thiosulfonic acid compound by a method described in EP No. 293,917.

The photosensitive silver halide grains used in the invention preferably contain a reduction sensitizer. The compound used in reduction sensitization is preferably ascorbic acid, aminoiminomethanesulfinic acid, stannous chloride, a hydrazine derivative, a borane compound, a silane compound, or a polyamine compound. The reduction sensitizer may be added in any step in the photosensitive emulsion preparing process from a grain growing step to an adjusting step immediately before coating. It is also preferred to execute the reduction sensitization by ripening the emulsion at a pH value of 7 or higher or at a pAg value of 8.3 or lower, or by introducing a single addition part of silver ions in the course of grain formation.

9) Compound that can be One-electron-oxidized to Provide a One-electron Oxidant which Releases One or More Electrons The photothermographic material of the invention preferably contains a compound that can be one-electron-oxidized to provide a one-electron oxidant which releases one or more electrons. The compound is used alone or used together with the chemical sensitizer(s) described above, and increases the sensitivity of silver halide.

The compound that can be one-electron-oxidized to provide a one-electron oxidant which releases one or more electrons, and which is contained in the silver halide photographic photosensitive material of the invention is selected from the following type-I compound and type-2 compound.

Type-1 Compound

A compound that can be one-electron-oxidized to provide a one-electron oxidant which further releases one or more electrons, due to being subjected to a subsequent bond cleavage reaction Type-2 Compound A compound that can be one-electron-oxidized to provide a one-electron oxidant, which further releases one or more electrons after being subjected to a subsequent bond formation reaction At first type-1 compound will be explained.

Examples of type-1 compound that can be one-electron-oxidized to provide a one-electron oxidant which further releases one or more electrons, due to being subjected to a subsequent bond cleavage reaction include compounds described as "1-photon 2-electron sensitizers" or "deprotonated electron-donating sensitizers" in JP-A No. 9-211769 (compounds PMT-1 to S-37 described in Tables E and F on pages 28 to 32), JP-A No. 9-211774, JP-A No. 11-95355 (compounds INV 1–36), JP-A No. 2001-500996 (compounds 1–74, 80–87, and 92–122), U.S. Pat. Nos. 5,747,235 and 5,747,236, EP No. 786692A1 (compounds INV 1–35), EP No. 893732A1, U.S. Pat. Nos. 6,054,260 and 5,994,051. Preferred embodiments of these compounds are the same as those described in the-specifications of the above applications.

Examples of type-1 compound that can be one-electron-oxidized to provide a one-electron oxidant which further releases one or more electrons, due to being subjected to a subsequent bond cleavage reaction include compounds represented by Formula (1) (the same as Formula (1) described in JP-A No. 2003-114487), Formula (2) (the same as Formula (2) described in JP-A No. 2003-114487), Formula (3) (the same as Formula (1) described in JP-A No. 2003-114488), Formula (4) (the same as Formula (2) described in JP-A No. 2003-114488), Formula (5) (the same as Formula (3) described in JP-A No. 2003-114488), Formula (6) (the same as Formula (1) described in JP-A No. 2003-75950), Formula (7) (the same as Formula (2) described in JP-A No. 2003-75950), and the Formula (8) (the same as Formula (1) described in Japanese Patent Application No. 2003-25886), and compounds which can cause a reaction represented by Chemical Reaction Formula (1) (the same as Chemical Reaction Formula (1) described in Japanese Patent Application No. 2003-33446) and which are represented by Formula (9) (the same as Formula (3) described in Japanese Patent Application No. 2003-33446). Preferred embodiments of these compounds are also the same as those described in the specifications of the above applications.

Formula (1)

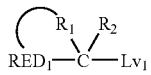

Formula (2)

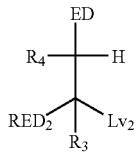

In Formulae (1) and (2), $RED_1$ and $RED_2$ represent a reductive group. $R_1$ represents a non-metal atomic group which, together with a carbon atom (C) and $RED_1$, can form a cyclic structure equivalent to a tetrahydro derivative or a hexahydro derivative of a five- or six-membered aromatic ring (including a hetero aromatic ring). $R_2$, $R_3$, and $R_4$ represent a hydrogen atom or a substituent. $L_{v1}$ and $L_{v2}$ represent a leaving group. ED represents an electron-donating group.

Formula (3)

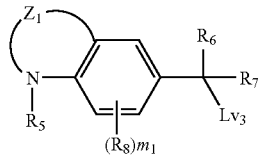

Formula (4)

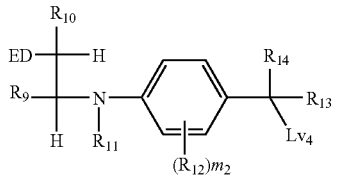

Formula (5)

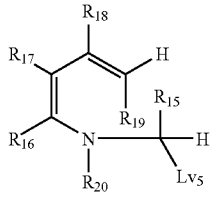

In Formulae (3) to (5), $Z_1$ represents an atomic group which, together with the nitrogen atom and two carbon atoms in the benzene ring, can form a six-membered ring. $R_5$ to $R_7$, $R_9$ to $R_{11}$, and $R_{13}$ to $R_{19}$ independently represent a hydrogen atom or a substituent. $R_{20}$ represents a hydrogen atom or a substituent. When $R_{20}$ represents a group other than an aryl group, $R_{16}$ and $R_{17}$ are bonded to each other to form an aromatic ring or an aromatic heterocycle; $R_8$ and $R_{12}$ independently represent a substituent which can be bonded to the benzene ring, m1 represents an integer of 0 to 3, and m2 represents an integer of 0 to 4. $Lv_3$, $Lv_4$, and $Lv_5$ independently represent a leaving group. ED represents an electron-donating group.

Formula (6)

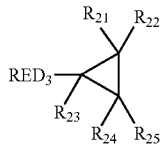

Formula (7)

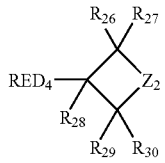

In Formulae (6) and (7), $RED_3$ and $RED_4$ independently represent a reductive group. $R_{21}$ to $R_{30}$ independently represents a hydrogen atom or a substituent. $Z_2$ represents $—CR_{111}R_{112}—$, $—NR_{113}—$, or —O—. $R_{111}$ and $R_{112}$ independently represent a hydrogen atom or a substituent. $R_{113}$ represents a hydrogen atom or an alkyl, aryl, or heterocyclic group.

Formula (8)

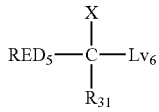

In Formula (8), $RED_5$ represents a reductive group, i.e., an arylamino group or a heterocyclic amino group. $R_3$, represents a hydrogen atom or a substituent. X represents an alkoxy, aryloxy, heterocyclic oxy, aklylthio, arylthio, heterocyclic thio, alkylamino, arylamino, or heterocyclic amino group. $Lv_6$ represents a leaving group, i.e., a carboxy group or a salt thereof or a hydrogen atom.

Chemical Reaction Formula (1)

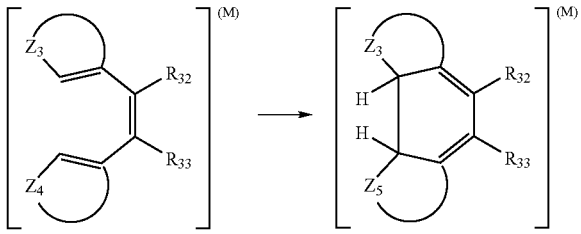

Formula (9)

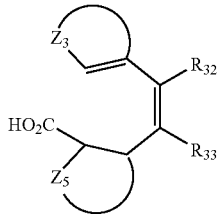

The compound represented by Formula (9) is a compound which, when oxidized after two-electron oxidation accompanied by decarboxylation, causes a bond formation reaction represented by chemical reaction formula (1). In the chemical reaction formula (1), $R_{32}$ and $R_{33}$ independently represent a hydrogen atom or a substituent; $Z_3$ represents a group which, together with the C═C group, forms a five-membered or six-membered heterocycle. $Z_4$ represents a group which, together with the C═C group, forms a five- or six-membered, aryl or heterocyclic group. M represents a radical, a radical cation, or a cation. In Formula (9), the definitions of $R_{32}$, $R_{33}$, and $Z_3$ are the same as those of $R_{32}$, $R_{33}$, and $Z_3$ in the chemical reaction formula (1). $Z_5$ represents a group which, together with the C—C group, forms a five-membered or six-membered alicyclic hydrocarbon group or heterocyclic group.

Next, type-2 compound of will be explained.

Specific examples of type-2 compound, a compound that can be one-electron-oxidized to provide a one-electron oxidant, which further releases one or more electrons after being subjected to a subsequent bond formation reaction, include a compound represented by Formula (10) (the same as Formula (1) described in JP-A No. 2003-140287), and a compound represented by Formula (11) (the same as Formula (2) described in Japanese Patent Application No. 2003-33446) which can cause a chemical reaction represented by Chemical Reaction Formula (1) (the same as Chemical Reaction Formula (1) described in Japanese Patent Application No. 2003-33446). Preferred embodiments of these compounds are the same as those described in the specifications of the above applications.

$RED_6$-Q-Y Formula (10)

In Formula (10), $RED_6$ represents a reductive group to be one-electron oxidized. Y represents a reactive group containing a carbon-carbon double bond site, a carbon-carbon triple bond site, an aromatic site, or a benzo-condensed non-aromatic heterocyclic site that reacts with the one-electron oxidant obtained by one-electron oxidation of $RED_6$ and forms a new bond therewith. Q represents a connecting group connecting $RED_6$ and Y.

Chemical Reaction Formula (1)

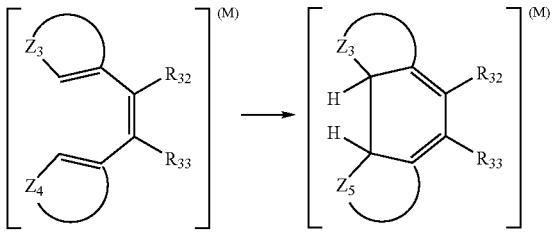

Formula (11)

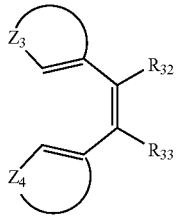

The compound represented by Formula (11) is a compound that, when oxidized, causes a bond formation reaction represented by Chemical Reaction Formula (1). In Chemical Reaction Formula (1), $R_{32}$ an $R_{33}$ independently represent a hydrogen atom or a substituent. $Z_3$ represents a group which, together with the C═C group, forms a five- or six-membered heterocycle. $Z_4$ represents a group which, together with the C═C group, forms a five- or six-membered aryl group or a heterocycle. $Z_5$ represents a group which, together with the C—C group, forms a five- or six-membered alicyclic hydrocarbon group or a heterocycle. M represents a radical, radical cation, or cation. In Formula (11), $R_{32}$, $R_{33}$, $Z_3$, and $Z_4$ have the same meanings as in Chemical Reaction Formula (1).

Type-1 or 2 compound is preferably a "compound having an adsorptive group to silver halide in the molecule thereof", or "compound having the partial structure of a spectral sensitizing dye in the molecule thereof". Typical examples of the adsorptive group to silver halide include groups described in JP-A No. 2003-156823, page 16, line 1 of right column to page 17, line 12 of right column. The partial structure of a spectral sensitizing dye is the structure described in JP-A No. 2003-156823, page 17, line 34 of right column to page 18, line 6 of left column.

Type-1 or 2 compound is more preferably a "compound having at least one adsorptive group to silver halide in the molecule thereof", and still more preferably a "compound having two or more adsorptive groups to silver halide in the molecule thereof". In the case where two or more adsorptive groups exist in the same molecule, these adsorptive groups may be identical with or different from each other.

The adsorptive group is preferably a mercapto-substituted, nitrogen-containing heterocyclic group (e.g., a 2-mercaptothiadiazole, 3-mercapto-1,2,4-triazole, 5-mercaptotetrazole, 2-mercapto-1,3,4-oxadiazole, 2-mercaptobenzoxazole, 2-mercaptobenzthiazole, or 1,5-dimethyl-1,2,4-triazolium-3-thiolate group), or a nitrogen-containing heterocyclic group having, as the partial structure of the heterocyclic ring, an —NH— group that can form imino silver (>NAg) (e.g., a benztriazole, benzimidazole, or indazole group). The adsorptive group is more preferably a 5-mercaptotetrazole, 3-mercapto-1,2,4-triazole, or benztriazole group, and most preferably a 3-mercapto-1,2,4-triazole or 5-mercaptotetrazole group.

The adsorptive group particularly preferably has two or more mercapto groups as the partial structure within the molecule. The mercapto group (—SH) may become a thion group in the case where the compound including the mercapto group can tautomerize. Typical examples of the adsorptive group having two or more mercapto groups as the partial structure (such as dimercapto-substituted, nitrogen-containing heterocyclic group) include a 2,4-dimercaptopyrimidine group, a 2,4-dimercaptotriazine group, and a 3,5-dimercapto-1,2,4-triazole group.

The quaternary salt structure of nitrogen or phosphor can also be advantageously employed as the adsorptive group. Specific examples of the quaternary salt structure of nitrogen include ammonio groups (such as trialkylammonio groups, dialkylaryl (or heteroaryl) ammonio groups, and alkyldiaryl (or heteroaryl) ammonio groups), and groups including a nitrogen-containing heterocyclic group with a quaternary nitrogen atom. Examples of the quaternary salt structure of phosphor include phosphonio groups (such as trialkylphosphonio groups, dialkylaryl (or heteroaryl) phosphonio groups, alkyldiaryl (or heteroaryl) phosphonio group, and triaryl (or heteroaryl) phosphonio groups). The quaternary salt structure of nitrogen is more preferable, and a five- or six-membered, nitrogen-containing aromatic heterocyclic group including a quaternary nitrogen atom is still more preferable. A pyridinio group, a quinolinio group or an isoquinolinio group is particularly preferable. Such a nitrogen-containing aromatic heterocyclic group including a quaternary nitrogen atom may have any substituent.

Examples of the counter anion of the quaternary salt include a halogen ion, a carboxylate ion, a sulfonate ion, a sulfate ion, a perchlorate ion, a carbonate ion, a nitrate ion, a $BF_4^-$ ion, a $PF_6^-$ ion and a $Ph_4B^-$ ion. In the case where a group having a negative charge such as a carboxylate group is present in the molecule, the counter anion and such a group can form an intramolecular salt. The counter anion not present within the molecule is particularly preferably a chloride ion, a bromide ion or a methanesulfonate ion.

Preferable structures of type-1 and type-2 compounds having the quaternary salt structure of nitrogen or phosphorus as an adsorptive group are represented by Formula (X).

$(P\text{-}Q_1\text{-})_i\text{-}R(\text{-}Q_2\text{-}S)_j$ Formula (X)

In Formula (X), P and R independently represent the quaternary salt structure of nitrogen or phosphorus which quaternary salt structure is not the partial structure of a sensitizing dye. $Q_1$ and $Q_2$ independently represent a connecting group, and specifically is a single bond, an alkylene group, an arylene group, a heterocyclic group, —O—, —S—, —$NR_N$—, —C(═O)—, —$SO_2$—, —SO—, or —P(═O)—, or a group having a combination of two or more of these groups. $R_N$ represents a hydrogen atom, or an alkyl, aryl, or heterocyclic group. S is a residue obtained by removing an atom from type-1 or type-2 compound. i and j independently represent an integer of 1 or more, and are selected so that the sum of them is 2 to 6. Preferably, i is 1 to 3 and j is 1 or 2. More preferably, i is 1 or 2 and j is 1. Still more preferably, i is 1 and j is 1. The compound represented by Formula (X) preferably has 10 to 100 carbon atoms, more preferably 10 to 70 carbon atoms, still more preferably 11 to 60 carbon atoms, and most preferably 12 to 50 carbon atoms in total.

Type-1 or type-2 compound in the invention may be used in any step of a process for preparing the photosensitive silver halide emulsion and that for producing the photothermographic material. The compound may be used, for example, during preparation of photosensitive silver halide grains, a desalting step, or chemical sensitization, or before coating. The compound may be added to a system plural times in these processes. The compound is added preferably during the period starting at the end of formation of photosensitive silver halide grains and ending before a desalting step, during chemical sensitization (period starting immediately before initiation of chemical sensitization and ending immediately after termination of the chemical sensitization), or before coating, and more preferably during the period starting at initiation of chemical sensitization and ending before mixing the photosensitive silver halide grains with a non-photosensitive organic silver salt.

Type-1 or type-2 compound in the invention is preferably dissolved in water, a water-soluble solvent such as methanol or ethanol, or a mixture of these solvents in adding the compound to a system. When the compound can be dissolved in water and can be more soluble in an aqueous medium having an increased or decreased pH value, such an aqueous medium may be prepared from water and the compound may be dissolved in the medium.

Type-1 or type-2 compound in the invention is preferably contained in the image-forming layer containing a photosensitive silver halide and a non-photosensitive organic silver salt, but may be contained in a coating liquid for at least one of a protective layer and an intermediate layer as well as a coating liquid for image-forming layer containing a photosensitive silver halide and a non-photosensitive organic silver salt and be diffused during coating. The compound may be added to a system regardless of a sensitization dye having been added or not. The amount of the compound in the silver halide emulsion layer (image-forming layer) is preferably $1\times10^{-9}$ moles to $5\times10^{-1}$ moles, and more preferably $1\times10^{-8}$ moles to $5\times10^{-2}$ moles with respect to 1 mole of silver halide.

10) Adsorptive Redox Compound Having an Adsorptive Group and a Reductive Group

The photothermographic material of the invention preferably contains an adsorptive redox compound having an adsorptive group to silver halide and a reductive group in the molecule. The adsorptive redox compound is preferably a compound represented by the following Formula (1):

A-(W)n-B Formula (I)

In Formula (I), A represents a group that is adsorptive to silver halide (hereinafter, referred to as an adsorptive group); W represents a bivalent connecting group; n is an integer of 0 or 1; and B represents a reductive group.

In Formula (I), the adsorptive group represented by A is a group which adsorbs directly to silver halide or a group which promotes adsorption of the compound of Formula (I) to silver halide. Typical examples thereof include a mercapto group (or a salt thereof), a thione group (—C(═S)—), a heterocyclic group containing at least one atom selected from a nitrogen atom, a sulfur atom, a selenium atom and a tellurium atom, a sulfide group, a disulfide group, a cationic group, and an ethynyl group.

The mercapto group (or a salt thereof) serving as the adsorptive group can be a mercapto group (or a salt thereof), or a heterocyclic, aryl, or alkyl group substituted with at least one mercapto group (or a salt thereof), and is more preferably such a heterocyclic, aryl, or alkyl group. The heterocyclic group is a five- to seven-membered, monocyclic or condensed, aromatic or non-aromatic heterocyclic group. Typical examples thereof include imidazole, thiazole, oxazole, benzimidazole, benzthiazole, benzoxazole, triazole, thiadiazole, oxadiazole, tetrazole, purine, pyridine, quinoline, isoquinoline, pyrimidine, and triazine ring groups. The heterocyclic group may contain a quaternary nitrogen atom, and in such a case, the mercapto group serving as the substituent may dissociate to become a meso ion. When the mercapto group forms a salt, the counter ion can be a cation of an alkali, alkaline earth, or heavy metal ion (e.g., $Li^+$, $Na^+$, $K^+$, $Mg^{2+}$, $Ag^+$, or $Zn^{2+}$), an ammonium ion, a heterocyclic group containing a quaternary nitrogen atom, or a phosphonium ion.

The mercapto group serving as the adsorptive group may tautomerize to become a thione group.

Examples of the thione group serving as the adsorptive group include chain-like or cyclic thioamido, thioureido, thiourethane, and dithiocarbamate groups.

The heterocyclic group containing at least one atom selected from nitrogen, sulfur, selenium and tellurium atoms and serving as the adsorptive group is a nitrogen-containing heterocyclic group having, as the partial structure of the heterocyclic ring, an —NH— group that can form imino silver (>NAg), or a heterocyclic group-having, as the partial structure of the heterocyclic ring, an —S—, —Se—, —Te—, or ═N— group that can bind to a silver ion via a coordinate bond. Examples of the former group include benztriazole, triazole, indazole, pyrazole, tetrazole, benzimidazole, imidazole, and purine groups, whereas examples of the latter group include thiophene, thiazole, oxazole, benzthiophene, benzthiazole, benzoxazole, thiadiazole, oxadiazole, triazine, selenoazole, benzoselenoazole, tellurazole, and benzotellurazole groups.

Examples of the sulfide and disulfide groups serving as the adsorptive group include all the groups having a partial structure of —S— or —S—S—.

The cationic group serving as the adsorptive group means a group containing a quaternary nitrogen atom, and specifically, is an ammonio group or a group having a nitrogen-containing heterocyclic group with a quaternary nitrogen atom. Examples of the nitrogen-containing heterocyclic group with a quaternary nitrogen atom include pyridinio, quinolinio, isoquinolinio, and imidazolio groups.

The ethynyl group serving as the adsorptive group means a —C≡CH group, and the hydrogen atom may be substituted.

The adsorptive group may have one or more substituents.

Other examples of the adsorptive group include those described on pp. 4 to 7 of JP-A No. 11-95355.

The adsorptive group represented by A in formula (I) is preferably a mercapto-substituted, heterocyclic group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazolium-3-thiolate group, a 2,4-dimercaptopyrimidine group, a 2,4-dimercaptotriazine group, a 3,5-dimercapto-1,2,4-triazole group, or a 2,5-dimercapto-1,3-thiazole group), or a nitrogen-containing heterocyclic group having, as the partial structure of the heterocyclic group, an —NH— group which can form imino silver (>NAg) (e.g., a benzotriazole group, a benzimidazole group, or an indazole group), and more preferably a 2-mercaptobenzimidazole group or a 3,5-dimercapto-1,2,4-triazole group.

In Formula (I), W represents a bivalent connecting group. The bivalent connecting group can be any group which does not adversely affect photographic properties. Examples thereof include bivalent connecting groups including a carbon, hydrogen, oxygen, nitrogen, or sulfur atom, or a combination of two or more of these. Specific examples thereof include alkylene groups having 1 to 20 carbon atoms (e.g., methylene, ethylene, trimethylene, tetramethylene, and hexamethylene groups), alkenylene group having 2 to 20 carbon atoms, alkynylene group having 2 to 20 carbon atoms, arylene group having 6 to 20 carbon atoms (e.g., phenylene and naphthylene groups), —CO—, —$SO_2$—, —O—, —S—, —$NR_1$—, and combinations of two or more of these connecting groups. $R_1$ represents a hydrogen atom, or an alkyl, heterocyclic, or aryl group.

The connecting group represented by W may be substituted with any substituent(s).

In Formula (1), the reductive group represented by B represents a group that can reduce silver ions, and examples thereof include a formyl group, an amino group, a triple bond-containing group such as an acetylene or propargyl group, a mercapto group, and a residue obtained by removing a hydrogen atom from any one of hydroxylamines, hydroxamic acids, hydroxyureas, hydroxyurethanes, hydroxysemicarbazides, reductones (including reductone derivatives), anilines, phenols (including chroman-6-ols, 2,3-dihydrobenzofuran-5-ols, aminophenols, sulfonamidophenols, and polyphenols such as hydroquinones, catechols, resorcinols, benzenetriols, and bisphenols), acylhydrazines, carbamoylhydrazines, and 3-pyrazolidones. These groups may also be substituted with any substituent group(s).

The oxidation potential of the reductive group represented by B in Formula (I) can be measured by a measuring method described in "Denkikagaku Sokuteihou", written by Akira Fujishima, pages 150 to 208, and published by Gihoudo Shuppan or The Chemical Society of Japan, "Zikken Kagakukouza", 4th ed., vol. 9, pages 282 to 344, and published by Maruzen. For example, a method of rotating disc voltammetry can be used. In the method, a sample is dissolved in a solution including methanol having a pH value of 6.5 and a Britton-Robinson buffer at a volume ratio of 10%:90% and nitrogen gas is introduced into the resultant solution for 10 minutes. Thereafter, a voltamograph can be obtained at a rotational speed of 1000 rpm, a sweep rate of 20 mV/second and 25° C. by using a rotating disc electrode (RDE) made of glassy carbon and serving as a working electrode, a platinum electrode serving as a counter electrode and a saturated calomel electrode serving as a reference electrode. The half-wave potential (E1/2) can be calculated from the voltamograph.

The reductive group represented by B in the invention preferably has an oxidation potential, measured by the method described above, in the range of about −0.3 V to about 1.0 V, more preferably about −0.1 V to about 0.8 V, and still more preferably about 0 V to about 0.7 V.

In Formula (I), the reductive group represented by B is preferably a residue obtained by removing one hydrogen atom from one of hydroxylamines, hydroxamic acids, hydroxyureas, hydroxysemicarbazides, reductones, phenols, acylhydrazines, carbamoylhydrazides, and 3-pyrazolidones.

The compound represented by Formula (I) of the invention may contain a ballast group or a polymer chain commonly included in immobile photographic additives such as couplers. Examples of the polymer include those described in JP-A No. 1-100530.

The compound represented by Formula (I) in the invention may be a bis- or tris-compound. The molecular weight of the compound represented by Formula (I) in the invention is preferably in the range of 100 to 10,000, more preferably 120 to 1,000, and still more preferably 150 to 500.

Examples of the compound represented by Formula (I) in the invention will be shown below, but the invention is not restricted by these examples.

(1)

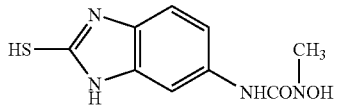

(2)

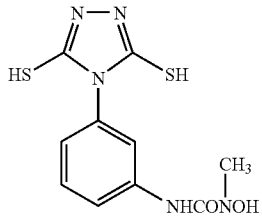

(3)

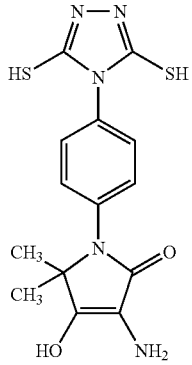

(4)

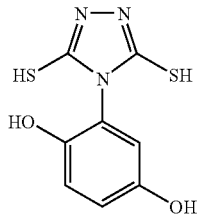

(5)

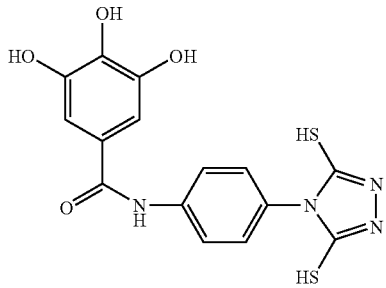

-continued (6)

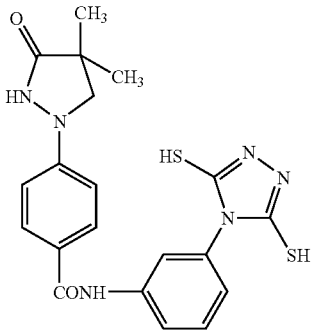

(7)

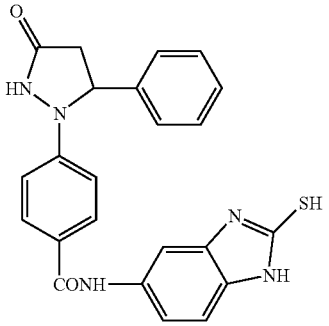

(8)

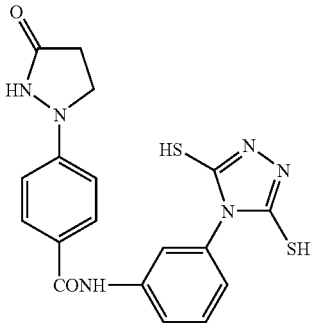

(9)

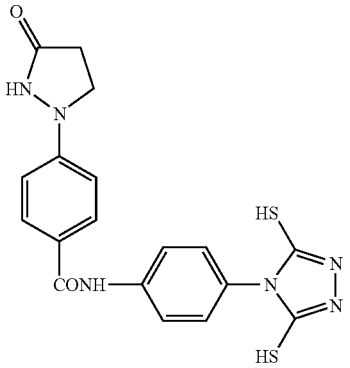

-continued (10)

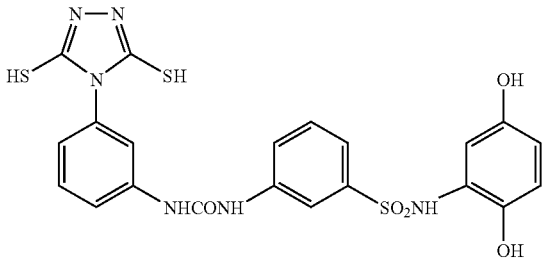

(11)

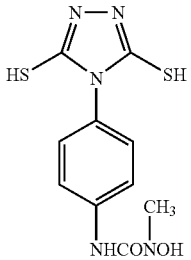

(12)

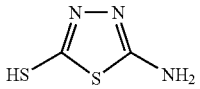

(13)

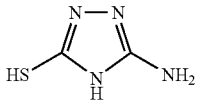

Further, the compound having an adsorptive group and a reductive group in the invention is also preferably any of exemplified compounds 1 to 30 and 1"-1 to 1"-77 shown in EP No. 1308776A2, pages 73 to 87.

These compounds can be easily synthesized by known methods. One compound of Formula (I) in the invention can be used alone, but it is preferred to use two or more kinds of such compounds together. When two or more kinds of the compounds are used together, these may be included in the same layer or different layers. Moreover, adding methods thereof may be different from each other.

The compound represented by Formula (I) in the invention is preferably included in the silver halide image-forming layer. To attain this, the compound is preferably added to a silver halide emulsion which is being prepared. If added during emulsion preparation, the compound may be added any time in the process, for example, in a step of forming silver halide grains, before initiation of a desalting step, during the desalting step, before initiation of chemical aging, during the chemical aging, or during a step before preparing a final emulsion. Moreover, it may be added multiple times in these steps. As described above, the compound is preferably contained in the image-forming layer, but may be included in a coating liquid for at least one of a protective layer and an intermediate layer which are adjacent to the image-forming layer as well as in a coating liquid for image-forming layer, and may be diffused during coating.

The addition amount of the compound greatly depends on the addition method and the type of the compound added, but is generally $1\times10^{-6}$ mole to 1 mole, preferably $1\times10^{-5}$ mole to $5\times10^{-1}$ mole, and more preferably $1\times10^{-4}$ mole to $1\times10^{-1}$ mole with respect to 1 mole of photosensitive silver halide.

The compound represented by Formula (I) in the invention may be dissolved in water, a water-soluble solvent such as methanol or ethanol, or a mixture of these solvents in adding it to the coating liquid. At this time, the pH of the solution may be adjusted properly with an acid or base, and/or a surfactant may be added to the solution. Alternatively, the compound may be added as an emulsified dispersion obtained by emulsifying and dispersing the compound in a high-boiling point organic solvent. Yet alternatively, it may be added as a solid dispersion.

11) Combined Use of Multiple Types of Silver Halides

The photosensitive material for use in the invention may include one photosensitive silver halide emulsion or two or more photosensitive silver halide emulsions (e.g., those having different average particle sizes, halogen compositions, and/or crystal habits, or those which are chemically sensitized under different conditions). Combined use of multiple photosensitive silver halides having different sensitivities allows adjustment of color tone. Descriptions concerning the combined use are found in JP-A Nos. 57-119341, 53-106125, 47-3929, 48-55730, 46-5187, 50-73627, and 57-150841. The difference in sensitivity between the respective emulsions is preferably 0.2 log E or more.

12) Coating Amount

The amount of the photosensitive silver halide(s) added is such that the amount of coated silver per $m^2$ of a photosensitive material is preferably 0.03 $g/m^2$ to 0.6 $g/m^2$, more preferably 0.05 $g/m^2$ to 0.4 $g/m^2$, most preferably 0.07 $g/m^2$ to 0.3 $g/m^2$. Moreover, the amount of photosensitive silver halide is preferably 0.01 mole to 0.5 mole, more preferably 0.02 mole to 0.3 mole, and still more preferably 0.03 mole to 0.2 mole with respect to 1 mole of organic silver salt.

13) Mixing of Photosensitive Silver Halide and Organic Silver Salt

The photosensitive silver halide and the organic silver salt separately prepared may be mixed with, for example, a high speed stirrer, a ball mill, a sand mill, a colloid mill, a vibrating mill, or a homogenizer. Alternatively, the photosensitive silver halide already prepared may be added to a system in which an organic silver salt is being prepared any time in the process for preparing the organic silver salt. However, a mixing method of these and conditions thereof are not particularly limited, as long as the effects of the invention can be sufficiently obtained. For control of photographic properties, it is preferable to mix two or more aqueous organic silver salt dispersions and two or more aqueous photosensitive silver salt dispersions.

14) Mixing Silver Halide with Coating Liquid

In the invention, the silver halide is preferably added to a coating liquid for image-forming layer for a period starting at 180 minutes before coating and ending immediately before the coating, and preferably for a period starting at 60 minutes before the coating and ending at 10 seconds before the coating. However, there is no restriction on a mixing method-and mixing conditions other than addition timing, as long as the effects of the invention can be sufficiently obtained. Specific examples of the mixing method include a method of mixing these in a tank so that the average residence time calculated from the flow rate of liquid added and the rate of liquid supplied to a coater is controlled to a desired value, and a method using a static mixer which is described in the eighth chapter of "Ekitai Kongo Gijutu" written by N. Harnby, M. F. Edwards and A. W. Nienow, translated by Koji Takahashi, and published by Nikkan Kogyo Shinbunsha in 1989.

Explanations for Anti-foggant

Exanples of an antifoggant, a stabilizer, and a stabilizer precursor usable in the invention include compounds disclosed in JP-A No. 10-62899, Paragraph No. 0070 and EP No. 0803764A1, page 20, line 57 to page 21, line 7, JP-A Nos. 9-281637 and 9-329864, U.S. Pat. No. 6,083,681 and EP Patent No. 1048975.

1) Organic Polyhalogen Compound

Hereinafter, an organic polyhalogen compound preferably used in the invention will be described in detail. The polyhalogen compound in the invention is preferably a compound represented by the following Formula (H).

$$Q\text{-}(Y)n\text{-}C(Z_1)(Z_2)X \qquad \text{Formula (H)}$$

In Formula (H), Q represents an alkyl, aryl or heterocyclic group; Y represents a bivalent connecting group; n denotes 0 to 1; $Z_1$ and $Z_2$ each represent a halogen atom; and X represents a hydrogen atom or an electron-attractive group.

In Formula (H), Q is preferably an alkyl group having 1 to 6 carbon atoms, an aryl group having 6 to 12 carbon atoms, or a heterocyclic group containing at least one nitrogen atom (e.g., a pyridine, or quinoline group).

In Formula (H), when Q is an aryl group, Q is preferably a phenyl group substituted with an electron-attractive group having a positive Hammett substituent constant cp. The Hammett substituent constant is described in, for example, Journal of Medicinal Chemistry, 1973, Vol. 16, No. 11, 1207-1216. Examples of such an electron-attractive group include halogen atoms, alkyl groups substituted with an electron-attractive group, aryl groups substituted with an electron-attractive group, heterocyclic groups, alkyl-or arylsulfonyl groups, acyl groups, alkoxycarbonyl groups, carbamoyl groups, and sulfamoyl groups. The electron-attractive group is preferably a halogen atom, a carbamoyl group, or an arylsulfonyl group, and more preferably a carbamoyl group.

X is preferably an electron-attractive group. Typical examples of the electron-attractive group include halogen atoms, aliphatic, aryl or heterocyclic sulfonyl groups, aliphatic, aryl or heterocyclic acyl groups, aliphatic, aryl or heterocyclic oxycarbonyl groups, carbamoyl groups, and sulfamoyl groups. The electron-attractive group is preferably a halogen atom or a carbamoyl group, and more preferably a bromine atom.

Each of $Z_1$ and $Z_2$ is preferably a bromine or iodine atom, and more preferably a bromine atom.

Y is preferably —C(═O)—, —SO—, —$SO_2$—, —C(═O)N(R)—, or —$SO_2$N(R)—, more preferably —C(═O)—, —$SO_2$—, or —C(═O)N(R)—, and still more preferably —$SO_2$—, or —C(═O)N(R)—. R represents a hydrogen atom, or an aryl- or alkyl group, and is preferably a hydrogen atom or an alkyl group, and more preferably a hydrogen atom.

n denotes 0 or 1, and is preferably 1.

In Formula (H), when Q is an alkyl group, Y is preferably —C(═O)N(R)—. When Q is an aryl group or heterocyclic group, Y is preferably —$SO_2$—.

Also, the organic polyhalogen compound is preferably a compound in which at least two residues each obtained by removing a hydrogen atom from the compound represented by Formula (H) bind to each other (generally called a bis-, tris-, or tetrakis-compound).

The compound of Formula (H) preferably has, as a substituent, a dissociative group (e.g., a COOH group or a salt thereof, an $SO_3H$ group or a salt thereof, or a $PO_3H$ group or a salt thereof), a quaternary ammonium cation-containing group (e.g., an ammonium group, or a pyridinium group), a polyethyleneoxy group, or a hydroxyl group.

Specific examples of the compound of Formula (H) are shown below.

H-1

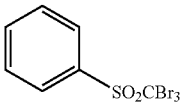

H-2

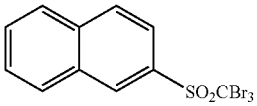

H-3

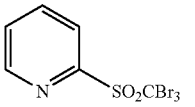

H-4

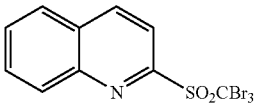

H-5

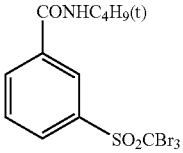

H-6

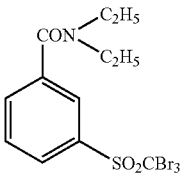

H-7

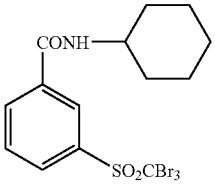

H-8

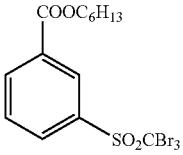

-continued

H-9

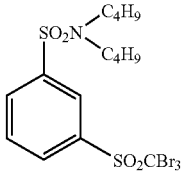

H-10

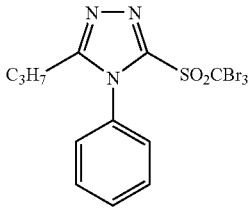

H-11

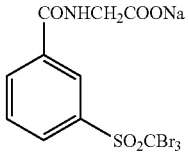

H-12

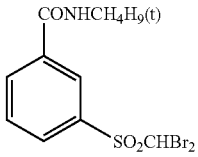

H-13

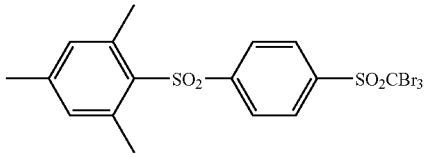

H-14

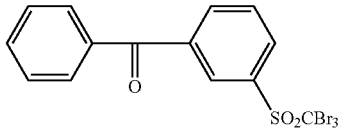

H-15

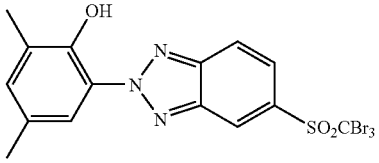

H-16

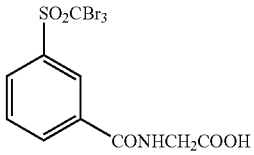

H-17

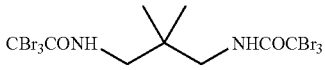

H-18

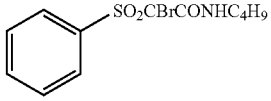

-continued

H-19

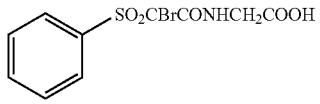

Other than those described above, the organic polyhalogen compound in the invention is preferably at least one of compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Among these, the organic polyhalogen compound is more preferably at least one of compounds disclosed in JP-A Nos. 7-2781, 2001-33911 and 20001-312027.

The amount of the compound represented by Formula (H) in the invention is preferably $10^{-4}$ to 1 mole, more preferably $10^{-3}$ to 0.5 mole, and still more preferably $10^{-2}$ to 0.2 mole with respect to 1 mole of the non-photosensitive silver salt in the image-forming layer.

In the invention, the anti-foggant may be incorporated into the photosensitive material in the same manner as the reducer, and the organic polyhalogen compound is preferably added to a coating liquid as a solid fine particle dispersion.

2) Other Anti-foggants

Other examples of the anti-foggant include mercury (II) salts described in JP-A No. 11-65021, paragraph No. 0113, benzoic acids described in JP-A No. 11-65021, paragraph 0114, salicylic acid derivatives described in JP-A No. 2000-206642, a formalin scavenger compound represented by Formula (S) in JP-A No. 2000-221634, a triazine compound described in claim 9 of JP-A No. 11-352624, a compound represented by Formula (III) in JP-A No. 6-11791, and 4-hydroxy-6-methyl-1,3,3a,7-tetrazaindene.

The photothermographic material of the invention may contain an azolium salt to prevent fogging. Examples of the azolium salt include a compound represented by Formula (XI) described in JP-A No. 59-193447; compounds described in JP-B No. 55-12581; and a compound represented by Formula (II) described in JP-A No. 60-153039. The azolium salt may be contained in any of the layer(s) of the photosensitive material, but is preferably contained in at least one of a layer or layers disposed on the surface of a support on which surface the image-forming layer is provided, and more preferably in the image-forming layer. The azolium salt may be added to a coating liquid any time during preparation of the coating liquid. When incorporated into the image-forming layer, the azolium salt can be added to a coating liquid any time during the process of preparing the organic silver salt and that of preparing the coating liquid, and is preferably added during a period starting after the end of the preparation of the organic silver salt and ending immediately before coating. The azolium salt may be added in any form of powder, a solution, or a fine particle dispersion. The azolium salt may be added in the form of a solution that contains any other additive such as a sensitizing dye, a reducer, or a color tone adjusting agent, as well as the azolium salt. In the invention, the amount of the azolium salt added is not particularly limited, but is preferably $1\times10^{-6}$ to 2 moles, and more preferably $1\times10^{-3}$ to 0.5 mole per mole of silver.

1) Mercapto, Disulfide and Thion

In order to suppress or accelerate development, improve spectral sensitization efficiency, and improve storability before and after the development, the photothermographic material of the invention may include a mercapto compound, a disulfide compound and/or a thion compound such as those described in JP-A No. 10-62899, paragraph Nos. 0067–0069, that represented by Formula (I) and specific examples described in paragraph Nos. 0033–0052 of JP-A No. 10-186572, and those described in EP No. 0803764A1, page 20, lines 36–56. Among these, the photothermographic material preferably contains at least one of mercapto-substituted heteroaromatic compounds described in, for example, JP-A Nos. 9-297367, 9-304875, 2001-100358, 2002-303954 and 2002-303951.

2) Color Tone Adjusting Agent

The photothermographic material of the invention preferably contains a color tone adjusting agent, and typical examples thereof include those described in JP-A No. 10-62899, paragraph Nos. 0054 and 0055, EP No. 0803764A1, page 21, lines 23 to 48, and JP-A Nos. 2000-356317 and 2000-187298. The color tone adjusting agent is preferably at least one of phthalazinones (i.e., phthalazinone, phthalazinone derivatives and metal salts thereof such as 4-(1-naphthyl)phthalazinone, 6-chlorophthalazinone, 5,7-dimethoxyphthalazinone and 2,3-dihydro-1,4-phthalazinedione), combinations of phthalazinones and phthalic acids (e.g., phthalic acid, 4-methylphthalic acid, 4-nitrophthalic acid, diammonium phthalate, sodium phthalate, potassium phthalate and tetrachlorophthalic anhydride), phthalazines (i.e., phthalazine, phthalazine derivatives and metal salts thereof such as 4-(1-naphthyl)phthalazine, 6-isopropylphthalazine, 6-t-butylphtahlazine, 6-chlorophthalazine, 5,7-dimethoxyphthalazine and 2,3-dihydrophthalazine), and combinations of phthalazines and phthalic acids. The color tone adjusting agent is preferably a combination of at least one of phthalazines and at least one of phthalic acids. Among these, the color tone adjusting agent is more preferably a combination of 6-isopropylphthalazine and phthalic acid or 4-methylphthalic acid.

3) Plasticizer, and Lubricant

In the invention, the image-forming layer may contain a plasticizer, and/or a lubricant to improve the physical properties of films. In particular, it is preferred to use a lubricant such as liquid paraffin, a long-chain fatty acid, a fatty acid amide, or a fatty acid ester, for the purpose of improving handling property at the time of production and scratch resistance at the time of thermal development. The lubricant is preferably liquid paraffin from which low-boiling ingredients have been removed, or a fatty acid ester having a molecular weight of 1,000 or more and a branched structure.

The plasticizer and lubricant usable in the image-forming layer and the non-photosensitive layer(s) are preferably those described in JP-A No. 11-65021, paragraph No. 0117, JP-A No. 2000-5137, and Japanese Patent Application Nos. 2003-8015, 2003-8071 and 2003-132815.

4) Dye and Pigment

The image-forming layer in the invention may contain any dye or pigment (for example, C. I. Pigment Blue 60, C. I. Pigment Blue 64, or C. I. Pigment Blue 15:6) from the viewpoints of improvement in color tone, prevention of interference fringe during laser exposure and prevention of inadequate irradiation. The dyes and pigments are described in, for example, WO98/36322 and JP-A Nos. 10-268465 and 11-338098.

5) Nucleating Agent

The photothermographic material of the invention preferably contains a nucleating agent in the image-forming layer. Details on the nucleating agent, an addition method and the addition amount thereof can be found in JP-A No. 11-65021, paragraph No. 0118, JP-A No. 11-223898, paragraph Nos. 0136 to 0193, JP-A No. 2000-284399 (compounds represented by Formulae (H), (1) to (3), (A), and (B)), and JP-A No. 2000-347345 (compounds represented by Formulae (III) to (V), and specific compounds described in Formulae 21 to 24). A nucleation accelerator is described in JP-A No. 11-65021, paragraph No. 0102 and JP-A No. 11-223898, paragraph Nos. 0194 and 0195.

When formic acid or formate serving as a strong fogging agent is contained in the photothermographic material, it is preferably incorporated into any of a layer or layers disposed on the surface of a support on which surface the image-forming layer containing a photosensitive silver halide is formed in an amount of 5 mmol or less, and more preferably 1 mmol or less per mol of silver.

When the photothermographic material of the invention contains the nucleating agent, it is preferable that the material further contains an acid resulting from hydration of diphosphorus pentaoxide, or a salt thereof. Examples of such acid and salt thereof include metaphosphoric acid and salts thereof, pyrophosphoric acid and salts thereof, orthophosphoric acid and salts thereof, triphosphoric acid and salts thereof, tetraphosphoric acid and salts thereof, and hexametaphosphoric acid and salts thereof. The acid or salt is preferably orthophosphoric acid or a salt thereof, or hexametaphosphoric acid or a salt thereof. Specifically, the salt can be sodium orthophosphate, sodium dihydrogen orthophosphate, sodium hexametaphosphate, and/or ammonium hexametaphosphate.

The addition amount of the acid obtained by hydration of diphoshorus pentaoxide or the salt thereof (i.e., the coating amount thereof per $m^2$ of the photothermographic material) depends on properties such as sensitivity and fogging level, but is preferably 0.1 $mg/m^2$ to 500 $mg/m^2$, and more preferably 0.5 mg/m2 to 100 $mg/m^2$.

Preparation of Coating Liquid and Coating

The temperature at which a coating liquid for image-forming layer in the invention is prepared is preferably from 30° C. to 65° C., more preferably not less than 35° C. and less than 60° C., and still more preferably from 35° C. to 55° C. Furthermore, the coating liquid for image-forming layer immediately after addition of a polymer latex is preferably maintained at a temperature in the range of from 30° C. to 65° C.

Film Surface pH

The photothermographic material of the invention preferably has a film surface pH of 7.0 or less before thermal development, and more preferably 6.6 or less. The lower limit of the film surface pH is not particularly restricted but is generally about 3. The pH is most preferably from 4 to 6.2. In order to adjust (lower) the film surface pH, it is preferable to use an organic acid such as a phthalic acid derivative, a non-volatile acid such as sulfuric acid, or a volatile base such as ammonia. In particular, to attain a low film surface pH, ammonia is preferable, since it can easily volatilize and can be removed from the photosensitive material during the coating step or before thermal development.

It is also preferable to use a non-volatile base such as sodium hydroxide, potassium hydroxide or lithium hydroxide in combination with ammonia. A method for measuring a film surface pH is described in JP-A No. 2000-284399, paragraph No. 0123.

Antistatic Agent

The photosensitive material of the invention preferably has an electrically conductive layer containing a metal oxide or an electrically conductivity polymer. The antistatic layer may serve as an undercoat layer or a back layer surface protective layer. Alternatively, these layers can be provided separately. A metal oxide into which oxygen defects or a foreign metal atom is introduced to improve conductivity is preferably used as the conductivity material of the antistatic layer. The metal oxide is preferably ZnO, $TiO_2$, or $SnO_2$. Aluminum or indium is preferably added to ZnO. Antimony, Niobium or phosphorous or a halogen element is preferably added to $SnO_2$. Niobium or tantalum is preferably added to $TiO_2$. In particular, the metal oxide is more preferably $SnO_2$ to which antimony is added. The amount of the foreign atom added is preferably in the range of 0.01 to 30 mole % and more preferably 0.1 to 10 mole % with respect to the metal oxide. The shape of the metal oxide particles may be spherical, needle-like, or platy, but needle-like particles having a ratio of a major axis length/minor axis length of 2.0 or more, preferably 3.0 to 50, are preferable from the viewpoint of the effect of giving electrical conductivity. The amount of the metal oxide used is preferably in the range of 1 to 1,000 $mg/m^2$, more preferably 10 to 500 $mg/m^2$, and still more preferably 20 to 200 $mg/m^2$. The antistatic layer can be provided on one side of the support on which one side an image-forming layer is provided and on the other side of the support on which a back layer is provided, but is preferably provided between the support and the back layer. Examples of the antistatic layer in the invention are described in JP-A No. 11-65021, paragraph No. 0135, JP-A Nos. 56-143430, 56-143431, 58-62646, and 56-120519, JP-A No. 11-84563, paragraph Nos. 0040 to 0051, U.S. Pat. No. 5,575,957, and JP-A No. 11-223898, paragraph Nos. 0078 to 0084.

Support

The photothermographic material of the invention preferably has a transparent support. The transparent support is preferably a polyester film, particularly a polyethylene terephthalate film, which has been subjected to heat treatment at a temperature in the range of 130° C. to 185° C. to relax internal stress accumulated during biaxial stretching and remaining in the film and to prevent thermal development from causing heat shrinkage deformation. If the photothermographic material is used for medical application, the transparent support may be colored with a blue dye (e.g., dye-I described in Examples of JP-A No. 8-240877) or may be colorless. An undercoat layer made of, for example, a water-soluble polyester described in JP-A No. 11-84574, a styrene-butadiene copolymer described in JP-A No. 10-186565, a vinylidene chloride copolymer described in JP-A No. 2000-39684 or Japanese Patent Application No. 11-106881, paragraph Nos. 0063 to 0080 is preferably provided on the support. The moisture content of the support is preferably 0.5 wt % or less when an image-forming layer or a back layer is coated thereon.

Other Additives

The photothermographic material may contain an antioxidant, a stabilizer, a plasticizer, a UV absorbent, and/or a coating aid. Each of these additives is contained in either of the image-forming layer or the non-photosensitive layer. Reference can be made to WO No. 98/36322, EP No. 803764A1, JP-A Nos. 10-186567 and 10-18568.

14) Other Usable Techniques

Other techniques usable for the photothermographic material of the invention include those described in EP Nos. 803764A1 and 883022A1; WO No. 98/36322; and JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, 2001-348546, and 2000-187298.

Image-forming Method

1) Exposure

A light source in the invention can be a He—Ne laser emitting light having a wavelength in the range from the red region to the infrared region, a red light-emitting semiconductor laser, an $Ar^+$, He—Ne, or He—Cd laser emitting light having a wavelength in the range from the blue region to the green region, or a blue light-emitting semiconductor laser. The light source is preferably a semiconductor laser emitting light having a wavelength in the range from the red region to the infrared region, and the peak wavelength of the laser light is preferably in the range of 600 to 900 nm and more preferably 620 to 750 nm.

A module in which an SHG (Second Harmonic Generator) element and a semiconductor laser are integrated and a blue light-emitting semiconductor laser have been recently developed, and a laser output device emitting light in the shorter wavelength range has been spotlighted. The blue light-emitting semiconductor laser, which enables high-definition image recording and an increased recording density, and has a long life and provides stable output, is expected to be more demanded in the future. The peak wavelength of the light of the blue light-emitting laser is preferably 300 to 500 nm, and more preferably 400 to 500 nm.

Laser light oscillated in a longitudinal multi mode by, for example, a high frequency-superposing method can also be employed advantageously in the invention.

2) Thermal Development

The photothernographic materialof the invention may be developed by any method, but is usually developed by heating the photothermographic material after imagewise exposure. The developing temperature is generally 80 to 250° C., preferably 100° C. to 140° C., and more preferably 110° C. to 130° C. The developing time is preferably 1 to 15 seconds, more preferably 1 to 10 seconds, still more preferably 2 to 8 second. Use of the photothermographic material of the invention enables rapid thermal development.

The thermal development may be performed by a drum heater or a plate heater, but is preferably performed by a plate heater. The thermal development using a plate heater is preferably performed by a method described in JP-A No. 11-133572, which discloses a thermal development device having, in a thermal development zone, a plate heater and press rollers disposed along one surface of the plate heater. In the device, a photothermographic material on which a latent image is formed is made to pass through a nip formed between the press rollers and the plate heater to bring the material into contact with the plate heater, forming a visible image. The plate heater is preferably divided into 2 to 6 zones, and the temperature of the top zone is preferably lowered than that of the other zones by approximately 1 ° C. to approximately 10° C. For example, a plate heater having four zones whose temperatures can be independently controlled is used, and the temperatures of the zones are controlled respectively to 112° C., 119° C., 121° C., and 120° C. Such a heating method is described in JP-A No. 54-30032, and allows removal of the water or organic solvent contained in the photothermographic material and ejection of the water or organic solvent from a system, and prevents deformation of the support of the photothermographic material caused by rapid heating.

More accurate heater control is preferable for miniaturization of the thermal development device and shortening of the heat developing time. When exposure of a sheet-type photosensitive material starts at the head portion of the material, it is preferable to start thermal development of the head portion before exposure of the foot portion of the material is finished. A high-speed imager preferably used in the invention is described in, for example, JP-A Nos. 2002-289804 and 2002-285455. In such an imager, thermal development is conducted in 14 seconds on a plate heater having three zones respectively controlled at, for example, 107° C., 121° C., and 121° C., and the output period needed to process one sheet is shortened to about 60 seconds. For such a high-speed development, it is preferable to use photothermographic material-2 of the invention that is highly sensitive and is insensitive to environment temperature in combination with the above-described device.

3) System

Examples of a medical laser imager equipped with a light exposing zone and a thermal developing zone include FUJI MEDICAL DRY LASER IMAGER FM-DP L and DRYPIX 7000. FM-DP L is described in Fuji Medical Review No. 8, pages 39 to 55. These techniques may be applied to the laser imager for the photothermographic material of the invention. In addition, the photothermographic material of the invention can be used as a photothermographic material for the laser imager included in "AD network" which was proposed by Fuji Film Medical Co., Ltd. as a network system accommodated to DICOM standard.

APPLICATIONS OF THE INVENTION

The photothermographic material of the invention, which provides a monochromic image which is a silver image, may be used preferably as photothermographic materials for medical diagnosis, industrial photography, printing, and COM.

EXAMPLES

The invention will be described specifically by way of Examples. However, the invention is not limited to these examples.

First, measurement results regarding the maximum absorption peak wavelength and the half breadth in the absorption spectrum of each of the dyes used in the invention were shown together with those of comparative dyes.

1. Preparation of Sample

1) Preparation of Coating Liquid 180 g of a styrene-butadiene copolymer latex (solid content of 40 mass %, and styrene/butadiene mass ratio of 68/32), 60 g of an aqueous 10 mass % dye (shown in Table 2) solution, 40 g of a 10 mass % dipentaerythrityl hexaisostearate emulsion, 5.5 ml of a 1 mass % fluorinated surfactant (F-1) solution, 5.5 ml of an aqueous 1 mass % fluorinated surfactant (F-2) solution, 28 ml of an aqueous 5 mass % sodium di(2-ethylhexyl) sulfoscuccinate solution, 4 g of polymethyl methacrylate fine particles (average diameter of 0.7 μm, and volume-weighted average distribution of 30%), and 21 g of polymethyl methacrylate fine particles (average diameter of 3.6 μm, and volume-weighted average distribution of 60%) were added to a solution in which 30 g of gelatin and 3 mg of benzisothiazolinone were dissolved in 850 ml of water.

2) Coating

The coating liquid was coated in an amount of 8.3 ml/m$^2$ on an undercoated PET support having a thickness of 175 μm.

2. Measurement of Absorption Spectrum

The transmission spectral absorption spectrum of the coated sample in the range of 400 nm to 900 nm was measured with a spectrometer (U-3500 manufactured by Hitachi Ltd.). The maximum absorption wavelength and the half breadth at that wavelength were determined, and summarized in Table 2.

TABLE 2

| Sample No. | Dye | Maximum absorption wavelength (nm) | Half breadth (nm) |
|---|---|---|---|
| 1 | Comparative pigment 1 | 620 | 155 |
| 2 | Comparative pigment 1 | 611 | 108 |
| 3 | Dye 1 | 665 | 50 |
| 4 | Dye 2 | 663 | 48 |
| 5 | Dye 11 | 663 | 48 |
| 6 | Dye 28 | 660 | 57 |
| 7 | Dye 92 | 670 | 62 |
| 8 | Dye 116 | 645 | 55 |
| 9 | Dye 137 | 665 | 58 |
| 10 | Dispersion 101 described in U.S. Pat. No. 6,830,879 | 660 | 25 |
| 11 | Dispersion 102 described in U.S. Pat. No. 6,830,879 | 628 | 20 |
| 12 | Dispersion 103 described in JP-A No. 2003-84395 | 660 | 36 |
| 13 | Dispersion 106 described in JP-A No. 2003-84395 | 662 | 21 |
| 14 | Dispersion 107 described in JP-A No. 2003-84395 | 652 | 40 |
| 15 | Dispersion 109 described in JP-A No. 2003-84395 | 648 | 29 |

The entire content of U.S. Pat. No. 6,830,879 is incorporated by reference herein. Preparation of dye dispersions 103, 106, 107, and 109 described in JP-A No. 2003-84395

One gram of the following polymethine dye (21) and 200 mL of an aqueous titanium oxide dispersion (solid matter concentration of 5%, and average particle diameter of 30 nm), 0.1 g of gelatin (containing 30 ppm of Ca ions) and 2041 mL of distilled water were mixed well with a high speed stirrer (MULTIDISPERSER PB95 having a round blade-type structure, and manufactured by MST Co., Ltd.) to prepare aqueous dye (21) slurry.

Then, 2,250 g of an aqueous 10% gelatin solution was added to the aqueous dye (21) slurry which was being stirred, and the mixture was stirred at 40° C. for 30 minutes. The mixture was filtered through a polypropylene filter having an effective pore size of 3 μm to obtain a dye dispersion 103. The dispersion was stored in a cool and dark place at 10° C. or less, forming a jelly solid, which was used in the above table. Dye dispersions 106, 107, and 109 were obtained in the same manner as the dye dispersion 103, except that the dye (21) was replaced respectively with the following dyes (51), (61), and (81) in the same amount (21)

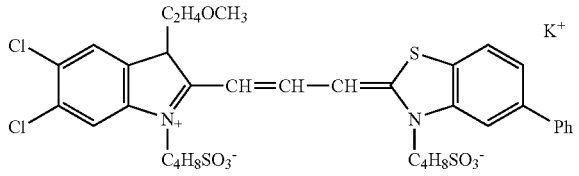

(51)

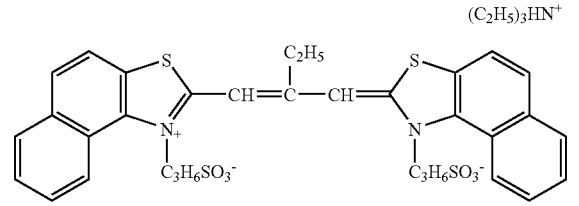

(61)

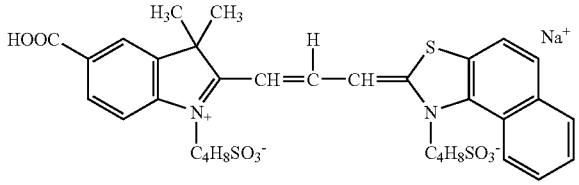

(81)

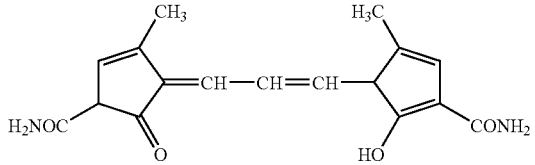

Example 1

Preparation of PET Support

1) Film Formation

PET was made by polymerizing terephthalic acid and ethylene glycol in an ordinary manner and had an intrinsic viscosity IV of 0.66 (measured in a mixture of phenol and tetrachloroethane at a mass ratio of 6/4 at 25° C.). This was pelletized, and the resultant was dried at 130° C. for 4 hours, and melted at 300° C. The melted PET was extruded out from a T-die, and rapidly cooled. Thus, a non-oriented film was prepared.

The film was longitudinally oriented by rolls rotating at different circumferential speeds at 110° C. so that the longitudinal length thereof after the orientation was 3.3 times as long as the original longitudinal length thereof. Next, the film was laterally oriented by a tenter at 130 ° C. so that the lateral length thereof after the orientation was 4.5 times as long as the original lateral length thereof. Next, the oriented film was thermally fixed at 240° C. for 20 seconds, and then laterally relaxed by 4% at the same temperature. Next, the portions of the film which portions were disposed at the chuck portions of the tenter were slit, and the both edges of the film were knurled, and the film was rolled up at 4 kg/cm$^2$. The rolled film having a thickness of 175 μm was obtained.

2) Corona Processing of Surface

Both surfaces of this support were processed at a rate of 20 m/minute at room temperature by using a solid state corona processing machine (6 KVA MODEL manufactured by Pillar Company). From current and voltage data read at this time, it was found that the support had been processed at 0.375 kV.A.min/m$^2$. At this time, the processing frequency was 9.6 kHz, and the gap clearance between an electrode and a dielectric roll was 1.6 mm.

3) Undercoating

| <Preparation of coating liquids for undercoat layer> | |
|---|---|
| Coating liquid (1) (for photosensitive layer-side undercoat layer) | |
| PES RESIN A-520 manufactured by Takamatsu Oil & Fat Co. (30 mass % solution) | 46.8 g |
| VYLONAL MD-1200 manufactured by Toyobo Co., Ltd. | 10.4 g |
| Polyethylene glycol monononylphenyl ether (average number of ethylene oxide: 8.5) (1 mass % solution) | 11.0 g |
| MP-1000 manufactured by Soken Chemical & Engineering Co., Ltd. (PMMA polymer fine particles having an average particle size of 0.4 μm) | 0.91 g |
| Distilled water | 931 ml |
| Coating liquid (2) (for first back surface layer) | |
| Styrene-butadiene copolymer latex (solid content of 40 mass %, and the mass ratio of styrene/butadiene of 68/32) | 130.8 g |
| Sodium salt of 2,4-Dichloro-6-hydroxy-S-triazine (8 mass % aqueous solution) | 5.2 g |
| 1 Mass % aqueous solution of sodium laurylbenzylsulfonate | 10 ml |
| Polystyrene particle dispersion (average particle diameter of 2 μm, 20 mass %) | 0.5 g |
| Distilled water | 854 ml |
| Coating liquid (3) (for second back surface layer) | |
| $SnO_2$/SbO (mass ratio of 9/1, average particle size of 0.5 μm, 17 mass % dispersion) | 84 g |
| Gelatin | 7.9 g |
| METOLOSE TC-5 manufactured by Shin-Etsu Chemical Co., Ltd. (2 mass % aqueous solution) | 10 g |
| 1 Mass % aqueous solution of sodium dodecylbenzenesulfonate | 10 ml |
| NaOH (1 mass %) | 7 g |
| PROXEL (manufactured by Avecia) | 0.5 g |
| Distilled water | 881 ml |

After both surfaces of the biaxially oriented polyethylene terephthalate support having a thickness of 175 μm were subjected to the corona discharge treatment respectively, the coating liquid (1) for undercoat layer was coated on one side (image-forming layer side) thereof with a wire bar so that the wet coating amount was 6.6 ml/m$^2$ (per one side). The coating was dried at 180° C. for 5 minutes. The coating liquid (2) for undercoat layer was coated on the rear side (back layer side) of the support with a wire bar so that the wet coating amount was 5.7 ml/m$^2$. The coating was dried at 180° C. for 5 minutes. The coating liquid (3) for undercoat layer was coated on the coating (on the back layer side) with a wire bar so that the wet coating amount was 8.4 ml/m$^2$. The coating was dried at 180° C. for 6 minutes. Thus, an undercoated support was prepared.

Back Layer

2) Preparation of Coating Liquid for Back Layer

<Preparation of Base Precursor Solid Fine Particle Dispersion (a)>

2.5 kg of base precursor compound 1, 300 g of a surfactant (DEMOL N™ manufactured by Kao Corporation), 800 g of diphenylsulfone and 1.0 g of benzoisothiazolinone sodium salt were mixed with distilled water so that the total amount was 8.0 kg. The resultant liquid blend was stirred with a horizontal sand mill (UVM-2 manufactured by AIMEX Co., Ltd.) containing beads. In the stirring, the liquid blend was supplied to UVM-2 mill containing zirconia beads having a mean particle diameter of 0.5 mm with a diaphragm pump, and was stirred at an inner pressure of 50 hPa or higher until a desired mean particle diameter could be achieved.

In the stirring, the spectral absorption of the dispersion was measured. The stirring was continued until the ratio of the absorbance of the dispersion at 450 nm to that at 650 nm ($D_{450}/D_{650}$) became 3.0. The resulting dispersion was diluted with distilled water so that the concentration of the base precursor became 25% by mass. Thereafter, the dispersion was filtrated (with a polypropylene filter having a mean fine pore diameter of 3 μm) to eliminate dust and the resultant was put into practical use.

2) Preparation of Dye Solid Fine Particle Dispersion 6.0 kg of cyanine dye compound 1, and 3.0 kg of sodium p-dodecylbenzenesulfonate, 0.6 kg of DEMOL SNB (surfactant manufactured by Kao Corporation), and 0.15 kg of a defoaming agent (SURFYNOL 104E™ manufactured by Nissin Chemical Industry Co., Ltd.) were mixed with distilled water to give the total amount of 60 kg. The resultant mixture was stirred with a horizontal sand mill (UVM-2 manufactured by AIMEX Co., Ltd.) containing zirconia beads having a diameter of 0.5 mm.

In the stirring, the spectral absorption of the dispersion was measured. The stirring was continued until the ratio of the absorbance of the dispersion at 650 nm to that at 750 nm ($D_{650}/D_{750}$) became 5.0 or more. The resulting dispersion was diluted with distilled water so that the concentration of the cyanine dye compound 1 became 6% by mass. Thereafter, the dispersion was filtrated (with a filter having a mean fine pore diameter of 1 μm) to eliminate dust and the resultant was put into practical use.

3) Preparation of Coating Liquid for Anti-halation Layer

Thirty-seven grams of gelatin having an isoelectric point of 6.6 (ABA GELATIN manufactured by Nippi, Inc.), 0.1 g of benzisothiazolinone, and water were placed in a container kept at 40° C., and the gelatin was dissolved in the water. The resultant solution was mixed with 36 g of the above dye solid fine particle dispersion, 73 g of the base precursor solid fine particle dispersion (a), 43 ml of an aqueous 3 mass % sodium polystyrenesulfonate solution, and 82 g of a 10 mass % SBR latex (styrene/butadiene/acrylic acid copolymer, and the mass ratio of these monomers of 68.3/28.7/3.0). Thus, a coating liquid for anti-halation layer having a total amount of 773 ml was obtained. The pH of the final liquid was 6.3.

4) Preparation of Coating Liquid for Back Surface Protective Layer

Forty-three grams of gelatin having an isoelectric point of 4.8 (PZ GELATIN manufactured by Jellice Co., Ltd.), 0.21 g of benzisothiazolinone, and water were placed in a container kept at 40° C., and the gelatin was dissolved in the water. The resultant solution was mixed with 8.1 ml of an aqueous 1 mol/sodium acetate solution, 0.93 g of monodisperse poly(ethylene glycol dimethacrylate-co-methyl methacrylate) fine particles (average particle diameter of 7.7 μm, and particle diameter standard deviation of 0.3 μm), 5 g of a 10 mass % liquid paraffin emulsion, 10 g of a 10 mass % dipentaerythrit hexaisostearate emulsion, 10 ml of an aqueous 5 mass % sodium di(2-ethylhexyl) sulfoscuccinate solution, 17 ml of an aqueous 3 mass % sodium polystyrenesulfonate solution, 2.4 ml of a 2 mass % fluorinated surfactant (F-1) solution, 2.4 ml of a 2 mass % fluorinated surfactant (F-2) solution, and 30 ml of a 20 mass % ethyl acrylate/acrylic acid copolymer (copolymerization mass ratio of 96.4/3.6) latex. Immediately before coating, 50 ml of an aqueous 4 mass % N,N-ethylene bis(vinylsulfoneacetamide) solution was mixed with the resultant blend. Thus, a coating liquid for back surface protective layer having a total amount of 855 ml was prepared. The pH of the final liquid was 6.2.

5) Back Layer Coating

The coating liquid for anti-halation layer and that for back surface protective layer were simultaneously coated on the back surface of the undercoated support so that the coating amount of gelatin of the former coating liquid and that of the latter coating liquid became 0.54 g/m$^2$ and 1.85 g/m$^2$, respectively. The coatings were dried to form a back layer.

Image-forming Layer, Intermediate Layer and Surface Protective Layer

1. Preparation of Coating Materials

1) Silver Halide Emulsion

<<Preparation of Silver Halide Emulsion 1>>

3.1 mL of a 1 mass % potassium bromide solution, 3.5 mL of 0.5 mol/L sulfuric acid, 31.7 g of phthalated gelatin were added to 1421 mL of distilled water. The resulting mixture was kept at 30° C. in a stainless steel reaction pot while it was being stirred. Solution A was prepared by diluting 22.22 g of silver nitrate with distilled water such that the total volume of the resultant mixture was 95.4 mL. Soution B was prepared by diluting 15.3 g of potassium bromide and 0.8 g of potassium iodide with distilled water such that the total volume of the resultant mixture was 97.4 mL. These solutions A and B were added to the content in the reaction pot at constant flow rates over 45 seconds. Then, 10 mL of a 3.5 mass % aqueous solution of hydrogen peroxide, and 10.8 mL of a 10 mass % aqueous solution of benzimidazole were added to the system. Solution C was prepared by diluting 51.86 g of silver nitrate with distilled water such that the total volume of the resultant mixture was 317.5 mL. Moreover, Solution D was prepared by diluting 44.2 g of potassium bromide and 2.2 g of potassium iodide with distilled water such that the total volume of the resultant mixture was 400 mL. These solutions C and D were added to the system by a controlled double jet method. At this time, the whole of Solution C was added at a constant flow rate over 20 minutes. Moreover, Solution D was added while pAg was kept at 8.1. When ten minutes had lapsed since staring of addition of Solutions C and D, potassium hexachloroiridate (III) was added to the system in an amount of $1\times10^{-4}$ mol per mol of silver. Further, when five seconds had lapsed since completion of addition of Solution C, an aqueous solution of potassium hexacyanoiron (II) was added to the system in an amount of $3\times10^{-4}$ mol per mol of silver. 0.5 mol/L sulfuric acid was added to the system so as to adjust the pH of the system at 3.8. Then, stirring was stopped, and precipitating, desalting and washing steps were carried out. One mol/L sodium hydroxide was added to the system so as to adjust the pH of the system at 5.9 and then a silver halide dispersion having pAg of 8.0 was prepared.

Five ml of a 0.34 mass % 1,2-benzisothiazolin-3-one methanol solution was added to the silver halide dispersion, which was kept at 38° C. and was being stirred. Forty minutes later, the resultant mixture was heated to 47° C. After heating for 20 minutes, a methanol solution of sodium benzenethiosufonate was added to the mixture (system) in an amount of $7.6\times10^{-5}$ mole per mole of silver. Five minutes later, a methanol solution of tellurium sensitizer C was added to the system in an amount of $2.9\times10^{-4}$ mole per mole of silver, and the resultant mixture was ripened for 91 minutes. Thereafter, a methanol solution of spectral sensitizing dyes A and B at a molar ratio of 3:1 was added thereto. At this time, the total amount of the sensitizing dyes A and B was $1.2\times10^{-3}$ mole per mole of silver. One minute later, 1.3 ml of a 0.8 mass % N,N'-dihydroxy-N"-diethylmelamine methanol solution was added to the resultant blend. Four minutes later, a methanol solution of 5-methyl-2-mercapto benzimidazole in an amount of $4.8\times10^{-3}$ mole per mole of silver, a methanol solution of 1-phenyl-2-heptyl-5-mercapto-1,3,4-triazole in an amount of $5.4\times10^{-3}$ mole per mole of silver, and an aqueous solution of 1-(3-methylureidophenyl)-5-mercaptotetrazole in an amount of $8.5\times10^{-3}$ mole per mole of silver were added to the resulting admixture. Thus, a silver halide emulsion 1 was prepared.

The silver halide emulsion thus obtained contained silver iodobromide particles having an average sphere-equivalent diameter of 0.042 μm and a variation coefficient of the sphere-equivalent diameters of 20% and uniformly containing iodine at 3.5 mole %. The particle size and the like were determined by measuring the diameters of 1,000 particles under an electron microscope and averaging the measured diameters. The {100} plane proportion of these particles was determined by Kubelka Munk method and was 80%.

<<Preparation of Silver Halide Emulsion 2>>

Silver halide emulsion 2 was prepared in the same manner as the silver halide emulsion 1, except that the liquid temperature during particle formation was changed from 30° C. to 47° C., except that the solution B was replaced with a solution obtained by diluting 15.9 g of potassium bromide with distilled water to give a total volume of 97.4 ml, except that the solution D was replaced with a solution obtained by diluting 45.8 g of potassium bromide with distilled water to give a total volume of 400 ml, except that the solution C was added over 30 minutes, except that potassium hexacyanoiron (II) was not added, except that the amount of the tellurium sensitizer added was change to $1.1\times10^{-4}$ mole per mole of silver, except that the total addition amount of the methanol solution containing the spectral sensitizing dyes A and B at a molar ratio of 3:1 was change to $7.0\times10^{-4}$ mole per mole of silver, and except that the amounts of 1-phenyl-2-heptyl-5-mercapto-1,3,4-triazole and 1-(3-methylureidophenyl)-5-mercaptotetrazole were respectively changed to $3.3\times10^{-3}$ mole and $4.7\times10^{-3}$ mole per mole of silver. The emulsified particles in the silver halide emulsion 2 were pure silver bromide cubic particles having an average sphere-equivalent diameter of 0.080 μm and a variation coefficient of the sphere-equivalent diameters of 20%.

<<Preparation of Silver Halide Emulsion 3>>

Silver halide emulsion 3 was prepared in the same manner as the silver halide emulsion 1, except that the liquid temperature during particle formation was changed from 30° C. to 27° C., except that a solid dispersion (aqueous gelatin solution) containing the spectral sensitizing dyes A and B at a molar ratio of 1:1 was added in a total amount of $6\times10^{-3}$ mole per mole of silver, and except that the amount of tellurium sensitizer C added was change to $5.2\times10^{-4}$ per mole of silver, except that bromoauric acid and potassium thiocyanate were added in respective amounts of $5\times10^{-4}$ mole and $2\times10^{-3}$ mole per mole of silver when three minutes had lapsed since addition of the tellurium sensitizer. The emulsified particles in the silver halide emulsion 3 were silver iodobromide particles uniformly containing iodine at 3.5 mole % and having an average sphere-equivalent diameter of 0.034 μm and a variation coefficient of the sphere-equivalent diameters of 20%.

<<Preparation of Mixed Emulsion A for Coating Liquid>>

Seventy mass % of the silver halide emulsion-1, 15 mass % of the silver halide emulsion-2, and 15 mass % of the silver halide emulsion-3 were melted. A 1 mass % aqueous solution of benzothiazolium iodide was added to the resultant mixture in an amount of $7\times10^{-3}$ mol per mole of silver.

Then, each of compounds 1, 2, and 3 that can be one-electron-oxidized to provide a one-electron oxidant which releases one or more electrons was added to the resulting blend in an amount of $2\times10^{-3}$ mole with respect to 1 mole of silver in the silver halide.

Each of adsorptive redox compounds 1 and 2 each having adsorptive and reductive groups was added to the resultant in an amount of $5\times10^{-3}$ mole with respect to 1 mole of silver halide.

Further, water was added to the resultant mixture so that the amount of silver of silver halide contained in 1 kg of the resultant mixed emulsion for coating liquid was 38.2 g. Thereafter, 1-(3-methylureidophenyl)-5-mercaptotetrazole was added to the mixed emulsion in an amount of 0.34 g per kg of the mixed emulsion for coating liquid.

2) Preparation of Dispersion of Silver Salt of Fatty Acid

Eighty-eight kg of recrystallized behenic acid, 422 L of distilled water, 49.2 L of a 5 mol/L aqueous NaOH solution and 120 L of t-butyl alcohol were mixed and reacted at 75° C. for one hour while the resultant system was being stirred. Thus, a sodium behenate solution B was obtained. Separately, 206.2 L of an aqueous solution (pH 4.0) containing 40.4 kg of silver nitrate was prepared and kept at 10° C. A reaction vessel containing 635 L of distilled water and 30 L of t-butyl alcohol was kept at 30° C. The entire amount of the sodium behenate solution and the entire amount of the aqueous solution of silver nitrate were added to the content of the vessel at constant flow rates over 93 minutes and 15 seconds and over 90 minutes, respectively, while the content in the vessel was being sufficiently stirred. At this time, only the aqueous solution of silver nitrate was added for 11 minutes after starting the addition of the aqueous solution of silver nitrate, addition of the sodium behenate solution B was started subsequently, and only the sodium behenate solution B was added for 14 minutes and 15 seconds after completion of the addition of the aqueous solution of silver nitrate. At this time, the internal temperature of the reaction vessel was kept at 30° C. The external temperature was controlled such that the liquid temperature was constant. The pipe line for the sodium behenate solution B was a double-walled pipe and thermally insulated by circulating hot water through the interspace of the double-walled pipe, and the temperature of the solution at the outlet of the nozzle tip was adjusted at 75° C. The pipe line for the aqueous solution of silver nitrate was also a double-walled pipe and thermally insulated by circulating cold water through the interspace of the double-walled pipe. The position at which the sodium behenate solution was added to the reaction system and that at which the aqueous solution of silver nitrate was added thereto were disposed symmetrically relative to the shaft of the stirrer disposed in the reactor, and the nozzle tips of the pipes were spaced apart from the reaction solution level in the reactor.

After adding the sodium behenate solution B was finished, the reaction system was stirred for 20 minutes at that temperature, and then heated to 35° C. over 30 minutes. Thereafter, the system was ripened for 210 minutes. Immediately after completion of the ripening, the system was centrifugally filtered to collect a solid component, which was washed with water until the conductivity of the washing waste reached 30 μS/cm. The solid thus obtained was the silver salt of a fatty acid and was stored as a wet cake without drying it.

The shapes of the silver behenate particles were analyzed on the basis of their images taken through electronmicroscopic photography. The average values of a, b, and c were 0.21 μm, 0.4 μm and 0.4 μm, respectively (a, b and c are defined hereinabove). The average aspect ratio was 2.1. The variation coefficient of the sphere-equivalent diameters of the particles was 11%.

19.3 kg of polyvinyl alcohol (PVA-217™) and water were added to the wet cake whose amount corresponded to 260 kg of the dry weight thereof so that the total amount of the resultant became 1000 kg. The resultant was formed into slurry with a dissolver blade, and then pre-stirred with a pipe-line mixer (Model PM-10 available from Mizuho Industry Co.).

Next, the pre-stirred stock slurry was processed three times with a disperser (MICROFLUIDIZER M-610 obtained from Microfluidex International Corporation, and equipped with a Z-type interaction chamber) at a controlled pressure of 1150 kg/cm$^2$. A silver behenate dispersion was thus prepared. To cool it, corrugated tube-type heat exchangers were disposed before and behind the interaction chamber, respectively. The temperature of the coolant in these heat exchangers was so controlled that the system could be processed at a stirring temperature of 18° C.

3) Preparation of Reducer Dispersion

<<Preparation of Reducer-1 Dispersion>>

Ten kg of reducer-1 (2,2'-methylenebis-(4-ethyl-6-tert-butylphenol)), 16 kg of a 10 mass % aqueous solution of modified polyvinyl alcohol (POVAL MP203 available from Kuraray Co., Ltd.) and 10 kg of water were sufficiently mixed to form slurry. The slurry was fed by a diaphragm pump into a horizontal sand mill (UVM-2 available from Imex Corporation) including zirconia beads which had a mean diameter of 0.5 mm, and stirred therewith for 3 hours. Then, 0.2 g of sodium salt of benzoisothiazolinone and water were added thereto to adjust the reducer concentration of the resultant at 25% by mass. The resultant dispersion was heated at 60° C. for 5 hours. A reducer-1 dispersion was thus prepared. The reducer particles in the dispersion had a median diameter of 0.40 μm, and a maximum particles size of at most 1.4 μm. The reducer dispersion was filtered through a polypropylene filter having a pore size of 3.0 μm to remove foreign objects such as dirt from it, and then stored.

<<Preparation of Reducer-2 Dispersion>>

Ten kg of reducer-2 (6,6'-di-t-butyl-4,4'-dimethyl-2,2'-butylidenediphenol), 16 kg of a 10 mass % aqueous solution of modified polyvinyl alcohol (POVAL MP203 available from Kuraray Co., Ltd.) and 10 kg of water were sufficiently mixed to form slurry. The slurry was fed by a diaphragm pump into a horizontal sand mill (UVM-2 available from Imex Corporation) including zirconia beads which had a mean diameter of 0.5 mm, and stirred therewith for 3 hours and 30 minutes. Then, 0.2 g of sodium salt of benzoisothiazolinone and water were added thereto to adjust the reducer concentration of the resultant at 25% by mass. The resultant dispersion was then heated at 40° C. for 1 hour, and subsequently heated at 80° C. for 1 hour. A reducer-2 dispersion was thus prepared. The reducer particles in the dispersion had a median diameter of 0.50 μm, and a maximum particle size of at most 1.6 μm. The reducer dispersion was filtered through a polypropylene filter having a pore size of 3.0 μm to remove foreign objects such as dirt from it, and then stored.

4) Preparation of Hydrogen-bonding Compound-1 Dispersion

Ten kg of hydrogen-bonding compound-1 (tri(4-t-butylphenyl)phosphine oxide), 16 kg of a 10 mass % aqueous solution of modified polyvinyl alcohol (POVAL MP203 available from Kuraray Co., Ltd.) and 10 kg of water were sufficiently mixed to form slurry. The slurry was fed by a diaphragm pump into a horizontal sand mill (UVM-2 available from Imex Corporation) containing zirconia beads which had a mean diameter of 0.5 mm, and stirred therewith for 4 hours. Then, 0.2 g of sodium salt of benzoisothiazolinone and water were added thereto to adjust the hydrogen-bonding compound concentration of the resultant at 25% by mass. The resultant dispersion was heated at 40° C. for 1 hour and subsequently heated at 80° C. for 1 hour. A hydrogen-bonding compound-1 dispersion was thus prepared. The hydrogen-bonding compound particles in the dispersion had a median diameter of 0.45 μm, and a maximum particle size of at most 1.3 μm. The hydrogen-bonding compound dispersion was filtered through a polypropylene filter having a pore size of 3.0 μm to remove foreign objects such as dirt from it, and then stored.

5) Preparation of Development Accelerator-1 Dispersion

Ten kg of development accelerator-1, 20 kg of a 10 mass % aqueous solution of modified polyvinyl alcohol (POVAL MP203 available from Kuraray Co., Ltd.) and 10 kg of water were sufficiently mixed to form slurry. The slurry was fed by a diaphragm pump into a horizontal sand mill (UVM-2 available from Imex Corporation) containing zirconia beads which had a mean diameter of 0.5 mm, and stirred therewith for 3 hours and 30 minutes. Then, 0.2 g of sodium salt of benzoisothiazolinone and water were added thereto to prepare a development accelerator-1 dispersion having a development accelerator concentration of 20% by mass. The development accelerator particles in the dispersion had a median diameter of 0.48 μm, and a maximum particle size of at most 1.4 μm. The development accelerator dispersion was filtered through a polypropylene filter having a pore size of 3.0 μm to remove foreign objects such as dirt from it, and then stored.

6) Preparation of Development Accelerator-2 Dispersion and Color Tone Adjusting Agent-1 Dispersion Development accelerator-2 and color tone adjusting agent-1 solid dispersions respectively having concentrations of 20 mass % and 15 mass % were prepared in the same manner as the development accelerator-1 dispersion. The structures of the development accelerator-2 and the color tone adjusting agent-1 are shown later.

7) Preparation of Polyhalogen Compound Dispersion

<<Preparation of Organic Polyhalogen Compound-1 Dispersion>>

Ten kg of organic polyhalogen compound-1 (tribromomethanesulfonylbenzene), 10 kg of a 20 mass % aqueous solution of modified polyvinyl alcohol (POVAL MP203 available from Kuraray Co., Ltd.), 0.4 kg of a 20 mass % aqueous solution of sodium triisopropylnaphthalenesulfonate, and 14 kg of water were sufficiently mixed to prepare slurry. The slurry was fed by a diaphragm pump into a horizontal sand mill (UVM-2 available from Imex Corporation) including zirconia beads which had a mean diameter of 0.5 mm, and stirred therewith for 5 hours. Then, 0.2 g of sodium salt of benzoisothiazolinone and water were added thereto to prepare an organic polyhalogen compound-1 dispersion having an organic polyhalogen compound concentration of 26 mass %. The organic polyhalogen compound particles in the dispersion had a median diameter of 0.41 μm, and a maximum particle size of at most 2.0 μm. The organic polyhalogen compound dispersion was filtered through a polypropylene filter having a pore size of 10.0 μm to remove foreign objects such as dirt from it, and then stored.

<<Preparation of Organic Polyhalogen Compound-2 Dispersion>>

Ten kg of organic polyhalogen compound-2 (N-butyl-3-tribromomethanesulfonylbenzamide), 20 kg of a 10 mass % aqueous solution of modified polyvinyl alcohol (POVAL MP203 available from Kuraray Co., Ltd.), and 0.4 kg of a 20 mass % aqueous solution of sodium triisopropylnaphthalenesulfonate were sufficiently mixed to prepare slurry. The slurry was fed by a diaphragm pump into a horizontal sand mill (UVM-2 available from Imex Corporation) including zirconia beads which had a mean diameter of 0.5 mm, and stirred therewith for 5 hours. Then, 0.2 g of sodium salt of benzoisothiazolinone and water were added thereto to adjust the organic polyhalogen compound concentration of the resultant at 30 mass %. The resultant dispersion was heated at 40° C. for 5 hours. An organic polyhalogen compound-2 dispersion was thus obtained. The organic polyhalogen compound particles in the dispersion had a median diameter of 0.40 μm, and a maximum particle size of at most 1.3 μm. The organic polyhalogen compound dispersion was filtered through a polypropylene filter having a pore size of 3.0 μm to remove foreign objects such as dirt from it, and then stored.

8) Preparation of Phthalazine Compound-1 Solution

Eight kg of modified polyvinyl alcohol (MP203 manufactured by Kuraray Co., Ltd.) was dissolved in 174.57 kg of water. Thereafter, 3.15 kg of a 20 mass % aqueous solution of sodium triisopropylnaphthalenesulfonate and 14.28 kg of a 70 mass % aqueous solution of phthalazine compound-1 (6-isopropylphthalazine) were added to the resultant solution to prepare a 5 mass % phthalazine compound-1 solution.

9) Preparation of Mercapto Compound

<<Preparation of Aqueous Solution of Mercapto Compound-1>>

Seven grams of mercapto compound-1 (sodium salt of 1-(3-sulfophenyl)-5-mercaptotetrazole) was dissolved in 993 g of water to form a 0.7 mass % aqueous solution.

<<Preparation of Aqueous Solution of Mercapto Compound-2>>

Twenty grams of mercapto compound-2 (1-(3-methylureidophenyl)-5-mercaptotetrazole) was dissolved in 980 g of water to form a 2.0 mass % aqueous solution.

10) Preparation of Comparative Pigment-1 Dispersion

Sixty-four g of C.I. Pigment Blue 60 and 6.4 g of DEMOL N manufactured by Kao Corp. were added to and well mixed with 250 g of water to prepare slurry. 800 g of zirconia beads having a mean diameter of 0.5 mm was placed in a vessel together with the slurry, and the mixture was stirred with a dispersing machine (1/4G sand grinder mill manufactured by Imex Co.) for 25 hours. Water was added to the resultant dispersion to prepare a pigment-1 dispersion having a pigment concentration of 5 mass %. The pigment dispersion thus obtained contained pigment particles having a mean particle size of 0.21 μm.

11) Preparation of SBR Latex

An SBR latex was prepared as follows.

287 g of distilled water, 7.73 g of a surfactant (PIONIN A-43-S produced by Takemoto Yushi Corporation and having a solid content of 48.5 mass %), 14.06 ml of 1 mol/liter NaOH, 0.15 g of tetrasodium ethylenedianinetetraacetate, 255 g of styrene, 11.25 g of acrylic acid, and 3.0 g of tert-dodecylmercaptan were put into the polymerization reactor of a gas monomer reaction apparatus (TAS-2J Model available from Taiatsu Techno Corporation). The reactor was sealed off, and the content therein was stirred at 200 rpm. The internal air was exhausted via a vacuum pump, and replaced a few times repeatedly with nitrogen. Then, 108.75 g of 1,3-butadiene was introduced into the reactor under pressure, and the internal temperature of the reactor was raised to 60° C. A solution in which 1.875 g of ammonium persulfate was dissolved in 50 ml of water was added to the system, and the system was stirred for 5 hour. It was heated to 90° C. and stirred for 3 hours at that temperature. After the reaction was completed, the internal temperature was lowered to room temperature. Then, NaOH and $NH_4OH$ (both 1 mol/liter) were added to the system at a molar ratio of $Na^+$ to $NH_4^+$ of 1/5.3 so as to adjust the pH of the system at 8.4. Next, the system was filtered through a polypropylene filter having a pore size of 1.0 μm to remove foreign objects such as dirt from it, and then stored. 774.7 g of SBR latex TP-1 was thus obtained. Its halide ion content was measured through ion chromatography, and the chloride ion concentration of the latex was 3 ppm. The chelating agent concentration thereof was measured through high-performance liquid chromatography, and was 145 ppm.

The gelation rate of the latex was 763 mass %, the mean particle size of the latex was 90 nm, Tg thereof was 17° C., the solid content thereof was 44% by mass, the equilibrium moisture content thereof at 25° C. and 60% RH was 0.6 mass %, and the ionic conductivity thereof was 4.80 mS/cm. To measure the ionic conductivity, a conductivity meter CM-30S manufactured by Toa Denpa Kogyo K. K. was used. In the device, the 44 mass % latex was used at 25° C.

2. Preparation of Coating Liquid

1) Preparation of Image-forming Layer Coating Liquids 1–5

1,000 g of the dispersion of silver salt of fatty acid, 135 ml of water, dye (the inventive or comparative dye or pigment was added in accordance with Table 3), 25 g of the organic polyhalogen compound-1 dispersion, 39 g of the organic polyhalogen compound-2 dispersion, 171 g of the phthalazine compound-1 solution, 1,060 g of the SBR latex, 77 g of the reducer-1 dispersion, 77 g of the reducer-2 dispersion, 22 g of the hydrogen-bonding compound-1 dispersion, 4.8 g of the development accelerator-1 dispersion, 5.2 g of the development accelerator-2 dispersion, 2.1 g of the color tone adjusting agent-1 dispersion, and 8 ml of the aqueous mercapto compound-2 solution were mixed one by one, and 140 g of the silver halide emulsion A was added to the resultant mixture immediately before coating, and the resulting image-forming layer coating liquid was stirred well and fed into a coating die as it was.

The viscosity of the image-forming layer coating liquid was measured by a type-B viscometer available from Tokyo Keiki Co,. Ltd. at 40° C. (No. 1 rotor, 60 rpm) was 35 [mPa.s].

The viscosity of the image-forming layer coating liquid, measured by RHEOSTRESS RS150 manufactured by Haake at 38° C., was 38, 49, 48, 34, and 25 [mPa.s] at a shear rate of 0.1, 1, 10, 100, and 1000 [l/second], respectively.

The zirconium content of the image-forming layer coating liquid was 0.30 mg per g of silver.

2) Preparation of Intermediate Layer A Coating Liquid

Twenty-seven ml of a 5 mass % aqueous solution of AEROSOL OT (manufactured by American Cyanamide), and 135 ml of a 20 mass % aqueous diammonium phthalate solution were added to a mixture of 1,000 g of polyvinyl alcohol PVA-205 (manufactured by Kuraray Co., Ltd.), 27 ml of a 5 mass % aqueous sodium di(2-ethylhexyl) sulfosuccinate solution, and 4,200 ml of a 19 mass % latex solution of methyl methacrylate/styrene/butyl acrylate/hydroxyethyl methacrylate/acrylic acid copolymer (copolymerization mass ratio of 57/8/28/5/2). Water was added to the resultant blend so that the total amount of the resultant was 10,000 g. NaOH was added to the resulting mixture so as to adjust the pH of the resultant at 7.5. Thus, an intermediate layer coating liquid was obtained and fed into a coating die at a rate of 8.9 ml/$m^2$.

The viscosity of the intermediate layer coating liquid was measured by a type-B viscometer at 40° C. (No. 1 rotor, 60 rpm) was 58 [mPa.s].

3) Preparation of Intermediate Layer B Coating Liquid

Hundred grams of inert gelatin and 10 mg of benzisothiazolinone were dissolved in 840 ml of water, and 180 g of a 19 mass % latex of methyl methacrylate/styrene/butyl acrylate/hydroxyethyl methacrylate/acrylic acid copolymer (copolymerization mass ratio of these monomers of 57/8/28/5/2), 46 ml of a 15 mass % phthalic acid methanol solution, and 5.4 ml of a 5 mass % aqueous solution of di(2-ethylhexyl) sodium sulfoscuccinate were added to the resultant solution. Forty ml of a 4 mass % chromium alum solution was added to the resulting blend immediately before coating, and the resulting mixture was fed to a coating die at a rate of 26.1 ml/$m^3$.

The viscosity of the coating liquid was measured by a type-B viscometer at 40° C. (No. 1 rotor, 60 rpm), and was 20 mPa.s.

4) Preparation of Outermost Layer Coating Liquid

Preparation of Outermost Layer Coating Liquid-1

Hundred grams of inert gelatin and 10 mg of benzisothiazolinone were dissolved in 800 ml of water, and 40 g of a 10 mass % liquid paraffin emulsion, 40 g of a 10 mass % dipentaerythrityl hexaisostearate emulsion, 180 g of a 19 mass % latex of methyl methacrylate/styrene/butyl acrylate/hydroxyethyl methacrylate/acrylic acid copolymer (copolymerization mass ratio of these monomers of 57/8/28/5/2), 40 ml of a 15 mass % phthalic acid methanol solution, 5.5 ml of a 1 mass % solution of fluorinated surfactant (F-1), 5.5 ml of a 1 mass % aqueous solution of fluorinated surfactant (F-2), 28 ml of a 5 mass % aqueous solution of di(2-ethylhexyl) sodium sulfoscuccinate, 4 g of polymethyl methacrylate fine particles (average particle size of 0.7 μm and volume-weighted average distribution of 30%), and 21 g of polymethyl methacrylate fine particles (average particle size of 3.6 μm and volume-weighted average distribution of 60%) were added to the resultant solution. A surface protective layer coating liquid was thus obtained, and was then fed to a coating die at a rate of 8.3 ml/m$^2$.

The viscosity of the coating liquid was measured by a type-B viscometer at 40° C. (No. 1 rotor, 60 rpm), and was 19 mPa.s.

<<Preparation of Outermost Layer Coating Liquids 2 to 5>>

Outermost layer coating liquids 2 to 5 were prepared in the same manner as the outermost layer-coating liquid 1, except that the inert gelatin and the latex of methyl methacrylate/styrene/butyl acrylate/hydroxyethyl methacrylate/acrylic acid copolymer (copolymerization mass ratio of 57/8/28/5/2) were respectively replaced with latex polymers shown in Table 3.

3. Preparation of Photothermographic Material

1) Preparation of Photothermographic Materials 1–17

The image-forming layer coating liquid, the intermediate layer A coating liquid, the intermediate layer B coating liquid and the outermost layer coating liquid were simultaneously applied to the surface of the undercoated support which was opposite to the back layer side of the undercoated support in that order by a slide bead coating method to prepare a sample of a photothermographic material. At this time, the temperature of the image-forming layer coating liquid and the intermediate layer A coating liquid was adjusted at 31° C., the temperature of the intermediate layer B coating liquid was adjusted at 36° C., and the temperature of the outermost layer coating liquid was adjusted at 37° C.

The amount (g/m$^2$) of each of the compounds of the image-forming layer is as follows.

| | |
|---|---|
| Organic silver salt | 4.88 |
| Pigment (C.I. Pigment Blue 60) | 0.0324 |
| Polyhalogen compound-1 | 0.108 |
| Polyhalogen compound-2 | 0.225 |
| Phthalazine compound-1 | 0.161 |
| SBR latex | 8.73 |
| Reducer-1 | 0.36 |
| Reducer-2 | 0.36 |
| Hydrogen-bonding compound-1 | 0.522 |
| Development accelerator-1 | 0.019 |
| Development accelerator-2 | 0.016 |
| Color tone adjusting agent-1 | 0.006 |
| Mercapto compound-1 | 0.0018 |
| Mercapto compound-2 | 0.0108 |
| Silver of silver halide | 0.09 |

Coating and drying conditions are as follows.

Before coating, the electricity of the support was eliminated by blowing an ion blow to the support. The coating speed was 160 m/minute. The distance between the coating die tip and the support was within the range of 0.10–0.30 mm. The pressure in the decompression chamber was lower by 196 to 882 Pa than the atmospheric pressure.

In the subsequent chilling zone, the coated support was chilled with an air blow (its dry-bulb temperature was 10 to 20° C.). The support was transported to the next zone, while kept not in contact with any member. In the next helix-type contactless drying zone, the support was dried with a dry air blow (its dry-bulb temperature was 23 to 45° C., and its wet-bulb temperature was 15 to 21° C.).

After the drying, the support was conditioned at 25° C. at humidity in the range of 40 to 60% RH. Then, the support was heated so that the surface temperature was between 70 and 90° C. After the heating, the support was cooled down to reduce the surface temperature to 25° C.

The degree of matting, in terms of the Beck's smoothness, of the image-forming layer side of the thermographic material thus prepared was 550 seconds and that of the back layer side was 130 seconds. The pH of the image-forming layer side was measured and was found to be 6.0.

The chemical structures of the compounds used in the example are shown below.

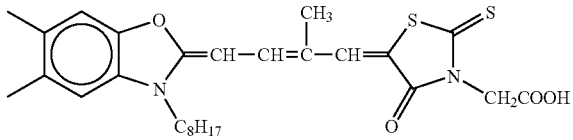

Spectral sensitizing dye A

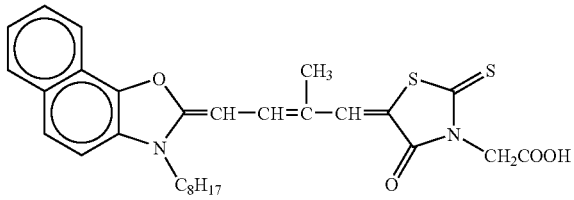

Spectral sensitizing dye B

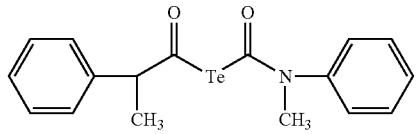

Tellurium sensitizer C

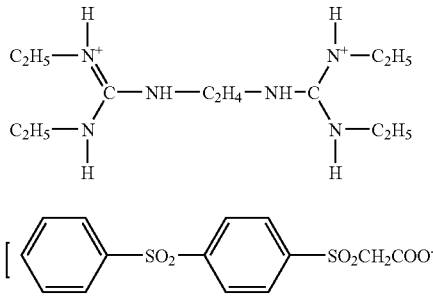

Base precursor compound-1

-continued

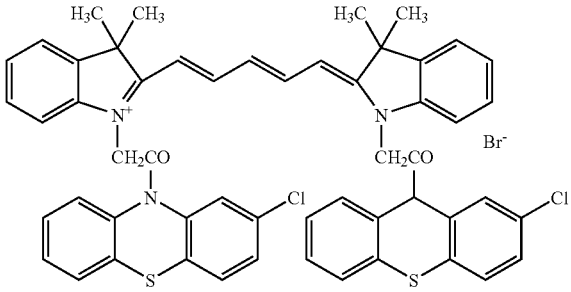

Cyanine dye compound-1

Compound 1 that can be one-electron-oxidized to provide a one-electron oxidant which releases one or more electrons

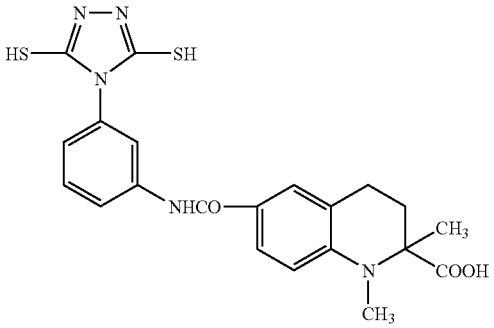

Compound 2 that can be one-electron-oxidized to provide a one-electron oxidant which releases one or more electrons

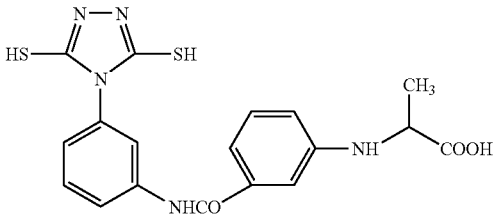

Compound 3 that can be one-electron-oxidized to provide a one-electron oxidant which releases one or more electrons

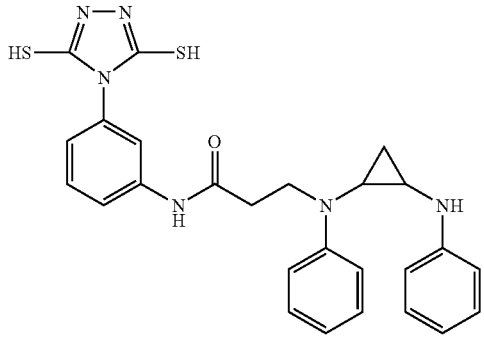

Compound 1 having adsorptive and reductive groups

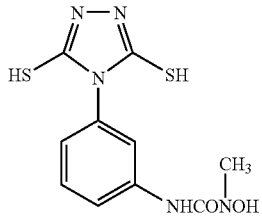

Compound 2 having adsorptive and reductive groups

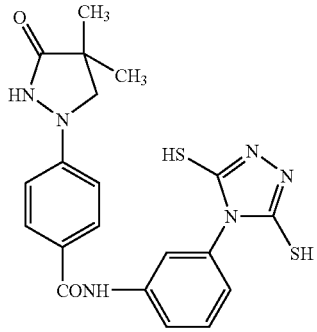

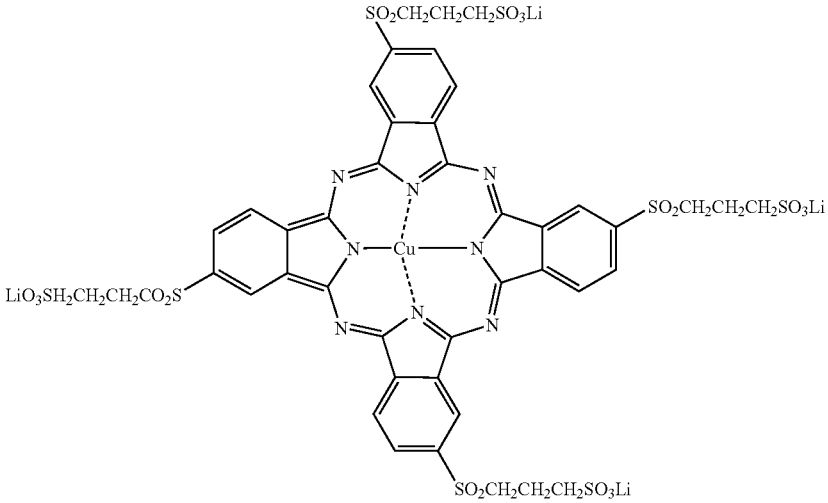
Comparative dye compound-1
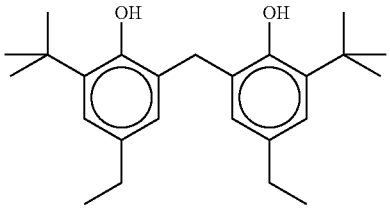
Reducer-1
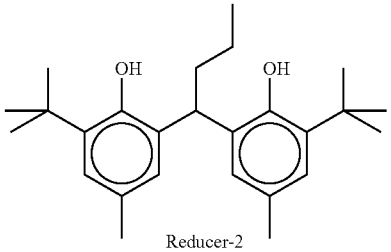
Reducer-2
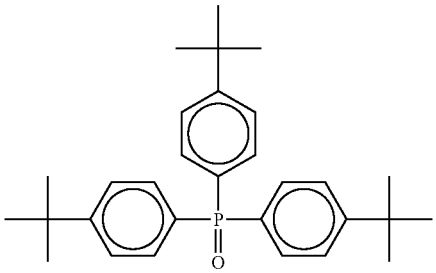
Hydrogen-bonding compound-1
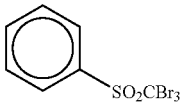
Polyhalogen compound-1
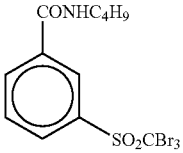
Polyhalogen compound-2
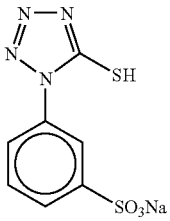
Mercapto compound-1
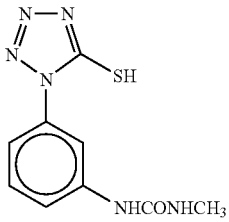
Mercapto compound-2
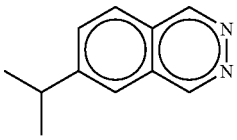
Phthalazine compound-1

-continued

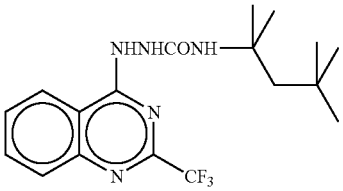

Develpoment accelerator-1

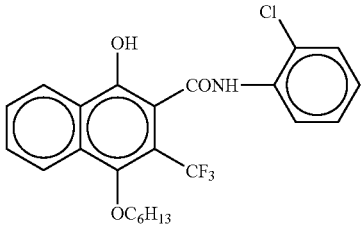

Develpoment accelerator-2

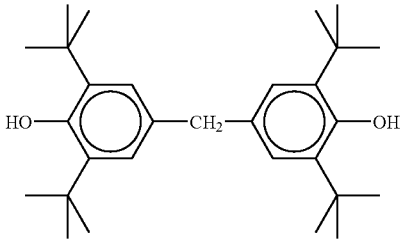

Color tone adjusting agent-1 mixture of the following compounds

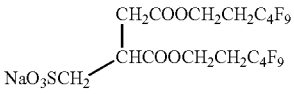

F-1

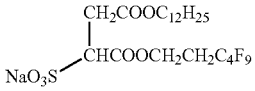

F-2

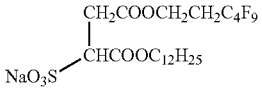

TABLE 3

| | Image-forming layer | | | Outermost layer | | | |
|---|---|---|---|---|---|---|---|
| Sample No. | Coating liquid No. | Dye | Coating amount ($mg/m^2$) | Coating liquid No. | Binder | Blending ratio (mass ratio) | Remarks |
| 1 | 1 | Comparative pigment-1 | 45 | 1 | Gelatin | — | Comparative Example |
| 2 | 2 | Comparative pigment-1 | 90 | 1 | Gelatin | — | Comparative Example |
| 3 | 3 | Comparative blue dye-1 | 25 | 1 | Gelatin | — | Comparative Example |
| 4 | 3 | Comparative blue dye-1 | 25 | 2 | Gel/latex No. NP-3 | 30/70 | Comparative Example |
| 5 | 3 | Comparative blue dye-1 | 25 | 3 | Gel/latex No. NP-4 | 30/70 | Comparative Example |
| 6 | 3 | Comparative blue dye-1 | 25 | 4 | Gel/latex No. NP-12 | 30/70 | Comparative Example |
| 7 | 3 | Comparative blue dye-1 | 25 | 5 | Gel/latex No. NP-14 | 30/70 | Comparative Example |
| 8 | 4 | Compound No. 11 of Formula (PC-1) | 25 | 1 | Gelatin | — | Comparative Example |
| 9 | 4 | Compound No. 11 of Formula (PC-1) | 25 | 2 | Gel/latex No. NP-3 | 30/70 | Inventive Example |
| 10 | 4 | Compound No. 11 of Formula (PC-1) | 25 | 3 | Gel/latex No. NP-4 | 30/70 | Inventive Example |
| 11 | 4 | Compound No. 11 of Formula (PC-1) | 25 | 4 | Gel/latex No. NP-12 | 30/70 | Inventive Example |
| 12 | 4 | Compound No. 11 of Formula (PC-1) | 25 | 5 | Gel/latex No. NP-14 | 30/70 | Inventive Example |
| 13 | 5 | Dispersion 101 described in U.S. Pat. No. 6,830,879 | 40 | 1 | Gelatin | — | Comparative Example |
| 14 | 5 | Dispersion 101 described in U.S. Pat. No. 6,830,879 | 40 | 2 | Gel/latex No. NP-3 | 30/70 | Inventive Example |

TABLE 3-continued

| | Image-forming layer | | | Outermost layer | | | |
|---|---|---|---|---|---|---|---|
| Sample No. | Coating liquid No. | Dye | Coating amount ($mg/m^2$) | Coating liquid No. | Binder | Blending ratio (mass ratio) | Remarks |
| 15 | 5 | Dispersion 101 described in U.S. Pat. No. 6,830,879 | 40 | 3 | Gel/latex No. NP-4 | 30/70 | Inventive Example |
| 16 | 5 | Dispersion 101 described in U.S. Pat. No. 6,830,879 | 40 | 4 | Gel/latex No. NP-12 | 30/70 | Inventive Example |
| 17 | 5 | Dispersion 101 described in U.S. Pat. No. 6,830,879 | 40 | 5 | Gel/latex No. NP-14 | 30/70 | Inventive Example |

Evaluation of Photographic Performance

1) Preparation

Each sample thus prepared was cut into pieces of a half-size having a length of 43 cm and width of 35 cm, and the pieces were packaged with a packaging material mentioned below at 25° C. and 50% RH, stored at ordinary temperature for two weeks, and tested according to test methods described later.

<Packaging Material>

The packaging material used herein was a laminated film including a PET film having a thickness of 10 μm, a PE film having a thickness of 12 μm, an aluminum foil having a thickness of 9 μm, a nylon film having a thickness of 15 μm, and a 2% carbon-containing polyethylene film having a thickness of 50 μm, and having an oxygen permeability of 0.02 ml/atm.$m^2$.25° C.day and a moisture permeability of 0.10 g/atm.$m^2$.25° C.day.

2) Exposure and Thermal Development of Photosensitive Material

Each sample was exposed to light and thermally developed with a dry laser imager DRYPIX 7000 manufactured by Fuji Film Medical Co., Ltd. (equipped with a semiconductor laser emitting light having a wavelength of 660 nm and having a maximum output of 50 mW (IIIB) and with three panel heaters respectively kept at 107° C., 121° C., and 121° C.) to form an image. The total developing time was 14 seconds. The optical density of the image was measured with a densitometer.

3) Evaluation Items

Spectral Absorption Spectrum

The spectral absorption spectrum of the unexposed area of each sample was measured with a spectrometer, and the absorbances at 550 and 660 nm were determined.

Color Tone

The unexposed area after heat development was sensorily evaluated by ten raters. The evaluation criteria are as follows: The rate which more raters indicated was the rate for the sample.

A: Good transmission photographic material with low density, and high clearness

B: Transmission photographic material which has slight color tint but is practically acceptable C: Transmission photographic material which has strong color tint and is not practically acceptable Sharpness Each sample was exposed to light and thermally developed in the above manner, except that a rectangular wave pattern was used for the exposure. A value obtained by dividing the density difference of a rectangular wave pattern having a spatial frequency of 5 lines/mm by that of a rectangular wave pattern having a spatial frequency of 0.01 lines/mm was designated as value A, and the relative value (%) obtained by dividing value A of each sample by that of sample 1 was used as the sharpness of the sample. A larger sharpness is more preferable.

Image Storability

The unexposed area of each sample after thermal development which unexposed area was uncovered was stored in a humidity-conditioned environment of 40° C. and 90% RH for one week, which is assumed the sample being stored in a high-temperature high-humidity environment.

The color of transmission light of the sample film was determined according to the method of JIS Z8722: 2000 before and after the storage in the environment of 40° C. and 90% RH. At this time, L*, a*, and b* in the CIELAB color space were determined with a F5 fluorescent lamp light source (observation light source) serving as a reference.

The following value D was calculated from Δa*, change between a* before the storage under the high-temperature and high-humidity environment and that after the storage, and Δb*, change between b* before the storage and that after the storage.

$$D=(\Delta a^{*2}+\Delta b^{*2})^{1/2}.$$

The value D indicates change between color before the storage and that after the storage. The smaller the value D is, the better image storability is.

4) Evaluation Results

The results thus obtained are summarized in Table 4.

The samples of the invention had superior color and an improved sharpness. In addition, the degree of color change of these samples which color change was due to storage under the high-temperature and high-humidity environment was smaller, and the image storability of the samples was good.

TABLE 4

| Sample No. | Absorbance at 550 nm | Absorbance at 660 nm | Color | Sharpness | Image storability | Remarks |
|---|---|---|---|---|---|---|
| 1 | 0.11 | 0.16 | B | 100% | 0.51 | Comparative Example |
| 2 | 0.21 | 0.32 | C | 125% | 1.10 | Comparative Example |
| 3 | 0.16 | 0.24 | C | 112% | 0.45 | Comparative Example |
| 4 | 0.16 | 0.24 | C | 112% | 0.50 | Comparative Example |
| 5 | 0.16 | 0.24 | C | 112% | 0.38 | Comparative Example |
| 6 | 0.16 | 0.24 | C | 112% | 0.55 | Comparative Example |
| 7 | 0.16 | 0.24 | C | 112% | 0.48 | Comparative Example |
| 8 | 0.10 | 0.45 | A | 134% | 1.21 | Comparative Example |
| 9 | 0.10 | 0.45 | A | 134% | 0.32 | Inventive Example |
| 10 | 0.10 | 0.45 | A | 134% | 0.38 | Inventive Example |
| 11 | 0.10 | 0.45 | A | 134% | 0.45 | Inventive Example |
| 12 | 0.10 | 0.45 | A | 134% | 0.47 | Inventive Example |
| 13 | 0.08 | 0.40 | A | 129% | 2.68 | Comparative Example |
| 14 | 0.08 | 0.40 | A | 129% | 0.49 | Inventive Example |
| 15 | 0.08 | 0.40 | A | 129% | 0.48 | Inventive Example |
| 16 | 0.08 | 0.40 | A | 129% | 0.53 | Inventive Example |
| 17 | 0.08 | 0.40 | A | 129% | 0.56 | Inventive Example |

Example 2

Samples 21 to 24 were prepared and evaluated in the same manner as the sample 10 of Example 1, except that the compound No. 11 of Formula (PC-1) was replaced respectively with the compounds Nos. 28, 92, 116, and 137.

These samples of the invention showed good results, as in Example 1.

Example 3

Example Using Aggregation Dye

Samples 31 to 34 were prepared and evaluated in the same manner as the sample 15 of Example 1, except that the dispersion 101 described in U.S. Pat. No. 6,830,879 was replaced respectively with dispersions 102 and 103 described in U.S. Pat. No. 6,830,879 and aggregate dye dispersions 107 and 109 described in JP-A No. 2003-84395.

When known aggregation dyes are used, use of a polymer latex in the outermost layer in an amount of 50% or more resulted in good image storability, as in Example 1.

Example 4

A sample 41 was prepared and evaluated in the same manner as the sample 10 of Example 1, except that a gelling agent, K-carrageenan, was added to the outermost layer in an amount of 0.1 g/m$^2$. The sample had an improved coated surface state. In addition, the sample had good image storability, as in the sample 10.

What is claimed is:

1. A photothermographic material, comprising: a support and an image-forming layer comprising a photosensitive silver halide, a non-photosensitive organic silver salt, a reducer, and a binder on at least one surface of the support, wherein the photothermographic material further contains a dye having a half breadth of 100 nm or less at a maximum absorbance peak, 50 mass % or more of a binder in an outermost layer on a dye-containing surface is a polymer latex, and the dye is a metal phthalocyanine dye represented by Formula (PC-1):

Formula (PC-1)

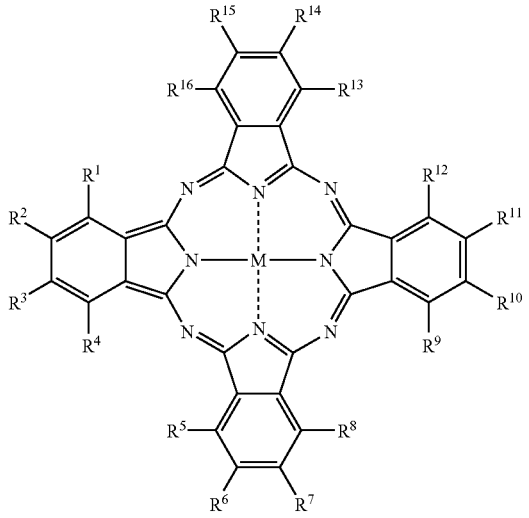

wherein, M represents a metal atom; $R^1$, $R^4$, $R^5$, $R^8$, $R^9$, $R^{12}$, $R^{13}$, $R^{16}$ independently represent a hydrogen atom or a substituent; at least one of $R^1$, $R^4$, $R^5$, $R^8$, $R^9$, $R^{12}$, $R^{13}$ and $R^{16}$ represents an electron-attractive group; and $R^2$, $R^3$, $R^6$, $R^7$, $R^{10}$, $R^{11}$, $R^{14}$, and $R^{15}$ each represent a hydrogen atom.

2. The photothermographic material of claim 1, wherein the photothermographic material has the image-forming layer on one surface of the support and a back layer on the other surface of the support, and the dye is contained in the back layer.

3. The photothermographic material of claim 1, wherein the photothermographic material has at least one layer including the image-forming layer on one surface of the support and the dye is contained in at least one of the at least one layer.

4. The photothermographic material of claim 3, wherein the image-forming layer contains the dye.

5. The photothermographic material of claim 4, wherein 50 mass % or more of the binder in the image-forming layer is a polymer latex.

6. The photothermographic material of claim 1 wherein, in Formula (PC-1), at least one of $R^1$, $R^4$, $R^5$, $R^8$, $R^9$, $R^{12}$, $R^{13}$, and $R^{16}$ represents a group represented by Formula (II):

$$-L^1-R^{17} \qquad \text{Formula (II)}$$

wherein, $L^1$ represents **—$SO_2$—*, **—$SO^3$—*, **—$SO^2NR_N$—*, **—SO—*, **—CO—*, **—$CONR_N$—*, **—COO—*, **—COCO—*, **—$COCO_2$—*, or **—$COCONR_N$—*; ** represents a site at which the group is connected to the phthalocyanine skeleton; and * represents a site at which the group is connected to $R^{17}$; $R_N$ represents a hydrogen atom or an alkyl, aryl, heterocyclic, acyl, alkoxycarbonyl, carbamoyl, sulfonyl, or sulfamoyl group; and $R^{17}$ represents a hydrogen atom or an alkyl, aryl, or heterocyclic group.

7. The photothermographic material of claim 6, wherein, in Formula (PC-1), four or more of $R^1$, $R^4$, $R^5$, $R^8$, $R^9$, $R^{12}$, $R^{13}$, and $R^{16}$ are each a group represented by Formula (II).

8. The photothermographic material of claim 1, wherein the glass transition temperature of the polymer latex in the outermost layer is −20° C. to 70° C.

9. The photothermographic material of claim 1, wherein the outermost layer contains a gelling agent.

10. The photothermographic material of claim 3, further comprising a non-photosensitive intermediate layer between the outermost layer and the image-forming layer.

11. The photothermographic material of claim 10, wherein the photothermographic material comprises at least two non-photosensitive intermediate layers, and 50 mass % or more of a binder in a non-photosensitive intermediate layer adjacent to the image-forming layer is a polymer latex having a monomer component represented by the following Formula (M):

$$CH_2{=}CR^{01}{-}CR^{02}{=}CH_2 \qquad \text{Formula (M)}$$

wherein, $R^{01}$ and $R^{02}$ each represent a hydrogen, an alkyl group having 1 to 6 carbon atoms, a halogen atom or a cyano group.

12. The photothermographic material of claim 11, wherein $R^{01}$ and $R^{02}$ in Formula (M) are each a hydrogen atom, or one of $R^{01}$ and $R^{02}$ is a hydrogen atom and the other is a methyl group.

13. A photothermographic material, comprising: a support and an image-forming layer comprising a photosensitive silver halide, a non-photosensitive organic silver salt, a reducer, and a binder on at least one surface of the support, wherein the photothermographic material further contains a dye having a half breadth of 100 nm or less at a maximum absorbance peak, 50 mass % or more of a binder in an outermost layer on a dye-containing surface is a polymer latex, the photothermographic material has at least one layer including the image-forming layer on one surface of the support and the dye is contained in at least one of the at least one layer, the photothermographic material further comprises at least two non-photosensitive intermediate layers between the outermost layer and the image-forming layer, 50 mass % or more of a binder in a non-photosensitive intermediate layer adjacent to the image-forming layer is a polymer latex having a monomer component represented by the following Formula (M), and in the at least two non-photosensitive intermediate layers, 50 mass % or more of a binder for a non-photosensitive intermediate layer adjacent to the outermost layer is an animal protein-derived hydrophilic polymer:

$$CH_2{=}CR^{01}{-}CR^{02}{=}CH_2 \qquad \text{Formula (M)}$$

wherein, $R^{01}$ and $R^{02}$ each represent a hydrogen, an alkyl group having 1 to 6 carbon atoms, a halogen atom or a cyano group.

14. The photothermographic material of claim 13, wherein, the animal protein-derived hydrophilic polymer is gelatin.

15. The photothermographic material of claim 13, wherein the photothermographic material has the image-forming layer on one surface of the support and a back layer on the other surface of the support, and the dye is contained in the back layer.

16. The photothermographic material of claim 13, wherein the image-forming layer contains the dye.

17. The photothermographic material of claim 16, wherein 50 mass % or more of the binder in the image-forming layer is a polymer latex.

18. The photothermographic material of claim 13, wherein the dye is a water-soluble dye.

19. The photothermographic material of claim 18, wherein the water-soluble dye is a metal phthalocyanine dye represented by Formula (PC-1):

Formula (PC-1)

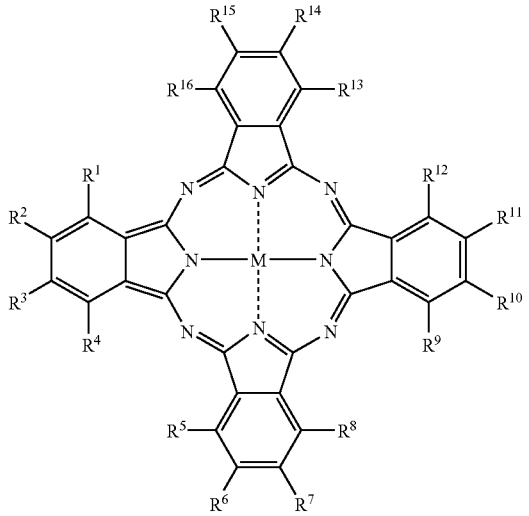

wherein, M represents a metal atom; $R^1$, $R^4$, $R^5$, $R^8$, $R^9$, $R^{12}$, $R^{13}$, $R^{16}$ independently represent a hydrogen atom or a substituent; at least one of $R^1$, $R^4$, $R^5$, $R^8$, $R^9$, $R^{12}$, $R^{13}$, and $R^{16}$ represents an electron-attractive group; and $R^2$, $R^3$, $R^6$, $R^7$, $R^{10}$, $R^{11}$, $R^{14}$, and $R^{15}$ independently represent a hydrogen atom or a substituent.

20. The photothermographic material of claim 19, wherein, in Formula (PC-1), at least one of $R^1$, $R^4$, $R^5$, $R^8$, $R^9$, $R^{12}$, $R^{13}$, and $R^{16}$ represents a group represented by Formula (II):

$-L^1-R^{17}$ Formula (II)

wherein, $L^1$ represents **—$SO_2$—*, **—$SO_3$—*, **—$SO_2NR_N$—*, **—SO—*, **—CO—*, **—$CONR_N$—*, **—COO—*, **—COCO—*, **—$COCO_2$—*, or **—$COCONR_N$—*; ** represents a site at which the group is connected to the phthalocyanine skeleton; and * represents a site at which the group is connected to $R^{17}$; $R_N$ represents a hydrogen atom or an alkyl, aryl, heterocyclic, acyl, alkoxycarbonyl, carbamoyl, sulfonyl, or sulfamoyl group; and $R^{17}$ represents a hydrogen atom or an alkyl, aryl, or heterocyclic group.

21. The photothermographic material of claim 20, wherein, in Formula (PC-1), four or more of $R^1$, $R^4$, $R^5$, $R^8$, $R^9$, $R^{12}$, $R^{13}$, and $R^{16}$ are each a group represented by Formula (II).

22. The photothermographic material of claim 18, wherein the water-soluble dye is an aggregation dye.

23. The photothermographic material of claim 22, wherein the aggregation dye is a polymethine dye.

24. The photothermographic material of claim 23, wherein the polymethine dye is a cyanine or oxonol dye.

25. The photothermographic material of claim 13, wherein the glass transition temperature of the polymer latex in the outermost layer is −20° C. to 70° C.

26. The photothermographic material of claim 13, wherein the outermost layer contains a gelling agent.

27. The photothermographic material of claim 13, wherein $R^{01}$ and $R^{02}$ in Formula (M) are each a hydrogen atom, or one of $R^{01}$ and $R^{02}$ is a hydrogen atom and the other is a methyl group.

* * * * *